US010724298B2

(12) United States Patent
Colson et al.

(10) Patent No.: US 10,724,298 B2
(45) **Date of Patent: *Jul. 28, 2020**

(54) ROLL-UP RETRACTABLE COVERING FOR ARCHITECTURAL OPENINGS

(71) Applicant: Hunter Douglas Inc., Pearl River, NY (US)

(72) Inventors: Wendell B. Colson, Weston, MA (US); Terrence M. Drew, Superior, CO (US); Paul G. Swiszcz, Niwot, CO (US); Jason T. Throne, Rockport, ME (US)

(73) Assignee: Hunter Douglas Inc., Pearl River, NY (US)

( * ) Notice: Subject to any disclaimer, the term of this patent is extended or adjusted under 35 U.S.C. 154(b) by 164 days.

This patent is subject to a terminal disclaimer.

(21) Appl. No.: 15/419,187

(22) Filed: Jan. 30, 2017

(65) Prior Publication Data

US 2017/0138127 A1 May 18, 2017

Related U.S. Application Data

(63) Continuation of application No. 14/311,649, filed on Jun. 23, 2014, now Pat. No. 9,587,430, which is a (Continued)

(51) Int. Cl.
*A47H 5/02* (2006.01)
*E06B 9/42* (2006.01)
(Continued)

(52) U.S. Cl.
CPC ..... *E06B 9/42* (2013.01); *A47H 2/00* (2013.01); *A47H 5/032* (2013.01); *A47H 5/0325* (2013.01);
(Continued)

(58) Field of Classification Search
CPC ..... E06B 9/56; E06B 9/42; E06B 9/40; E06B 9/44; E06B 9/36; E06B 9/362;
(Continued)

(56) References Cited

U.S. PATENT DOCUMENTS 15,676 A * 9/1856 Wieterich ..... E06B 9/90 160/299
31,550 A * 2/1861 Marsh ..... E06B 9/90 160/299
(Continued)

FOREIGN PATENT DOCUMENTS

GB 200103 1/1924
WO WO-2016104170 A1 * 6/2016 ..... E06B 9/42

OTHER PUBLICATIONS

Kikuchi, English translation of "WO 2016104170" obtained from <https://worldwide.espacenet.com/>. (Year: 2016).*

*Primary Examiner* — Johnnie A. Shablack
(74) *Attorney, Agent, or Firm* — Dority & Manning, P.A.

(57) ABSTRACT

A retractable covering for an architectural opening includes a headrail in which a control system is mounted and a fabric suspended from the headrail. The fabric is mounted to be moved laterally between a rolled up retracted position and an extended position across the architectural opening. At least one roller about which the fabric can be wrapped is mounted at an end of the headrail for rotation about a vertical axis, and the system includes a flexible control element that is substantially horizontally disposed for moving the covering between extended and retracted positions.

24 Claims, 48 Drawing Sheets

Related U.S. Application Data continuation of application No. 13/059,269, filed as application No. PCT/US2009/053013 on Aug. 6, 2009, now Pat. No. 8,757,239.

(60) Provisional application No. 61/091,959, filed on Aug. 26, 2008.

(51) Int. Cl.

| | |
|---|---|
| ***A47H 2/00*** | (2006.01) |
| ***A47H 5/032*** | (2006.01) |
| ***E06B 9/36*** | (2006.01) |
| ***E06B 9/264*** | (2006.01) |
| ***E06B 9/60*** | (2006.01) |
| ***E06B 9/68*** | (2006.01) |
| *E06B 9/40* | (2006.01) |

(52) U.S. Cl.
CPC ..... *E06B 9/264* (2013.01); *E06B 9/36* (2013.01); *E06B 9/368* (2013.01); *E06B 9/60* (2013.01); *E06B 9/68* (2013.01); *E06B 2009/405* (2013.01)

(58) Field of Classification Search
CPC . E06B 9/368; E06B 9/364; E06B 9/34; E06B 2009/583; A47H 5/032; A47H 5/02; A47H 5/06
USPC ..... 160/265, 133, 31, 323.1, 170, 273.1, 160/330–350, 108, 120, 123, 309, 267.1, 160/268.1, 277, 307, 319
See application file for complete search history.

(56) References Cited

U.S. PATENT DOCUMENTS 169,450 A * 11/1875 Lake ..... E06B 9/90 160/301
262,398 A 8/1882 Gerard
379,614 A 3/1888 Smith
853,622 A * 5/1907 Berry ..... E06B 9/90 160/301
1,621,717 A * 3/1927 Grant ..... E06B 9/08 16/94 R
1,734,800 A 11/1929 Faulds
1,811,619 A 6/1931 Dwyer
2,031,473 A * 2/1936 Fay ..... E06B 9/90 160/296
2,120,175 A * 6/1938 Fritz ..... E06B 9/90 160/301
2,273,426 A 2/1942 Washburn
2,334,482 A 11/1943 Davis
2,521,178 A * 9/1950 Meletti ..... B65H 75/4447 15/323
2,521,455 A 9/1950 Gorgun
2,570,140 A * 10/1951 Mayer, Jr. ..... E06B 9/90 160/304.1
2,754,899 A * 7/1956 Karobonik ..... E04H 4/101 160/23.1
2,934,139 A * 4/1960 Wardlaw ..... E06B 9/08 160/133
2,958,083 A * 11/1960 Shook ..... B63B 19/21 4/502
2,961,693 A 11/1960 Prehm
3,043,120 A 7/1962 Waldron
3,115,927 A * 12/1963 Znamirowski ..... E06B 9/60 160/301
3,180,401 A * 4/1965 Gambon ..... E06B 9/90 160/265
3,279,528 A * 10/1966 Gambon ..... E06B 9/40 160/274
3,297,078 A 1/1967 Seizo
3,357,480 A 12/1967 Matsumoto
3,386,489 A 6/1968 Denton et al.
3,407,863 A 10/1968 Griesser
3,680,622 A 8/1972 Lester
3,688,341 A 9/1972 Peckham et al.
3,741,497 A 6/1973 Ganske
3,747,132 A * 7/1973 Foster ..... E04H 4/101 160/310
3,807,482 A 4/1974 Baker, Sr.
3,842,890 A * 10/1974 Kramer ..... E06B 9/13 160/26
3,856,072 A 12/1974 Sund
3,983,921 A 10/1976 Ford
3,984,063 A * 10/1976 Knieriennen ..... B60R 22/44 242/372
4,096,902 A * 6/1978 Junod ..... E06B 9/13 160/122
4,112,996 A * 9/1978 Fohl ..... E06B 9/84 160/296
4,125,142 A * 11/1978 Fohl ..... E06B 9/84 160/291
4,153,097 A 5/1979 Pettibone
4,203,174 A * 5/1980 Schults ..... E04H 4/101 134/122 R
4,227,564 A 10/1980 Bratschi
4,231,141 A 11/1980 Derrick et al.
4,240,489 A 12/1980 Madsen
4,252,172 A * 2/1981 Pommat ..... E06B 9/40 160/322
4,335,777 A 6/1982 Simon
4,355,677 A 10/1982 Madsen
4,357,983 A 11/1982 Hand
4,435,882 A 3/1984 Unger
4,513,805 A * 4/1985 Mase ..... E06B 9/80 160/299
4,681,279 A * 7/1987 Nakamura ..... E06B 9/68 160/294
4,825,921 A * 5/1989 Rigter ..... E06B 9/54 160/23.1
4,887,660 A 12/1989 Kraus
5,044,022 A * 9/1991 Hess ..... E04H 4/101 4/502
5,067,184 A 11/1991 Last
5,101,878 A 4/1992 Thomas
5,165,621 A * 11/1992 Mizuno ..... B60R 22/44 242/372
5,176,194 A 1/1993 Chigusa
5,291,933 A 3/1994 Fussnegger et al.
5,381,846 A 1/1995 Lichy
5,494,093 A * 2/1996 Eiterman ..... E05D 13/003 160/300
5,503,210 A * 4/1996 Colson ..... B29C 65/08 160/121.1
5,632,317 A * 5/1997 Krupke ..... E06B 9/13 160/264
5,682,937 A 11/1997 Decrane et al.
5,749,404 A 5/1998 Colson
5,752,557 A 5/1998 Crider et al.
5,787,954 A 8/1998 Herrera
5,797,442 A 8/1998 Colson et al.
5,934,354 A * 8/1999 Price ..... B60R 5/047 160/313
5,964,427 A * 10/1999 Aiston ..... B60R 22/44 242/372
6,003,583 A 12/1999 Locoste et al.
6,050,322 A 4/2000 Finkelstein et al.
6,123,140 A * 9/2000 Bergamaschi ..... E06B 9/60 160/316
6,129,131 A 10/2000 Colson
6,163,899 A 12/2000 Leonard
6,309,076 B1 * 10/2001 McVicker ..... B60J 1/2041 160/238
6,311,756 B1 11/2001 Anderson et al.
6,382,297 B1 5/2002 Takizawa et al.
6,685,592 B2 * 2/2004 Fraczek ..... E06B 9/44 160/166.1
6,691,761 B1 2/2004 Alkhoury et al.

(56) References Cited

U.S. PATENT DOCUMENTS 6,729,447 B2 * 5/2004 Takahashi ..... E06B 9/80 188/291
6,766,849 B1 7/2004 Tseng
6,848,734 B1 2/2005 Mulvaney
6,907,914 B1 * 6/2005 Lundh ..... E06B 9/08 160/238
6,923,398 B2 * 8/2005 Kosugi ..... B60J 7/068 160/296
6,935,403 B2 8/2005 Killo et al.
7,028,741 B2 4/2006 Coenraets
7,059,376 B2 * 6/2006 Tussinger ..... E06B 9/42 160/310
7,100,667 B2 9/2006 Tomita
7,128,126 B2 * 10/2006 Smith ..... E06B 9/262 160/319
7,178,792 B2 * 2/2007 Monahan ..... E06B 9/08 160/10
7,185,691 B2 3/2007 Toti
7,275,581 B2 10/2007 Coenraets
7,438,112 B2 * 10/2008 Cheng ..... E01F 13/028 160/24
7,487,816 B2 * 2/2009 Moriya ..... E06B 9/54 160/23.1
7,568,752 B1 * 8/2009 Lin ..... B60J 1/2058 296/97.8
7,581,578 B2 9/2009 Coenraets
7,600,553 B2 * 10/2009 Bresson ..... E05D 13/1269 160/301
7,686,064 B2 3/2010 Gu
7,810,544 B2 10/2010 Spiess
7,828,041 B2 * 11/2010 Schlecht ..... B60R 5/047 160/322
7,878,230 B2 * 2/2011 Daus ..... B66D 1/02 160/9
8,002,341 B2 8/2011 Hotta et al.
8,051,960 B2 * 11/2011 Nakajima ..... E06B 9/80 160/299
8,136,569 B2 * 3/2012 Bohlen ..... E06B 9/42 160/323.1
8,186,413 B2 * 5/2012 Fujita ..... E06B 9/34 160/121.1
8,261,806 B2 * 9/2012 Wettern ..... E01F 13/028 160/24
8,297,335 B2 10/2012 Bennett et al.
8,393,380 B2 * 3/2013 Uehara ..... B60J 7/0015 160/313
8,397,787 B1 * 3/2013 Daus ..... E05D 13/003 160/1
8,430,148 B2 * 4/2013 Thalhammer ..... B60J 1/2038 160/23.1
8,739,854 B2 * 6/2014 Mullet ..... E06B 9/60 160/190
8,757,239 B2 6/2014 Colson et al.
8,770,255 B2 * 7/2014 Daus ..... B66D 1/02 160/9
8,770,258 B2 * 7/2014 Kitani ..... B60J 7/0015 160/265
8,851,142 B2 10/2014 Birkestrand
8,881,787 B2 * 11/2014 Wang ..... E06B 9/60 160/24
8,887,441 B2 * 11/2014 Lundh ..... E05B 43/00 49/55
8,893,766 B2 * 11/2014 Bohlen ..... E06B 9/88 160/297
8,905,113 B2 * 12/2014 Daus ..... E05D 13/003 160/1
8,910,697 B1 12/2014 Dollhan Shirk
9,033,841 B2 * 5/2015 Clark ..... F16H 1/32 160/321
9,587,430 B2 * 3/2017 Colson ..... A47H 2/00
9,598,896 B1 * 3/2017 Pichik ..... E06B 9/08
9,624,722 B2 * 4/2017 Hummel ..... E06B 9/54
9,890,588 B2 * 2/2018 Smith ..... E06B 9/50
10,047,558 B2 * 8/2018 Hummel ..... E06B 9/54
2003/0121621 A1 7/2003 Killo
2004/0163777 A1 8/2004 Frede
2005/0016696 A1 1/2005 Tomita
2005/0051283 A1 3/2005 Chatellard et al.
2005/0252623 A1 11/2005 McTavish et al.
2006/0048903 A1 3/2006 Drew et al.
2006/0068962 A1 * 3/2006 Allsopp ..... E06B 9/42 475/182
2007/0000620 A1 1/2007 Colson et al.
2007/0056696 A1 * 3/2007 Lin ..... B60J 1/2025 160/273.1
2007/0181269 A1 8/2007 Spiess
2007/0256799 A1 11/2007 Lin
2008/0128098 A1 6/2008 Colson et al.
2008/0141599 A1 * 6/2008 Akdag ..... E06B 9/08 52/202
2008/0163988 A1 7/2008 Hicks et al.
2008/0264574 A1 10/2008 Spiess
2008/0314533 A1 * 12/2008 Park ..... E06B 9/44 160/313
2009/0120592 A1 5/2009 Lesperance
2009/0120593 A1 5/2009 Lesperance
2009/0145559 A1 6/2009 Glasl et al.
2010/0038196 A1 * 2/2010 Krammer ..... E05F 5/006 188/290
2010/0043987 A1 2/2010 Hicks et al.
2010/0219306 A1 * 9/2010 Detmer ..... E06B 9/72 248/201
2011/0000630 A1 1/2011 Huang
2011/0146922 A1 * 6/2011 Colson ..... A47H 2/00 160/331
2013/0126288 A1 * 5/2013 Qiu ..... E06B 9/42 192/20
2013/0213589 A1 * 8/2013 Hicks ..... E06B 9/54 160/268.1
2014/0053989 A1 * 2/2014 Colson ..... E06B 9/34 160/84.04
2014/0196371 A1 * 7/2014 Lundh ..... E05B 17/10 49/13
2014/0299281 A1 10/2014 Colson et al.
2015/0041075 A1 * 2/2015 Henderson ..... E06B 11/026 160/245
2015/0376942 A1 * 12/2015 Henderson ..... E01F 13/028 160/133
2017/0138127 A1 * 5/2017 Colson ..... A47H 2/00
2017/0361690 A1 * 12/2017 Higuchi ..... E06B 9/42

* cited by examiner 128
188
190
112
202
204
212
214
218
220
222
224
228
234
236
206
208
210
226
232

ROLL-UP RETRACTABLE COVERING FOR ARCHITECTURAL OPENINGS

CROSS-REFERENCE TO RELATED APPLICATIONS

This application is a continuation of U.S. patent application Ser. No. 14/311,649, filed Jun. 23, 2014, which is a continuation of U.S. patent application Ser. No. 13/059,269, filed Feb. 16, 2011, now U.S. Pat. No. 8,757,239, and entitled "Roll-Up Retractable Covering For Architectural Openings", which is a national stage application of International Patent Application No. PCT/US2009/053013, filed on Aug. 6, 2009, and entitled "Roll-Up Retractable Vertical Covering For Architectural Openings", which claims the benefit under 35 U.S.C. § 119(e) of the earlier filing date of U.S. Provisional Application No. 61/091,959, filed Aug. 26, 2008, and entitled "Roll-Up Retractable Vertical Covering For Architectural Openings", which applications are hereby incorporated by reference into the present application in their entireties.

BACKGROUND

Field

The present invention relates generally to retractable coverings for architectural openings such as windows, doors, archways, or the like, and includes a vertically extending fabric material that can be retracted to one side of an architectural opening by rolling at least a portion of the fabric about a vertical roller along the side of the covering. A control system for retracting and extending the covering is coordinated so that movement of a free edge of the fabric between open and closed positions is synchronized with the wrapping of the fabric around the roller.

Description of the Relevant Art

Retractable coverings for architectural openings such as windows, doors, archways, or the like, have assumed numerous forms over a number of years. Retractable coverings include horizontal blinds such as venetian blinds and vertical blinds where vertically oriented vanes are suspended from a headrail with the vertical blind covering being very similar to a venetian blind in operation except the vanes or slats for the blind are vertically oriented rather than horizontally.

More recently, cellular shades have become popular as they are not only aesthetically appealing but also inherently have thermal insulating qualities. Cellular shades have included shades with horizontally disposed transversely collapsible tubes of a fabric material which can be raised into a retracted position or lowered into an extended position across the architectural opening in which it is mounted. Similarly, cellular shades have been formed where one fabric forms a backing sheet while a second fabric is adhesively or otherwise secured to the backing sheet while forming loops of fabric that simulate a roman shade or the like.

While some horizontal blinds are retracted into a stack adjacent a headrail for the covering, some blinds are wrapped around rollers, which are horizontally disposed within the headrail in a concealed location. Roll-up shades are desirable in that they require less visual space when retracted than shades that are gathered such as a venetian blind or the like.

Vertical shades are typically gathered adjacent one or both sides of an architectural opening so that in a retracted position they occupy space within the architectural opening thereby partially blocking the view through the opening. It would be desirable to retract vertical coverings and the like adjacent a side of the opening in a manner that did not unnecessarily obstruct vision through the architectural opening.

It is to provide a retractable covering that extends and retracts horizontally toward and away from a side of an architectural opening in a manner that does not unnecessarily usurp vision through the architectural opening that the present invention has been developed.

SUMMARY

The present invention is a retractable covering for an architectural opening where the fabric for the covering, which may include one or two panels, can be at least partially wrapped about a roller, drum, hub, or the like, positioned adjacent one or both sides of the opening with the roller or rollers being rotatable about a vertical axis so that in the retracted position of the covering, the covering does not occupy space that unnecessarily blocks viewing through the architectural opening.

The covering includes a headrail having the operative components for the covering and a fabric or shade material suspended from the headrail. The fabric material is movable between a retracted position adjacent one or both sides of the opening where a top edge thereof is connected to a flexible strap or tape and the strap is wrappable around the roller or rollers and an extended position across the opening where it is unrolled from the roller or rollers.

While the fabric material can take numerous forms, the top edge of the fabric is secured to the strap which is anchored at one end to the roller and at an opposite end to a flexible cord whose opposite end, in one embodiment of the invention, is anchored to a tapered drum having a spiral groove in which the cord can be wrapped. A control wand is secured to the strap or the cord at a location adjacent a free edge of the fabric so the free edge of the fabric can be pulled toward the roller when retracting the covering or pulled away from the roller when extending the covering.

The tapered drum about which the flexible cord is wrapped includes a gear which is operatively connected to a gear on the roller through an idler gear so that movement of the control element with the control wand coordinates the wrapping of the strap from which the fabric material is suspended about the roller as the cord is unrolled from the tapered drum. Oppositely when the fabric is extended, the flexible cord is wrapped around the tapered drum while the strap from which the fabric is suspended is unrolled from the roller. This structure provides constant tension in the strap and helps prevent the fabric from dropping off the hub.

In a second embodiment of the invention, the fabric material is again connected to a support strap which can be wrapped and unwrapped about a roller but wherein the roller includes a coil spring which becomes tensioned as the covering is moved toward an extended position and therefore biases the covering toward a retracted position where the strap is wrapped around the roller. The fabric material and the strap from which it is suspended are unwrapped from the roller by pulling on a control cord with a unidirectional drive system, which is operated by pulling a pull cord downwardly and allowing it to retract upwardly with a drive system of the type disclosed in copending U.S. patent publication Nos. 2009/0120592 A1 and 2009/0120593 A1, which are commonly owned with the present application. In other words, in this embodiment, the covering is extended by reciprocal movement of a pull cord of the drive system against the bias of the spring and then upon releasing a brake in the drive system, the spring in the roller retracts the covering causing the strap from which the fabric material is suspended to be wrapped around the roller. A governor associated with the roller controls the speed at which the covering retracts.

In an alternative embodiment of the invention, there are two panels of fabric in a center-draw system with a roller at each end associated with each panel. The roller at each end in turn supports and guides an affiliated strap to which an affiliated panel of the fabric material is secured along a top edge so that the strap can be wrapped about or unwrapped from the roller in retracting or extending the covering respectively. A spring biases the covering toward the retracted position and a governor is provided for controlling the rate at which the covering moves from an extended to the retracted position.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
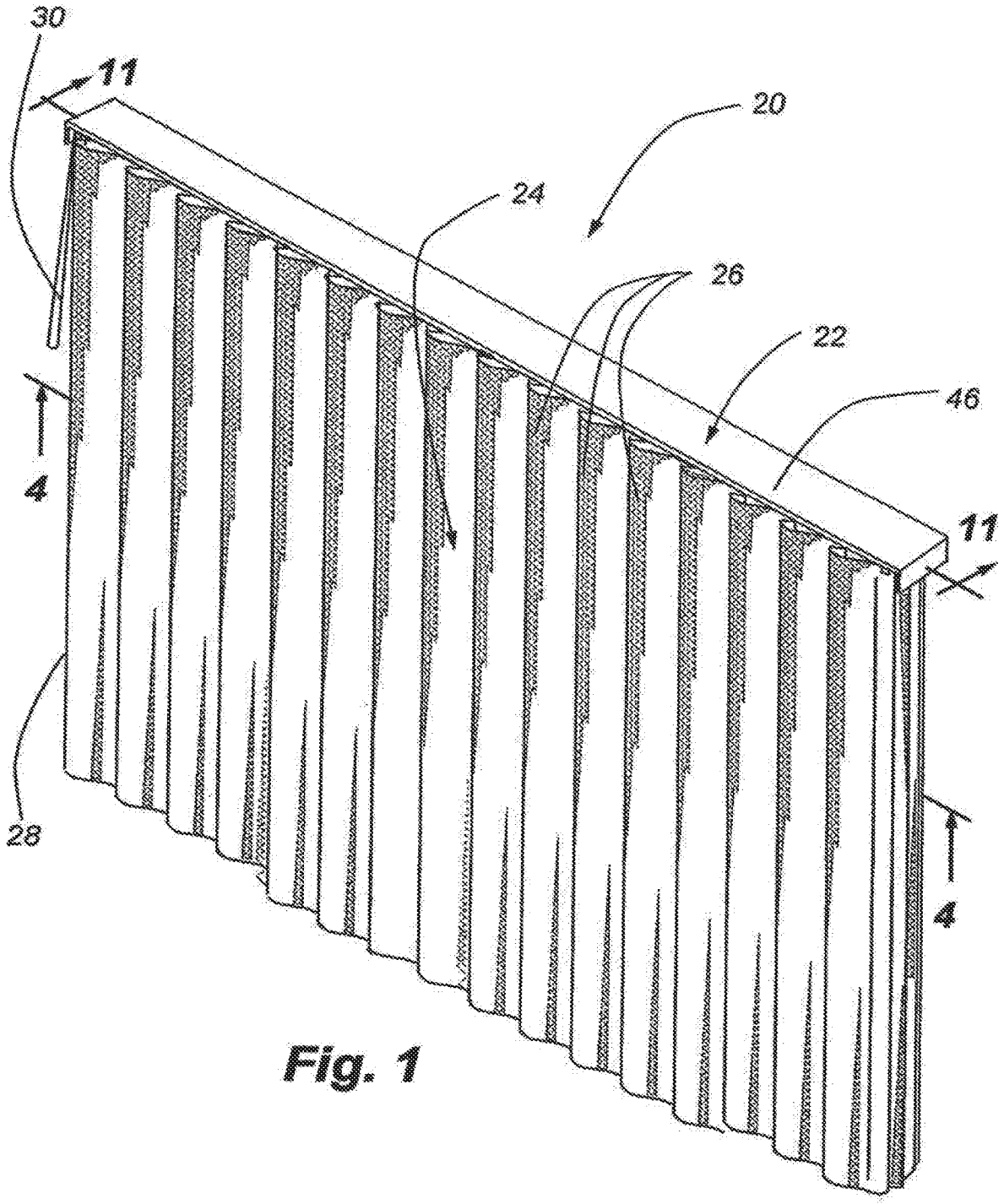
FIG. 1 is an isometric of a covering in accordance with the present invention shown in a fully extended position.
Figure 2:
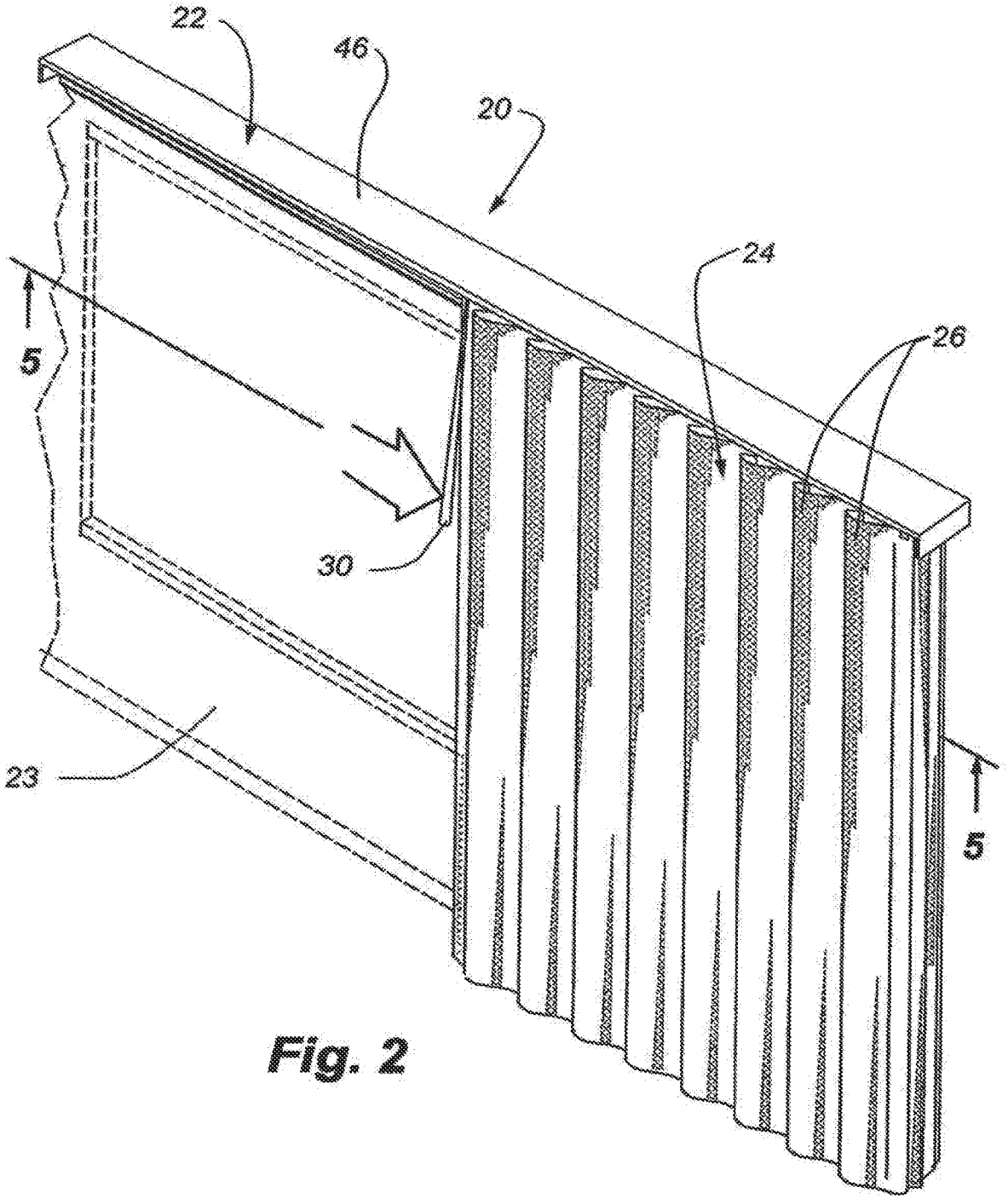
FIG. 2 is an isometric similar to FIG. 1 with the covering partially retracted.
Figures 3, 3A:
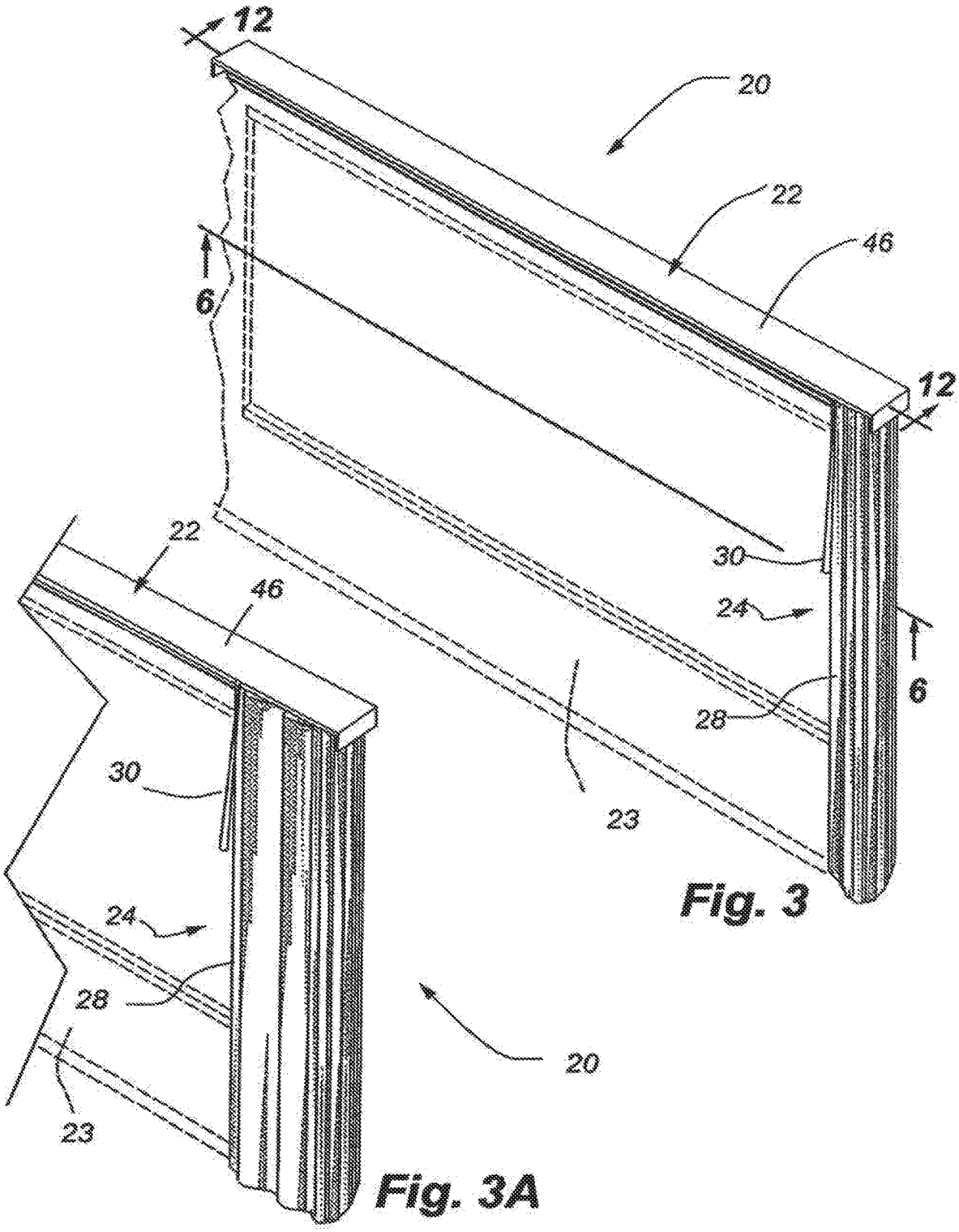
FIG. 3 is an isometric similar to FIG. 1 with the covering fully retracted.
FIG. 3A is an isometric similar to FIG. 3 with the covering not quite fully retracted.

Referring first to FIGS. 1, 2 and 3, an embodiment of the covering 20 in accordance with the present invention can be seen in an extended, partially retracted and fully retracted position respectively. The covering includes a headrail 22 adapted to be secured to a supporting surface 23 and in which a control system to be described in detail hereafter is mounted. Suspended from the headrail is a fabric material 24 having vertically extending looped elements 26 with the fabric having a free side edge 28 to which a control wand 30 is operatively, attached and a fixed edge 31 (FIG. 4) secured to a roller 36 to be described hereafter about which a strap 52, which supports the fabric, can be wrapped when the covering is retracted as shown in FIG. 3. The strap is flexible but somewhat stiff and might be, for example, webbing.

The fabric 24 could assume most any form but for purposes of the present disclosure the fabric includes a relatively flat but flexible backing sheet of material 32 (FIG. 4) to which is attached a front sheet 34 that is gathered into the vertically extending loops or looped elements 26 and secured to the backing sheet to retain the looped configuration. The vertical loops simulate pleats or gatherings as found in some architectural covering products and are primarily included for aesthetics.

Figure 4:
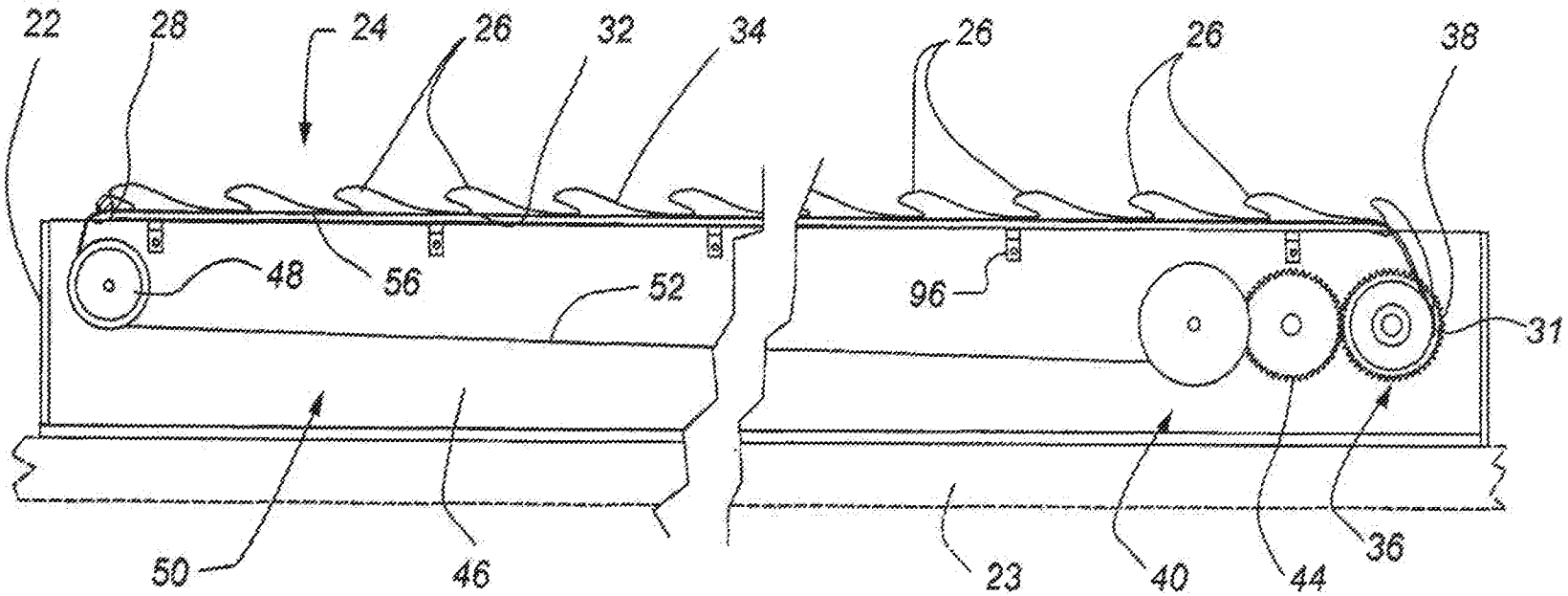
FIG. 4 is an enlarged fragmentary section taken along line 4-4 of FIG. 1.
Figure 5:
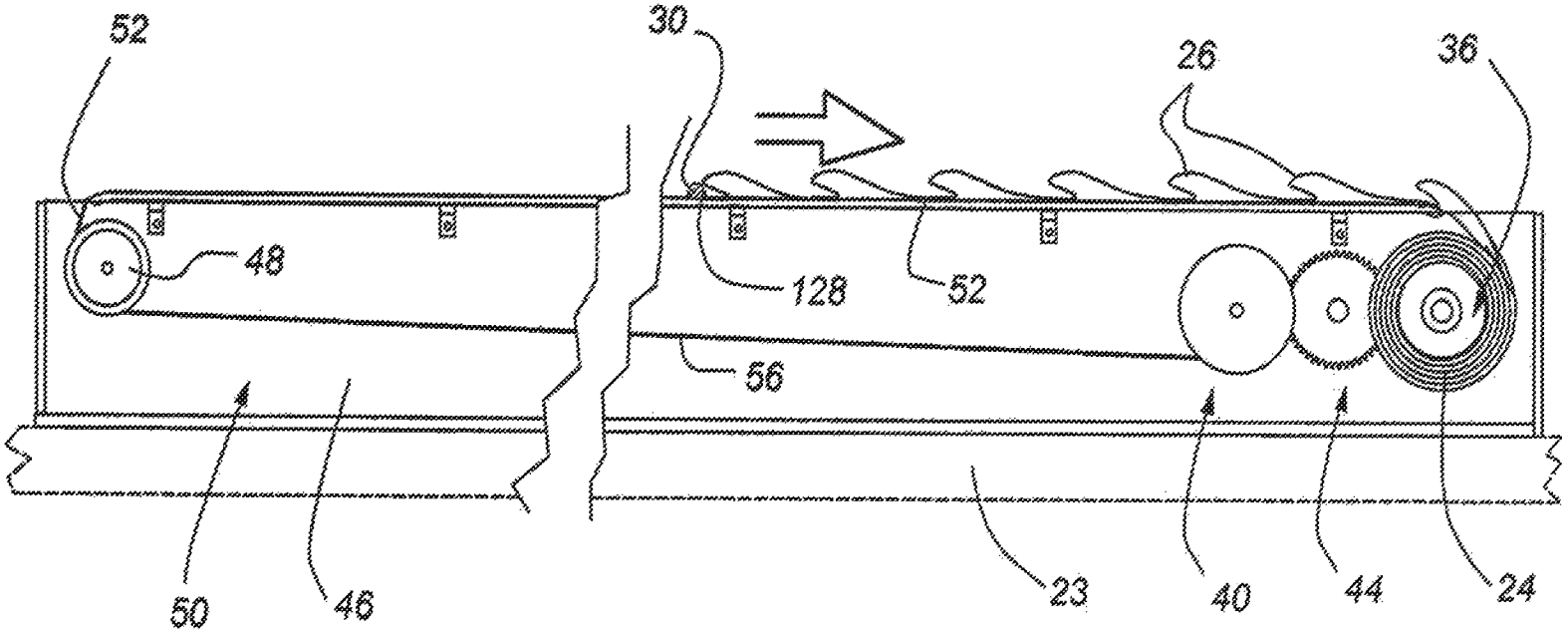
FIG. 5 is a section similar to FIG. 4 with the covering partially retracted.
Figure 6:
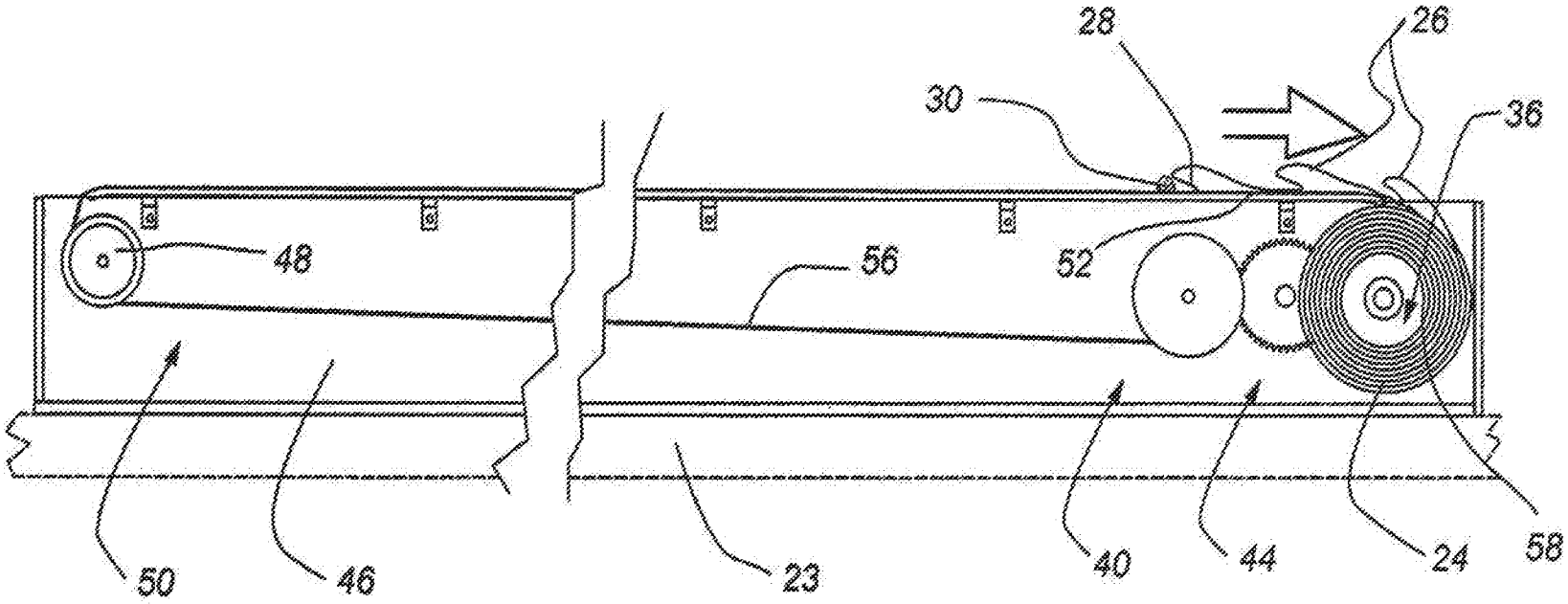
FIG. 6 is a section similar to FIG. 4 with the covering substantially fully retracted.

With reference to FIGS. 4, 5, and 6, the control system for the covering can be generally appreciated to include the roller 36, which is generally cylindrical in configuration, about which the strap 52, which supports a top edge of the fabric 24, can be wrapped, and which includes a horizontal gear 38 with the roller being adapted to rotate about a vertical axis. The roller could be any desirable length or height but is preferably very short and only a few inches in height (e.g. less than six inches) so as in essence to be simply a hub or short drum. For reasons which will become more clear hereafter, the operative interrelationship between the strap 52 and the roller, hub or drum is such that each wrap of the strap about the roller can be spaced a predetermined amount so that the fabric in its retracted position hangs substantially vertically and does not flare outwardly from the top to the bottom. Depending upon the fabric, and particularly the stiffness or body thereof, the length of the roller could be varied but even if it were the full height of the covering, it would not have to be anchored to the floor; rather, it would only be suspended from the headrail in a manner to be described hereafter. It will be appreciated with the description that follows that the fabric is only wrapped about the roller to the extent the roller exists so that beneath the roller the fabric is only wrapped about itself. The fabric is therefore free to sway beneath the roller or even be connected to an adjacent wall in a swag. It will also be appreciated that when the fabric is entirely wrapped about the roller, it occupies only a small space at the side of an architectural opening relative to the space required for drawn pleated curtains, for example. Also, as shown in FIG. 3A, if one did not like the look of a rolled-up fabric, the fabric would not have to be fully rolled up so that a small panel of unrolled fabric would conceal the rolled fabric from view.

The control system further includes a cord take-up drum 40, which also includes a horizontal gear 42 (FIG. 9) not seen in FIGS. 4, 5 and 6, which is also rotatable about a vertical axis and an idler gear 44 operatively engaged with the gear 38 on the roller and the gear 42 on the take-up drum with the idler gear also being mounted for rotation about a vertical axis. As will be described in more detail hereafter, the geared components of the control system are suspended from a top wall 46 (FIG. 11) of the headrail 22 and are disposed at one end of the headrail with that end being the end about which the strap 52 is wrapped around the roller 36 in a retracted position of the covering as shown for example in FIGS. 3 and 6. The opposite end of the headrail has an idler pulley 48 mounted for rotation about a vertical axis, which is also suspended from the top wall 46 of the headrail.

A flexible control element 50 (FIGS. 4-6 and 9) includes the flexible strap component 52, which is interconnected at one end 54 to a flexible cord component 56 of the control element and the control element is utilized to transfer the fabric 24 between the extended position of FIG. 1 and the retracted position of FIG. 3. The strap component has an opposite end 58 anchored to the roller 36 (FIG. 15) and is continuously secured along its length to a top edge of the fabric as with adhesive 59, ultrasonic bonding or the like. As mentioned, the one end 54 of the strap is connected to one end 60 of the flexible cord component 56 which has its opposite end 62 anchored to the take-up drum 40.

The control wand 30 is secured to the flexible strap component 52 adjacent to the free edge 28 of the fabric 24 so that movement of the control wand by an operator of the covering in one horizontal direction or another causes the strap component and attached cord component to move in unison substantially in a looped path. Rotation of the take-up drum 40 to which the end 62 of the cord component is connected is coordinated with rotation of the roller 36 through the idler gear 44 so that the drum and roller rotate at the same speed but in opposite directions. As the fabric is wrapped around the roller, the flexible cord component is unwrapped from the take-up drum and vice versa. It will therefore be appreciated that movement of the control wand from one end of the headrail to the other causes the fabric to be wrapped around or unwrapped from the roller as the cord is unwrapped from or wrapped around the take-up drum respectively.

Figure 7:
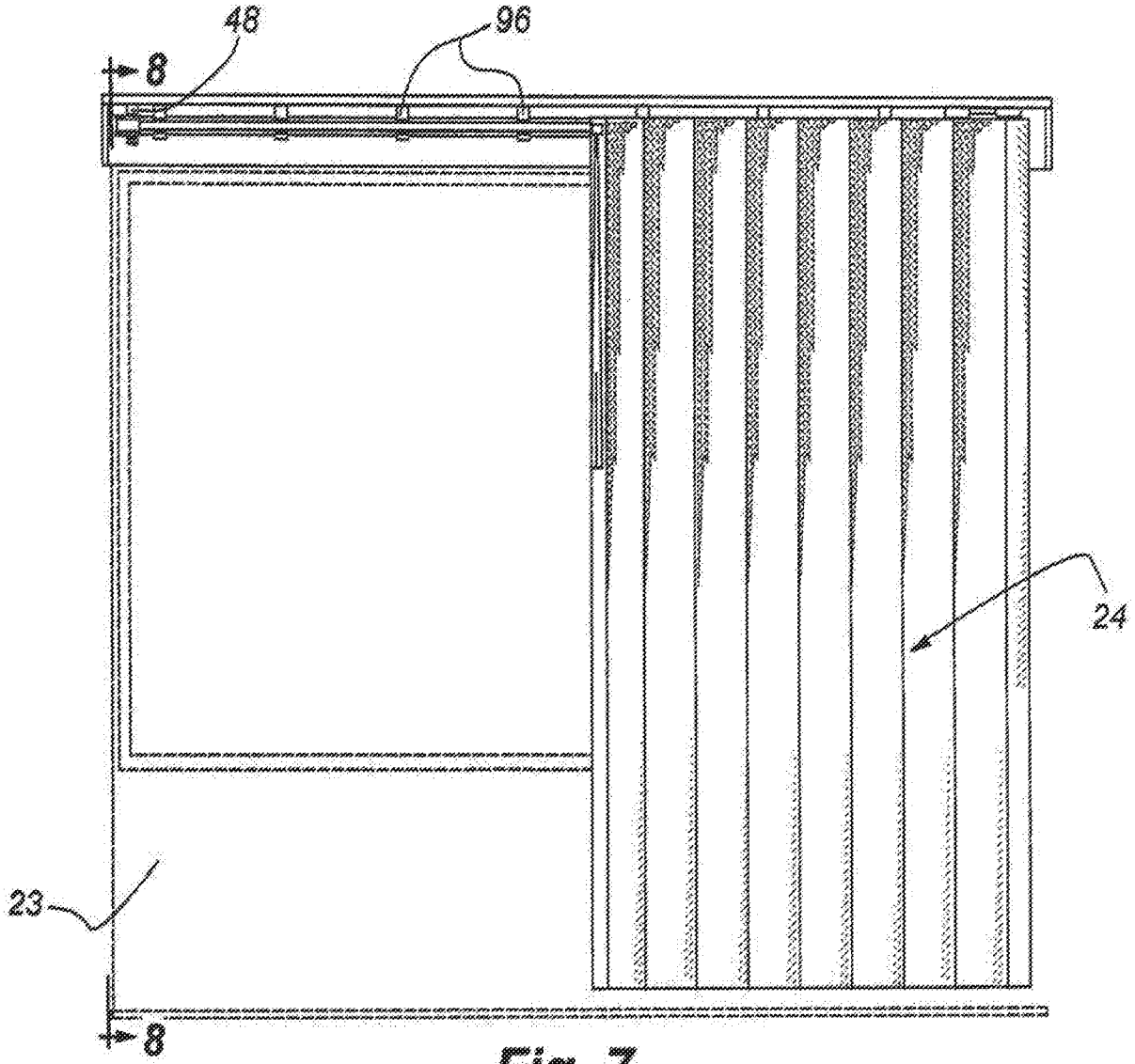
FIG. 7 is a front elevation of the covering as shown in FIG. 2.
Figure 8:
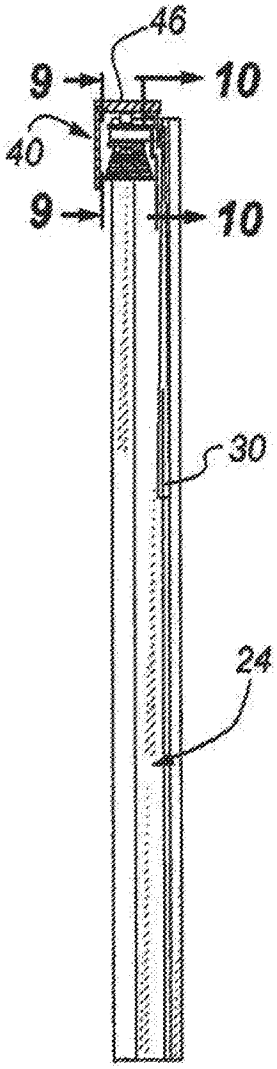
FIG. 8 is a section taken along line 8-8 of FIG. 7.
Figure 9:
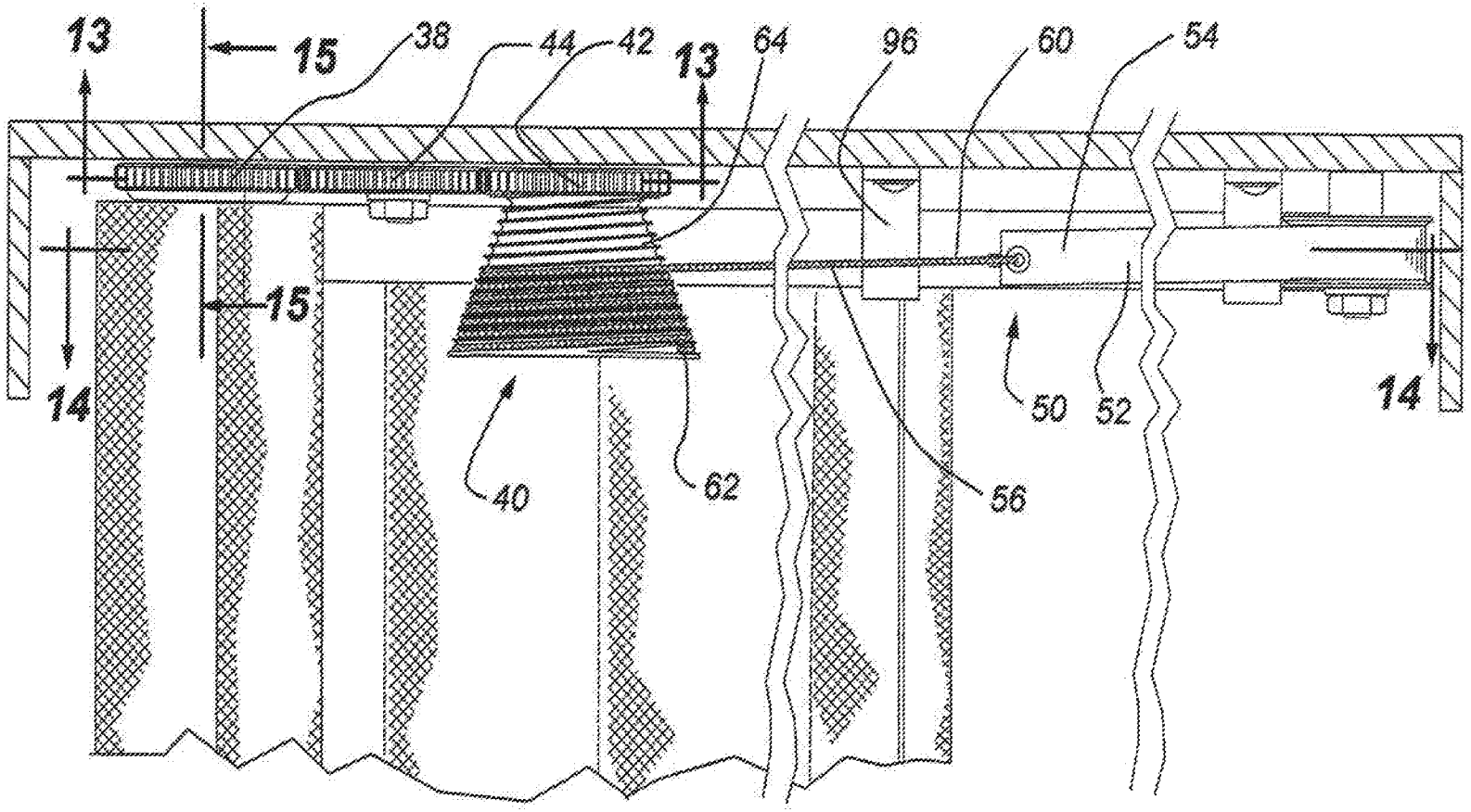
FIG. 9 is an enlarged fragmentary section taken along line 9-9 of FIG. 8.

With reference to FIGS. 7-9, the take-up drum 40 can be seen to be generally frustoconical in configuration, i.e. its conical body tapers downwardly and outwardly and defines in its outer peripheral surface a spiral groove 64 in which the flexible cord component 56 is removably confined. As will be more clear with the description that follows, the upper or smaller diameter portion of the spiral groove has a diameter that is substantially commensurate with the diameter of the cylindrical roller 36 while the lowermost portion of the spiral groove has a larger diameter that is substantially commensurate with the effective diameter of the roller which would include the entire fabric 24 wrapped therearound. In other words, the effective diameter of the roller increases as fabric is wrapped therearound so the effective diameter of the roller changes depending upon how much fabric is wrapped thereon. The take-up drum changes correspondingly in diameter from top to bottom to coordinate with the corresponding effective change in diameter of the roller.

As can also be appreciated by reference to FIG. 9, the flexible cord component 56 is attached to the take-up drum 40 at the lower edge of the drum, i.e. the edge that has the largest diameter. It should also be appreciated that the cord component is fully unwrapped from the take-up drum when the fabric 24 is fully wrapped on the roller 36 so the diameter of the take-up drum where the cord is being received in the spiral groove substantially corresponds with the effective diameter of the roller. Vice versa, when the fabric is completely unwound from the roller, the last wrap of the flexible cord component, or the location where the cord is being received in the spiral groove 64, is at the uppermost edge of the take-up drum, which as mentioned previously, has a diameter that corresponds with the diameter of the roller with no fabric wrapped therearound. In this manner, as the control wand 30 is moved horizontally to move the covering between extended and retracted positions, the flexible cord component is wrapped or unwrapped from the take-up drum at the same speed as the fabric is unwrapped or wrapped about the roller 36.

The relationship between the dimensions of the effective diameter of the roller 36 and the varied diameter of the take-up drum 40 are possibly best appreciated by reference to FIGS. 11-14 where it can be appreciated the diameter of the take-up drum at the location where the most recent wrap of the cord component 56 extends therearound is substantially equal to the effective diameter of the roller which includes the roller itself and any wraps of fabric 24 therearound.

Figure 11:
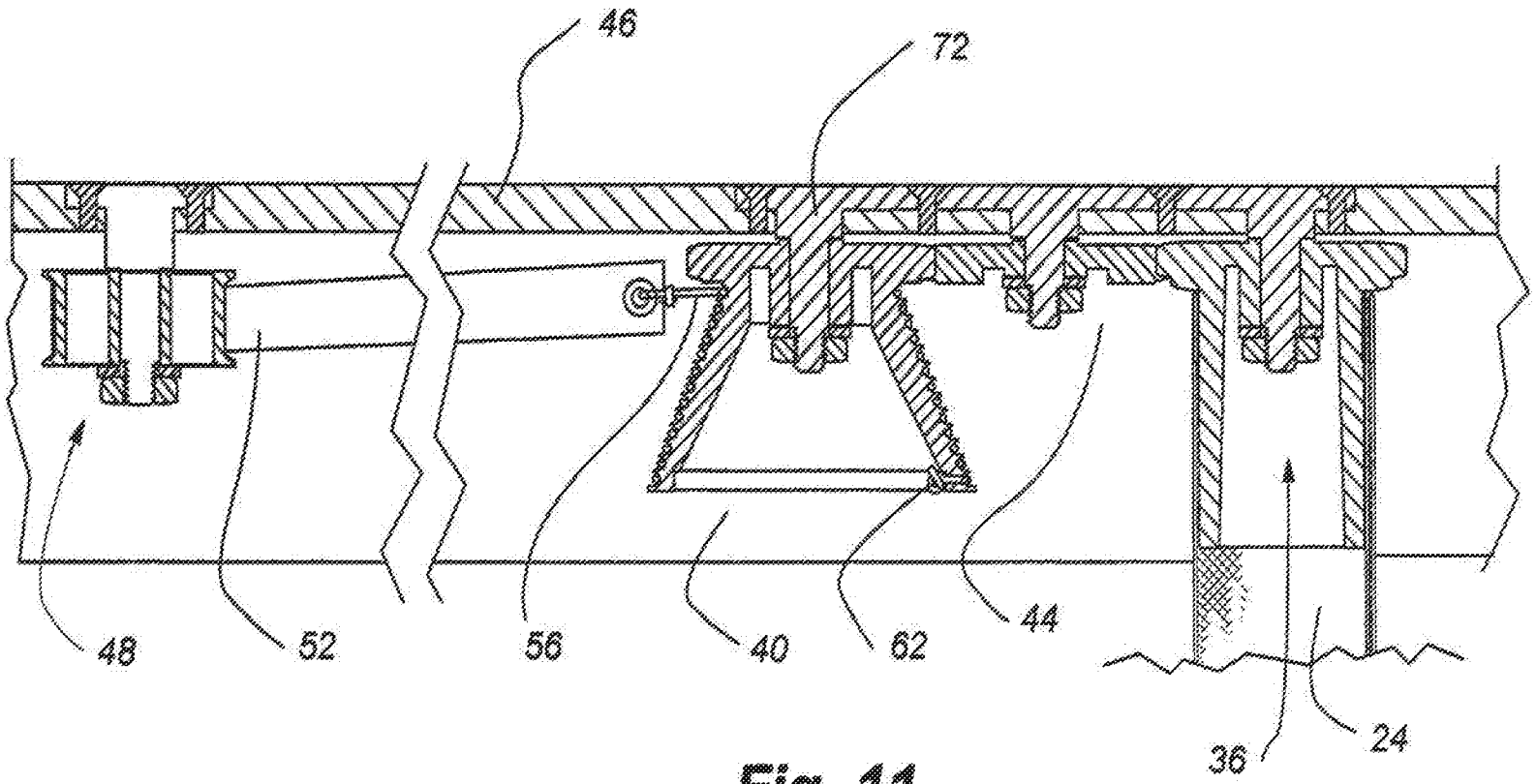
FIG. 11 is an enlarged fragmentary section taken along line 11-11 of FIG. 1.
Figure 12:
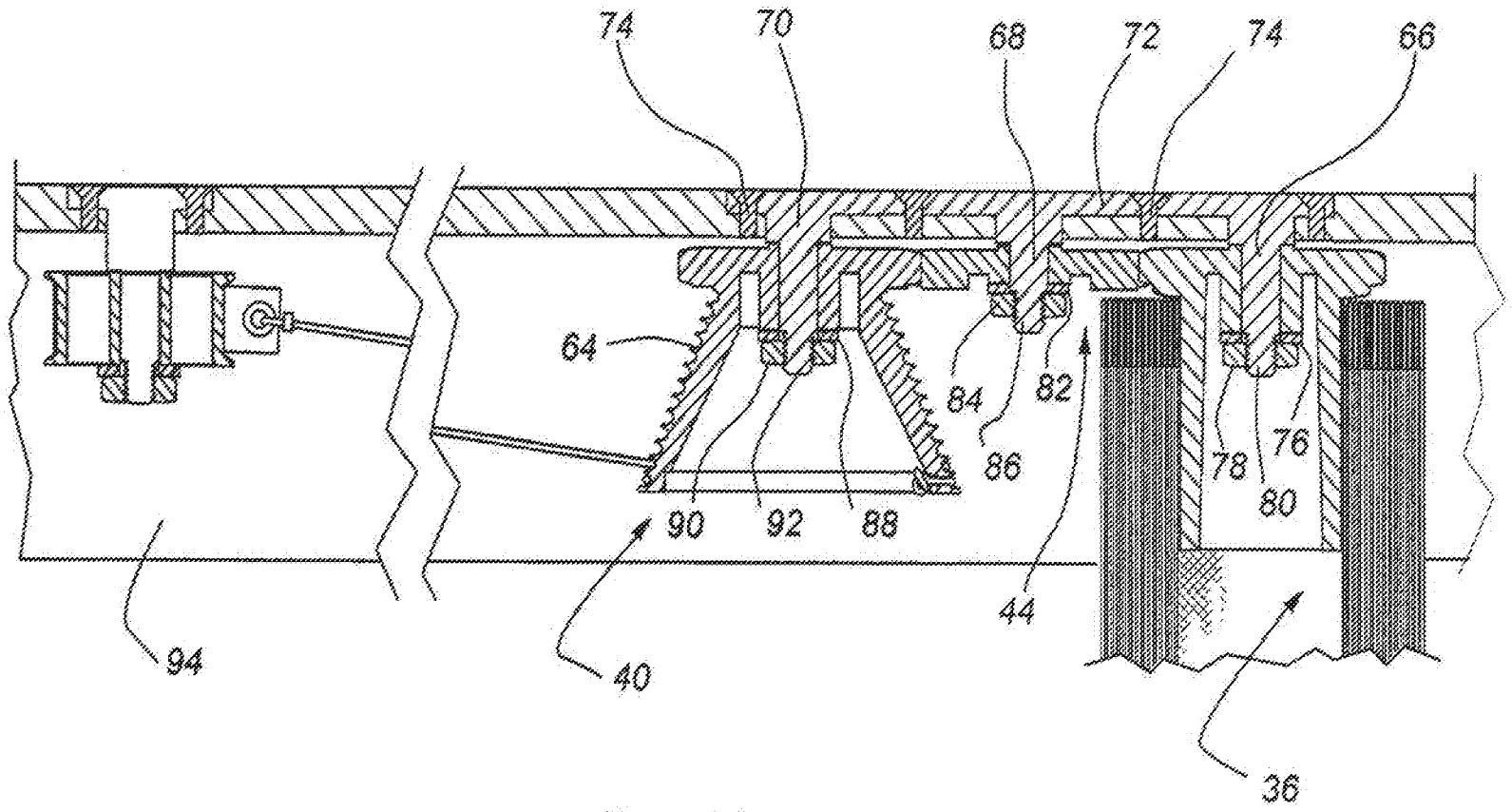
FIG. 12 is an enlarged fragmentary section taken along line 12-12 of FIG. 3.
Figure 13:
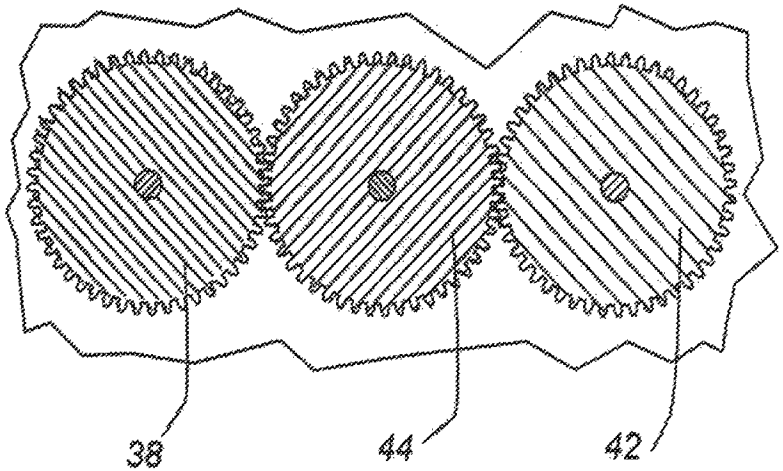
FIG. 13 is a fragmentary section taken along line 13-13 of FIG. 9.
Figure 14:
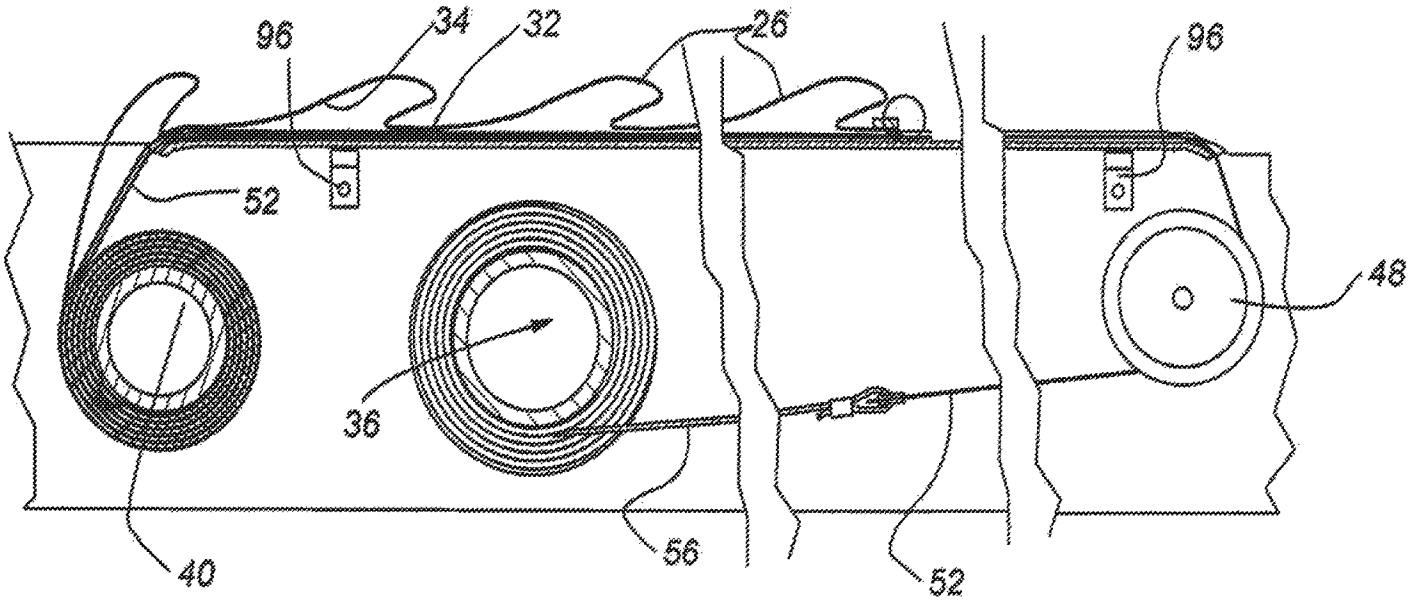
FIG. 14 is an enlarged fragmentary section taken along line 14-14 of FIG. 9.

Also with reference to FIGS. 11 and 12, the roller 36, take-up drum 40, and idler gear 44 can be seen to be mounted on three downwardly extending support shafts 66, 68 and 70, respectively, which form part of a mounting plate 72 secured within a recess provided in the top wall 46 of the headrail 22. Fasteners 74 extend through the mounting plate into the top wall of the headrail to secure the mounting plate in position.

The support shaft 66 closest to the adjacent end of the headrail 22 of course rotatably supports the roller 36, which is held thereon with a washer 76 and a nut 78 threaded on a threaded lower end 80 of the support shaft. Similarly, the idler gear 44 is held on its support shaft 70 with a washer 82 and nut 84 threaded on a threaded lower end 86 thereof, and the take-up drum 40 is rotatably supported on its support shaft 68 with a washer 88 and nut 90 threaded on a threaded lower end 92 thereof. In this manner, the geared elements of the system remain in a desired fixed spacing in operative relationship with each other so that rotation of the take-up drum causes an equal and opposite rotation of the roller and vice versa.

Figure 10:
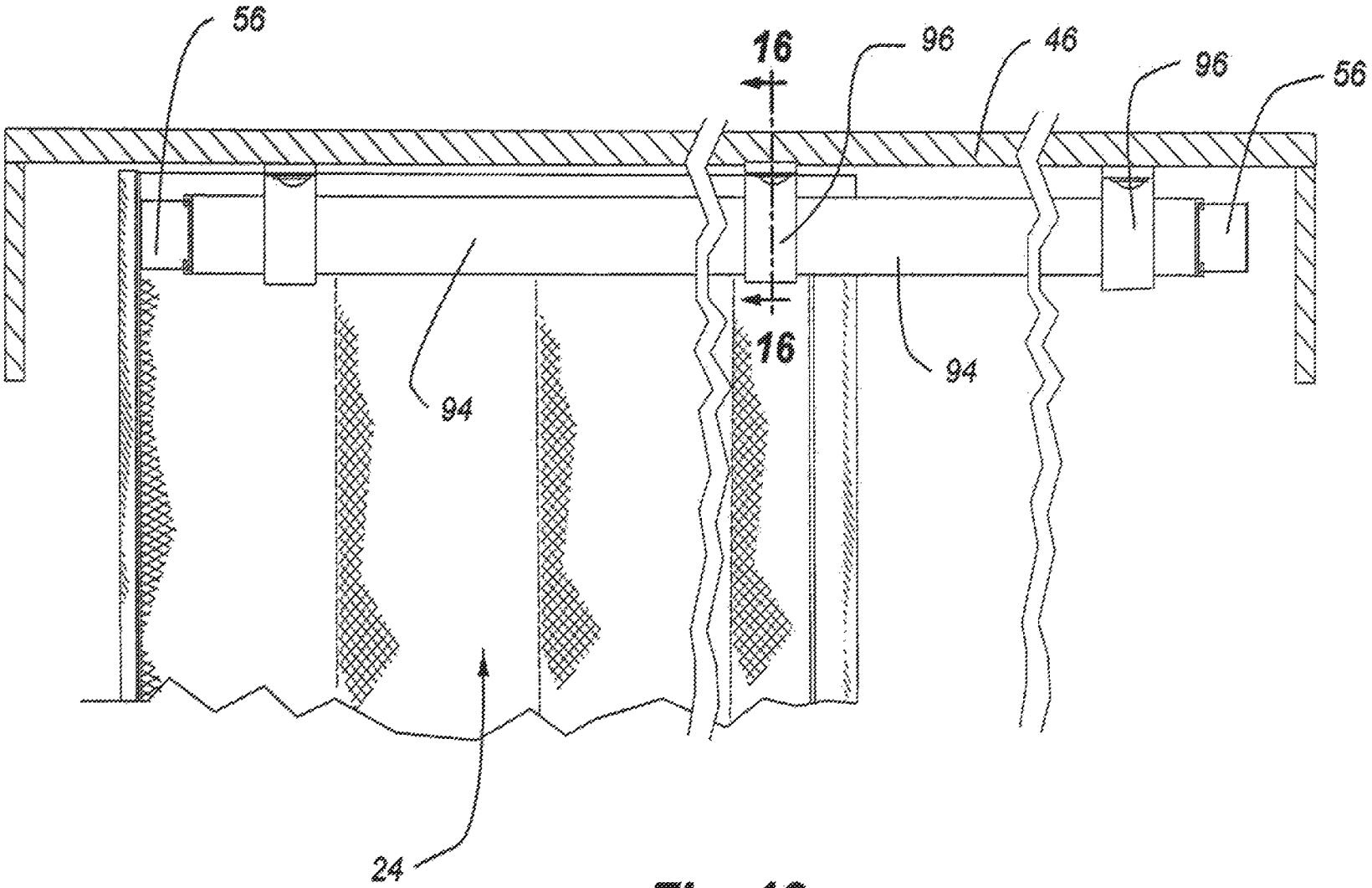
FIG. 10 is an enlarged fragmentary section taken along line 10-10 of FIG. 8.
Figure 16:
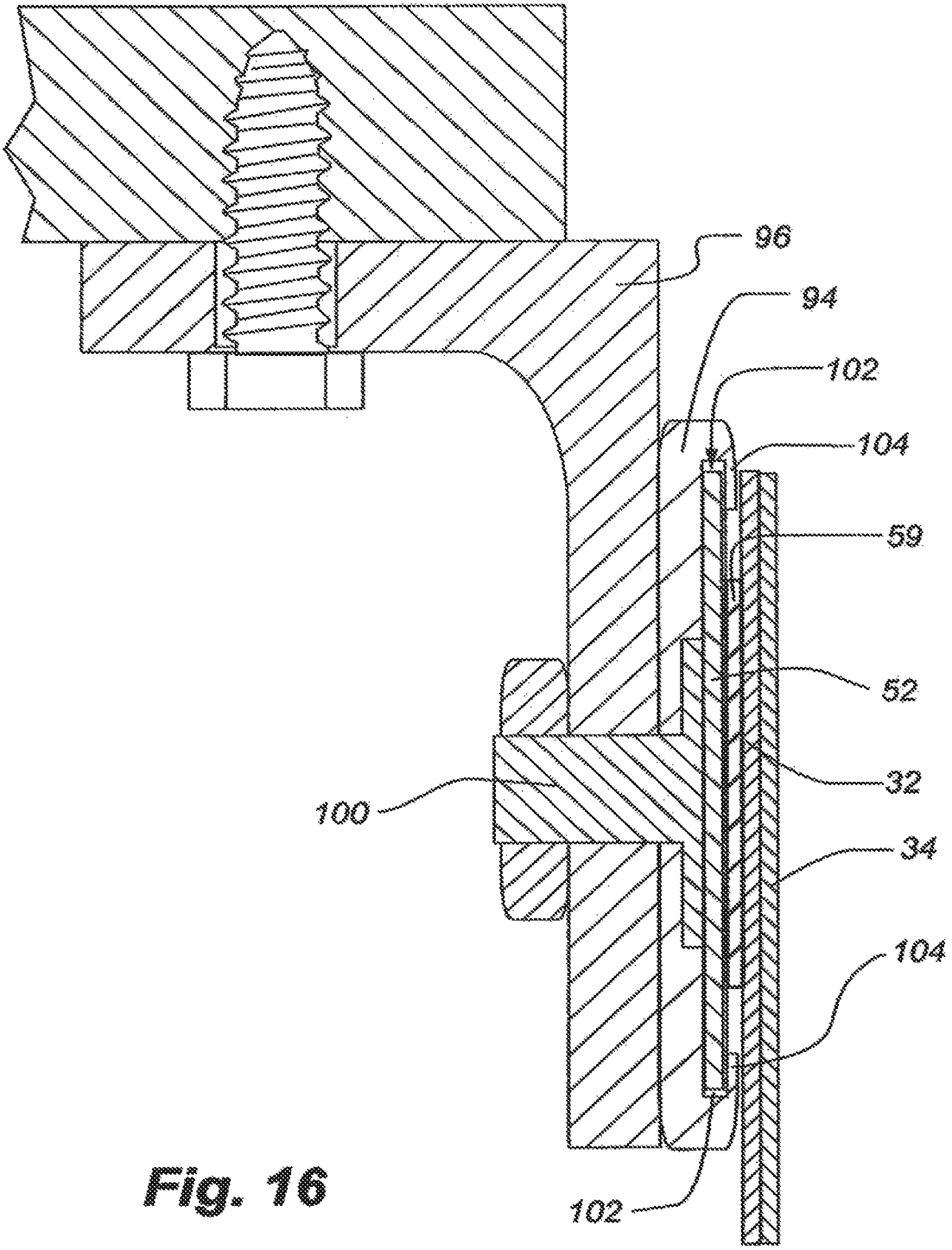
FIG. 16 is an enlarged fragmentary section taken along line 16-16 of FIG. 10.

Referring next to FIGS. 10 and 16, it will be appreciated the headrail 22 itself has the top wall 46 identified previously, which supports and is secured to a guide track 94 with spaced brackets 96 along its length. The guide track extends horizontally and defines a forwardly opening groove 102 between a pair of upper and lower longitudinally extending lips 104 of the guide track. The ends 98 of the guide track curve rearwardly.

The guide track 94 slidably receives and supports the flexible strap component 52 of the flexible control element 50 to which the fabric material 24 is continuously secured with a layer of adhesive or the like with the fabric material as described previously having a backing sheet 32 and a front sheet 34 as seen in FIG. 16. It will therefore be appreciated as the control wand 30 is moved horizontally along the length of the headrail 22, the flexible strap component 52 slides within the groove 102 which supports the strap and fabric at a uniform and desired elevation along the length of the headrail 22 so that the strap is fed to the roller at a consistent, desired, and uniform elevation.

Figure 15:
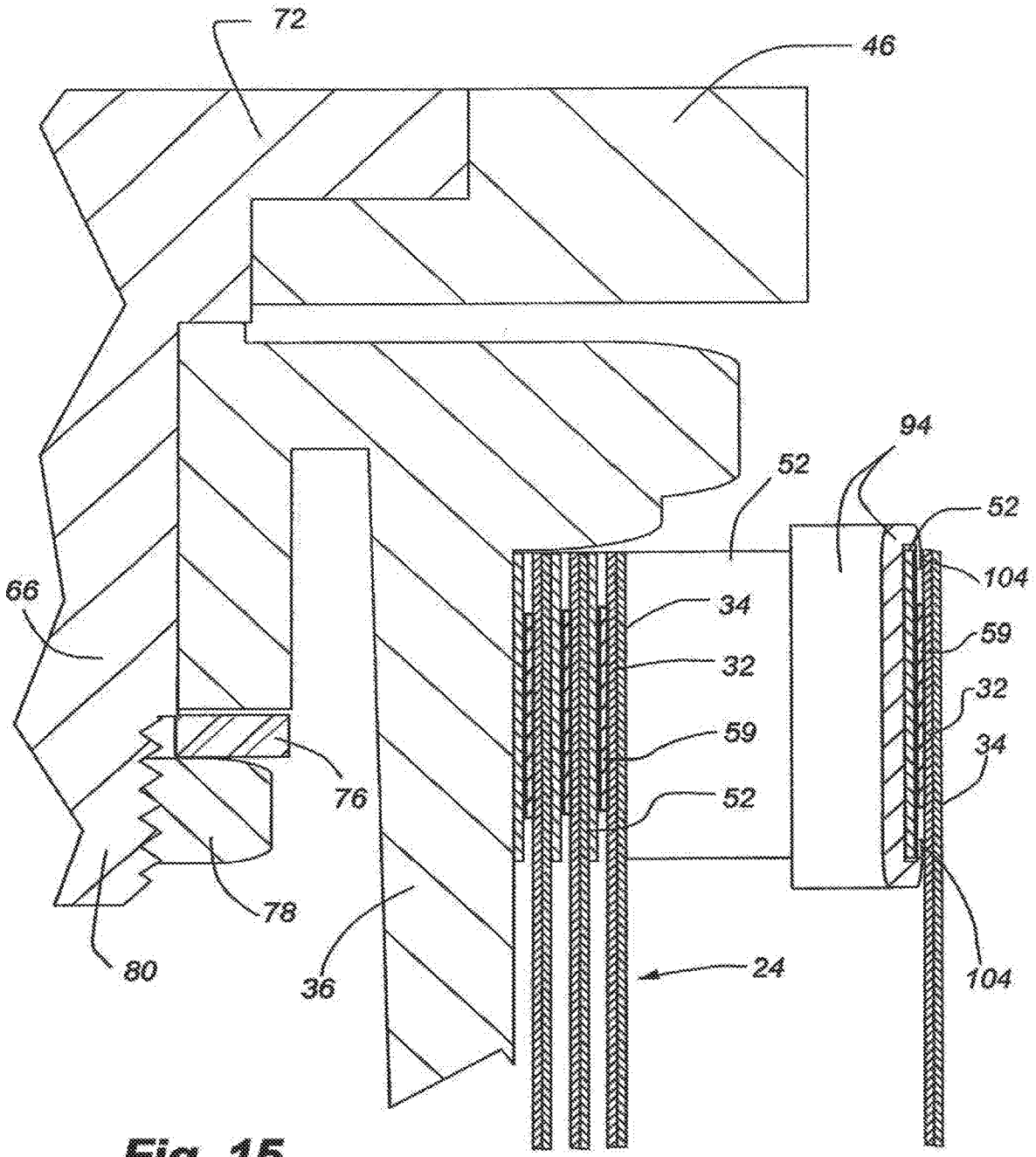
FIG. 15 is an enlarged fragmentary section taken along line 15-15 of FIG. 9.

Referring to FIG. 15, the guide track 94 is again seen supporting the top edge of the fabric 24 on the flexible strap component 52 with three wraps of fabric having accumulated on the roller 36. In other words, in the position of the covering illustrated in FIG. 15, the fabric has been partially retracted by sliding the control wand 30 toward the roller end of the headrail and having caused three wraps of fabric to accumulate on the roller. Of course, further movement of the control wand toward the roller end of the headrail will cause additional wraps of fabric to accumulate on the roller and movement of the control wand in the opposite direction will cause those wraps of fabric to be removed or unwound from the roller. It can also be seen in FIG. 15 that the flexible strap component itself is secured to the roller in any suitable manner such as with adhesive, ultrasonic bonding, mechanical fasteners (not shown), or the like.

It will be appreciated that by utilizing a spacer system for varying the effective thickness of the strap, i.e. the thickness of the adhesive, mechanical fasteners, or the like, the spacing of each wrap of the strap from a prior wrap and of course each wrap of fabric material from a prior wrap can be correspondingly varied, which can be helpful in assuring that the fabric hangs substantially vertically from the roller. In other words, if the fabric were of a predetermined thickness but allowed to be wrapped around the roller in a very tight wrap, perhaps with each layer of fabric being contiguous with a previous layer, the fabric might flare outwardly as it hangs from the roller due to the thickness of the fabric. However, by providing a fastening system of a thickness that correlates with the thickness of the fabric, each wrap of fabric around the roller will be spaced sufficiently so that each wrap of fabric hangs substantially vertically downwardly and does not flare outwardly. Such a system might not be necessary if the roller were, for example, a full length roller extending from the top of the covering to the floor as the covering might be longitudinally confined to the roller and therefore forced to remain substantially vertically, but if the roller were very short, such as illustrated as being a hub, short drum or the like, it has been helpful to space each wrap of the strap and thus the fabric suspended therefrom to provide or allow for the thickness of the fabric so that it hangs substantially vertically downwardly. It should be noted, however, that if a full-length or substantially full-length roller were utilized, it would not have to be confined or attached at the bottom to the floor, for example, but only suspended from the headrail in the manner previously described.

It will be appreciated from the above that the embodiment of the covering described is easily operated by manually sliding a control wand 30 along the length of the headrail 22, which transfers the fabric 24 from a fully-extended position, as illustrated in FIG. 1, to a fully retracted position as shown in FIG. 3 where the fabric is wrapped around the roller 36. As can also be appreciated by reference to FIG. 12, the roller does not extend the full height of the covering even though it could as mentioned above. It will also be appreciated the control system has been designed so that fabric is wrapped around the roller at the same speed the flexible cord component 56 is removed from the take-up drum 40 and vice versa so there is no binding or malfunction in the system. It will also be appreciated by those skilled in the art that the control system would not have to be manually operated as it could be motor driven and a system for accomplishing such would be within the skill of those in the art.

A second embodiment 106 of the invention is shown in FIGS. 17-30. In this embodiment, as will be described in more detail hereafter, the covering is suspended from a headrail 108 and moved between an extended (FIGS. 17 and 18) and retracted (FIG. 19) position through use of a pull cord 110 for extending the covering across an architectural opening and a return spring 112 (FIGS. 24 and 25) for moving the covering from the extended position to the retracted position. The pull cord can be used to position the covering at any intermediate position between fully extended and fully retracted regardless of whether the covering is being extended or retracted at the time.

Figure 17:
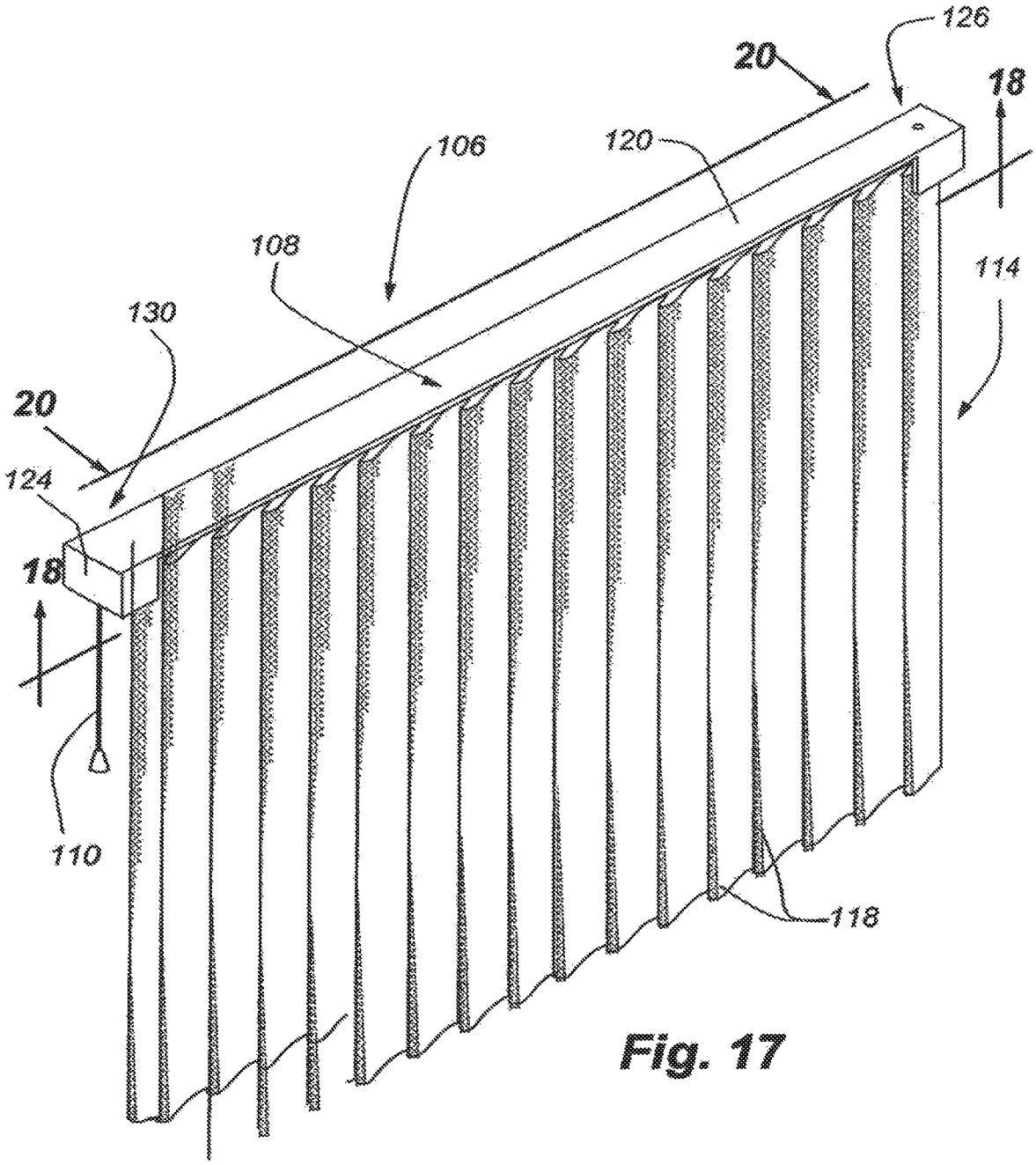
FIG. 17 is an isometric of a second embodiment of the covering of the present invention in an extended or closed position.
Figure 19:
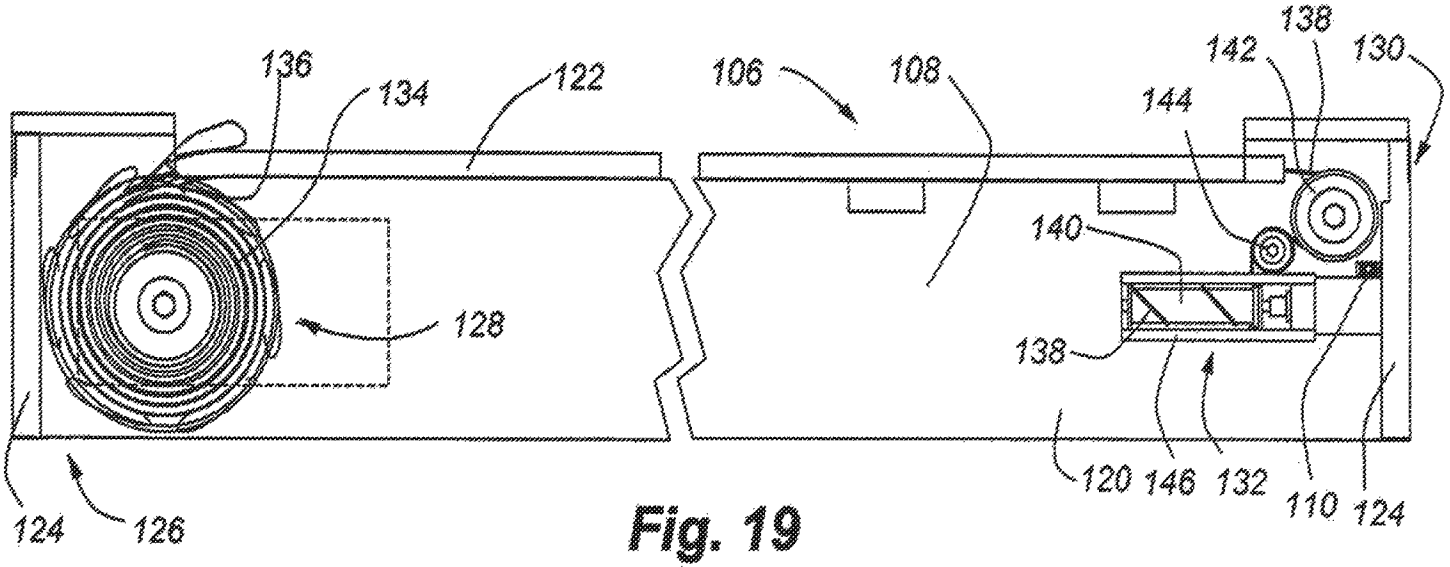
FIG. 19 is a section similar to FIG. 18 showing the covering in a retracted or open position.
Figure 18:
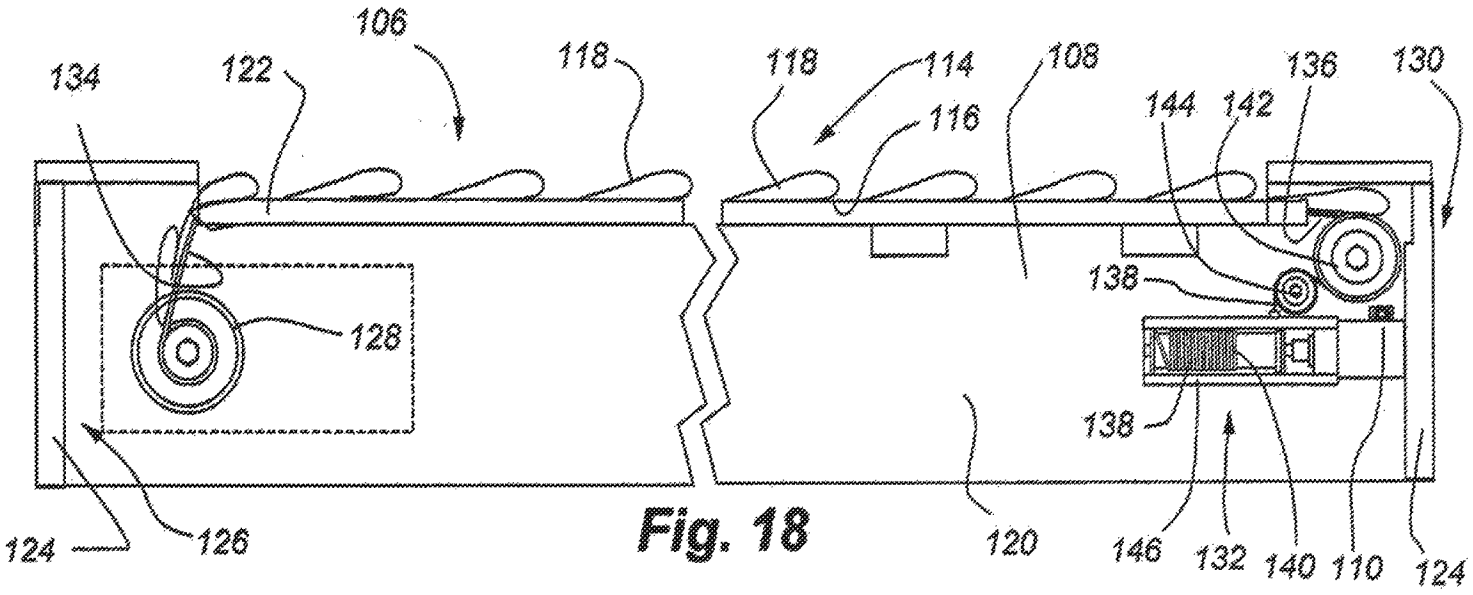
FIG. 18 is an enlarged fragmentary section taken along line 18-18 of FIG. 17.

As can be appreciated by reference to FIGS. 17-19, the covering fabric 114 is illustrated as having a backing sheet 116 suspended vertically from the headrail 108 with a plurality of decorative loops 118 formed vertically on a front face of the backing sheet. This form of covering fabric is shown for illustrative purposes only, and it will be appreciated with the description that follows that other forms of fabric covering material would be suitable for use in this embodiment of the invention.

The headrail 108 from which the fabric covering material 114 is suspended has a top wall 120, a front wall 122, and end walls 124. One end 126 of the headrail has a cylindrical roller 128 suspended from the top wall around which a strap 134, secured to a top edge of the fabric material 114, can be wrapped and unwrapped. As mentioned with respect to the first embodiment, while the roller can be any desired length depending to some degree on the fabric being used, it is preferred to be very short, i.e. less than six inches, and might alternately be referred to as a drum or hub. The opposite end 130 has a control system 132 for moving the strap between a retracted position wrapped about the roller and an extended position across the architectural opening in which the headrail is mounted. As mentioned, the fabric material is suspended along a top edge from a flexible but somewhat stiff strap 134 of material, as used in the first embodiment, with a free end 136 of the strap being connected to an end of a control cord 138 forming part of the control system so the control cord can pull the strap from a retracted position wrapped around the cylindrical drum to an extended position while the control cord itself is wrapped around a take-up or wrap spool 140 at the opposite end of the headrail from the cylindrical drum. As mentioned, a spring 112 returns the fabric material and the strap 134 secured thereto from the extended position to the retracted position, as the control cord is unwrapped from the wrap spool as will be explained in more detail hereafter.

As best seen in FIGS. 18 and 19, the control cord 138 passes around a main idler pulley 142 that is rotatably mounted on a vertical shaft and in a reverse direction around a smaller idler pulley 144 before the cord passes into a housing 146 in which the take-up or wrap spool 140 is rotatably mounted. The spool is unidirectionally rotated by the pull cord 110 through use of the drive or control system 132, which is of the general type disclosed in application No. 60/987,861 filed Nov. 14, 2007, which is hereby incorporated by reference and is commonly owned with the present application. With that control system, the pull cord 110 is reciprocated up and down and when it is pulled downwardly, the spool 140 is rotatively driven in one direction. When the pull cord is retracted upwardly by allowing it to move upwardly under a spring bias, the spool is maintained in a stationary position until it is again rotated in the one direction as the pull cord is again pulled downwardly. Repeated or reciprocated pulling motions on the pull cord are intermittent with retracting motions of the pull cord which ultimately causes the control cord to be wrapped around the spool. FIG. 18 shows the cord fully unwrapped and FIG. 19 shows the cord fully wrapped around the spool.

The unidirectional driving motion is accompanied with a brake mechanism in the control system that holds the wrap spool in a predetermined position when the pull cord is retracted upwardly but allows the wrap spool to be driven in the wrapping direction when the pull cord is pulled downwardly. Manipulation of the pull cord in predetermined lateral directions permits the brake to release the wrap spool allowing the control cord to be unwrapped therefrom when the spring returns the fabric covering material 114 from an extended position to a retracted position. The brake can be activated or released through lateral movement of the pull cord so the covering can be stopped at any intermediate position between fully extended and fully retracted.

Figure 20:
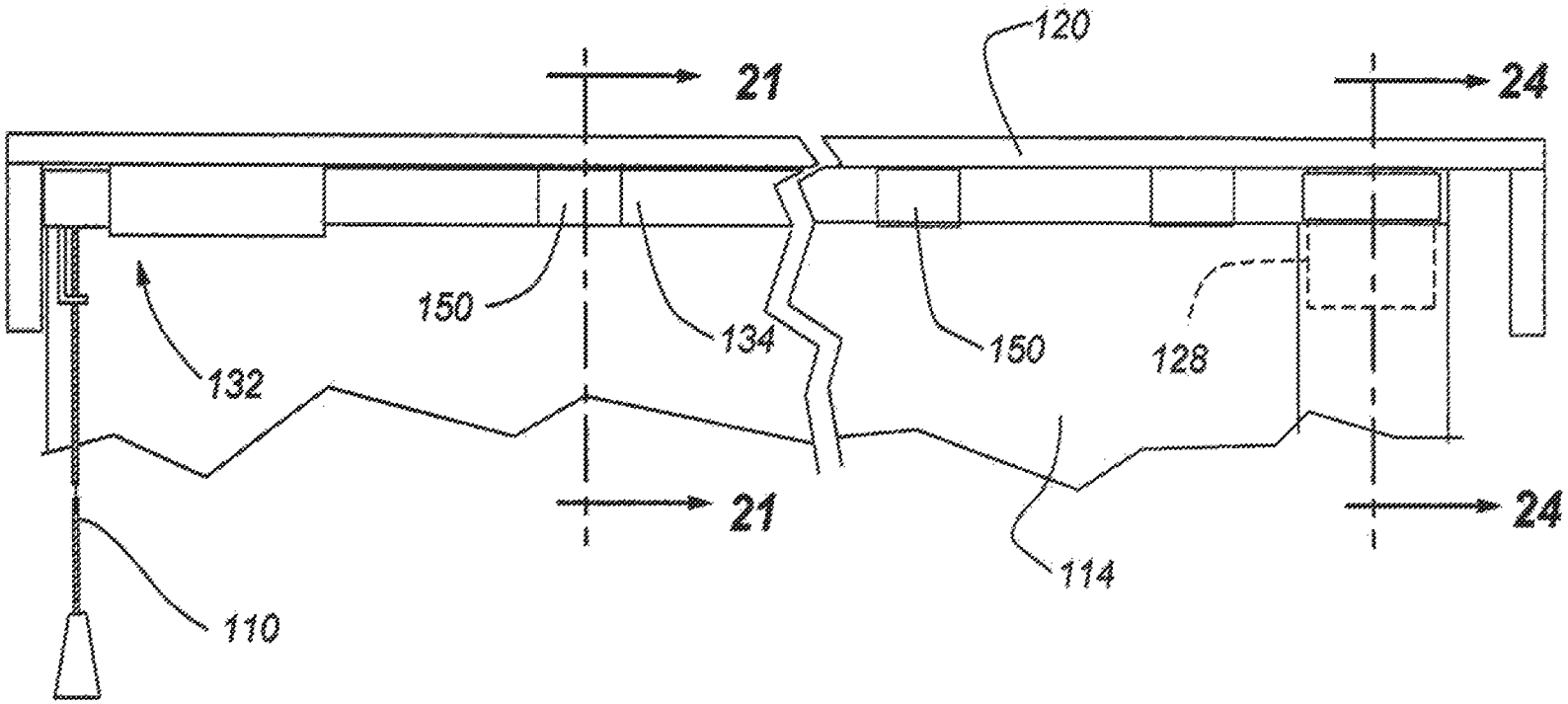
FIG. 20 is an enlarged fragmentary section taken along line 20-20 of FIG. 17.
Figure 21:
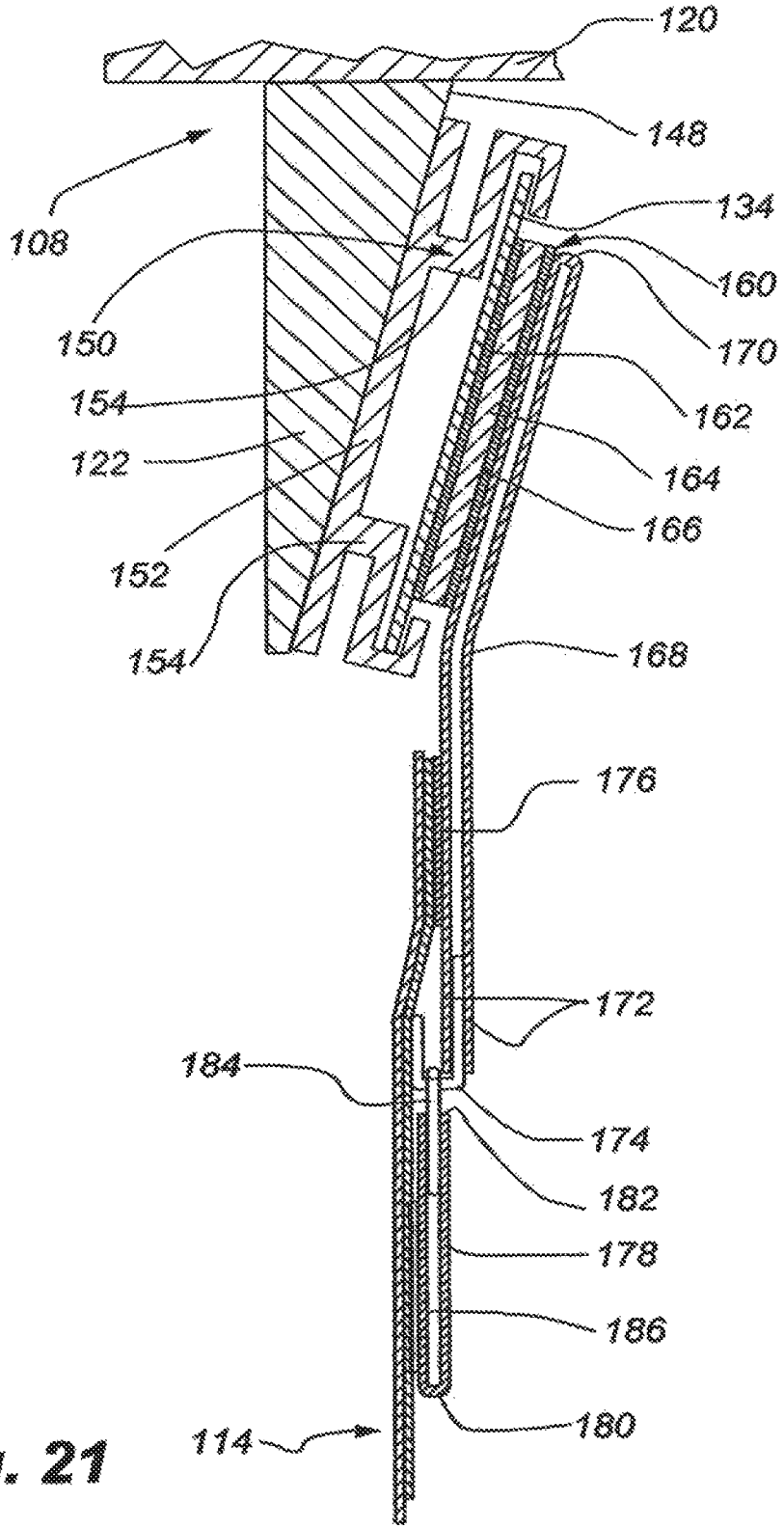
FIG. 21 is a further enlarged fragmentary section taken along line 21-21 of FIG. 20.
Figure 22:
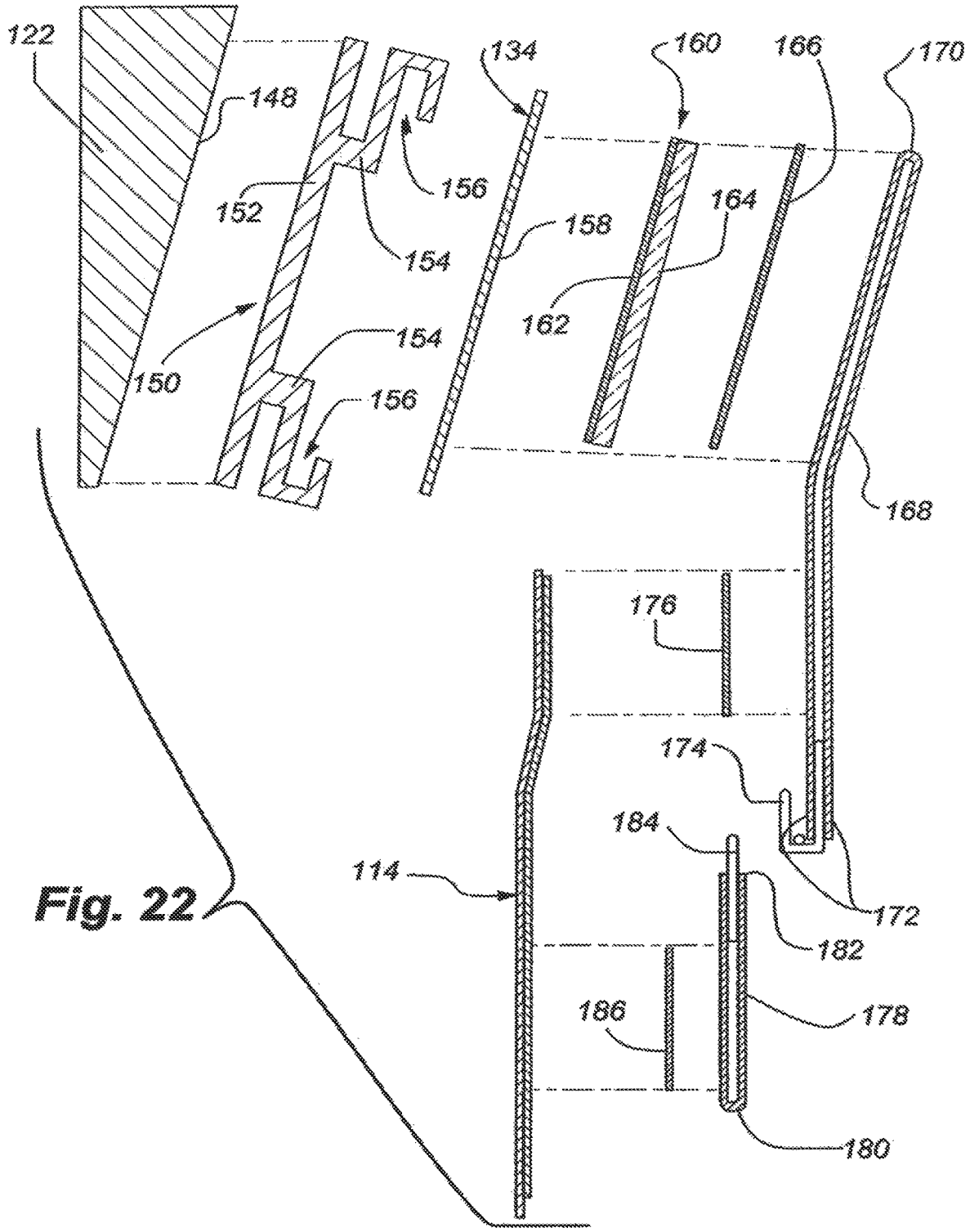
FIG. 22 is an exploded view of the section of FIG. 21.
Figure 23:
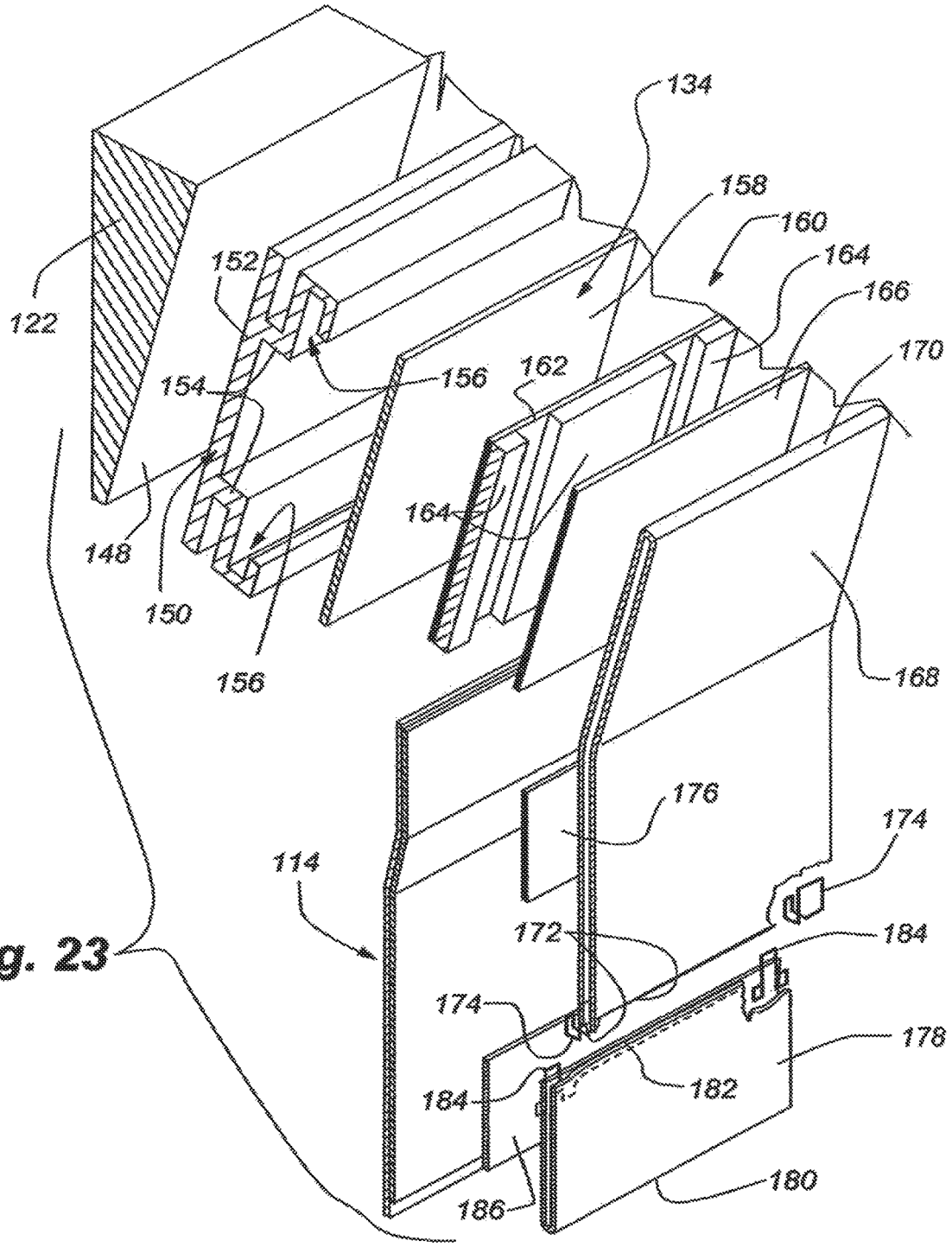
FIG. 23 is an exploded isometric of the section of FIG. 21.

While the fabric covering material 114 could take any form as mentioned previously, it could also be suspended from the headrail in numerous ways. One of those ways is illustrated in FIGS. 21-23 where it will be appreciated the front wall 122 of the headrail 108 has a front downwardly inclined face 148 to which is attached a plurality of track members 150 as shown, for example, in FIG. 20. The track members are spaced along the length of the front wall of the headrail as shown in FIG. 20 even though a continuous track could be utilized. The track has a mounting base 152 secured to the downwardly inclined front face of the front wall of the headrail, and a pair of hook-shaped forward projecting arms 154 along the top and bottom edges thereof, which define and establish confronting channels 156 and therebetween a track in which the strap 134 is slidably positioned as shown in FIG. 21.

As possibly best seen in FIGS. 22 and 23, the strap 134 has a front face 158 to which a spacer strip 160 is attached with the spacer strip having a flexible backing sheet 162 of fabric or the like and a plurality of more rigid, vertically-extending, foam-like strips 164 secured thereto at horizontally spaced locations so the spacer strip can be rolled about the cylindrical drum 128 as will be described hereafter. The front of the spacer strip receives a double-faced adhesive strip 166 with a rear side thereof secured to the spacer strip 160 and the front side secured to an upper portion of a flexible support strip 168. The flexible support strip is illustrated as being a flexible fabric-type material folded upon itself along a top edge 170 and having lower free edges 172 with the two confronting sheets of the support strip 168 being adhesively secured together and along the bottom edge a plurality of hooks 174 adhesively secured between the lower free edges 172 of the fabric material and possibly even sewn therein (not shown), if necessary. A portion of the support strip 168 is adhesively secured to the top edge of the fabric covering material 114 with double-faced adhesive 176 at a location immediately above the hooks 174 on the support strip.

The fabric covering material 114 is illustrated in FIGS. 21-23 as being a laminate of two layers even though the loops 118 of fabric shown in FIG. 1 are not illustrated for clarity purposes. A lower strip 178 of hanger fabric material, that is folded upon itself along a bottom edge 180 but secured together with adhesive or the like along a top edge 182, has upwardly projecting loops 184 adhesively secured or hemmed therein, which are aligned with the hooks 174 of the support strip. The lower strip of hanger fabric material is adhesively secured to the fabric covering material 114 with a double-faced adhesive 186 at a location beneath the connection of the support strip 168 to the fabric covering material 114. In this manner, the fabric covering material is suspended with hooks at spaced locations along its length and continuously or intermittently with double-faced adhesive 176 so the fabric covering material will hang smoothly from the strap 134 and the track members 150 in which the strap is slidably received. It should be appreciated the spacer strip 160 constitutes a spacer system which permits each wrap of the strap 134 around the drum 128 to be spaced a predetermined distance from an adjacent wrap. As mentioned in the description of the first embodiment, it is sometimes important each wrap of the strap and the fabric secured thereto is spaced a predetermined distance from adjacent wraps so the fabric will hang substantially vertically when wrapped around the drum. In this manner, the bottom does not flare out relative to the top which is wrapped tightly around the drum. As mentioned previously, when the top of the fabric material and the strap to which it is attached is wrapped tightly around the drum and the lower edge of the fabric material is not wrapped tightly around anything, the bottom of the fabric will tend to flare outwardly relative to the top with each wrap at the bottom being spaced from adjacent wraps a greater distance than the corresponding wraps at the top of the fabric. However, by properly spacing the wrapped strap and the attached fabric at the top where they are wrapped around the roller 128, a corresponding spacing can be maintained at the bottom so the fabric hangs substantially vertically.

Figure 24:
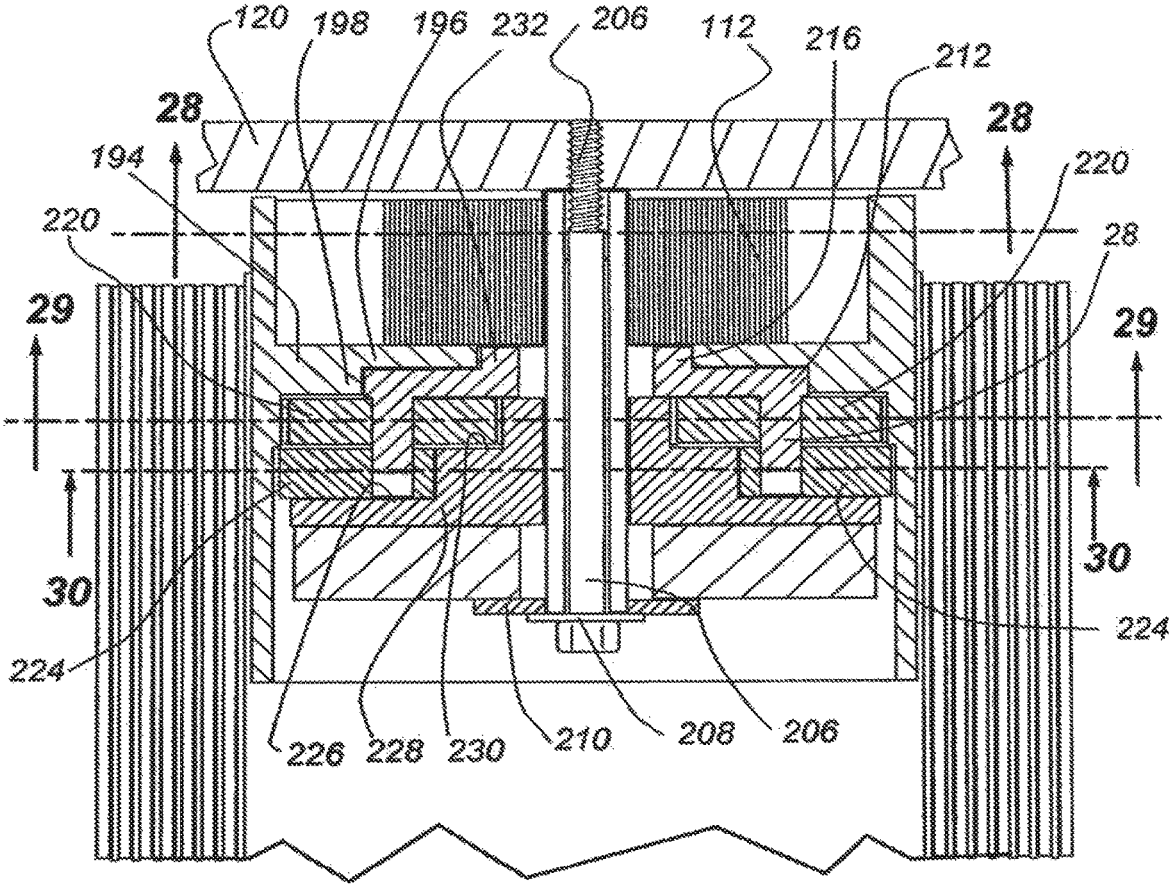
FIG. 24 is an enlarged fragmentary section taken along line 24-24 of FIG. 20.

With reference to FIGS. 24-30, the cylindrical roller 128 around which the fabric 114 for the covering can be wrapped and unwrapped is illustrated. The cylindrical roller and its operative components are probably best understood by reference to FIGS. 24-27. The roller itself has a main cylindrical body 188 with an internal ring gear 190 formed in an inner surface thereof at a spaced location from the top edge 192 of the roller. The main body of the roller has a radially inwardly directed ring 194 with inner 196 and outer 198 shoulders formed thereon as seen in FIG. 24. At a location above the upper shoulder, the roller has a catch plate 200 seen in FIG. 27 formed on the inner surface thereof to which an outer end of the return spring 112, shown as a coil or clock spring, is anchored while the opposite end of the spring is anchored in a slot 202 in a mounting shaft 204 threadedly secured to the top wall 120 of the headrail 108 with an elongated bolt 206. The bolt can be tightened against a washer 208 and a thrust washer 210 so the shaft frictionally remains positively positioned relative to the top wall thereby providing a fixed anchor for the opposite or inner end of the return spring. In this manner, as the roller 128 is rotated in one direction, biasing the return spring, as when the covering is unwrapping the fabric 114 from the roller and moving the covering to the extended position of FIG. 19, the return spring is tensioned and postured to return the roller in an opposite rotative direction to wrap the fabric for the covering about the roller.

Figures 25, 26:
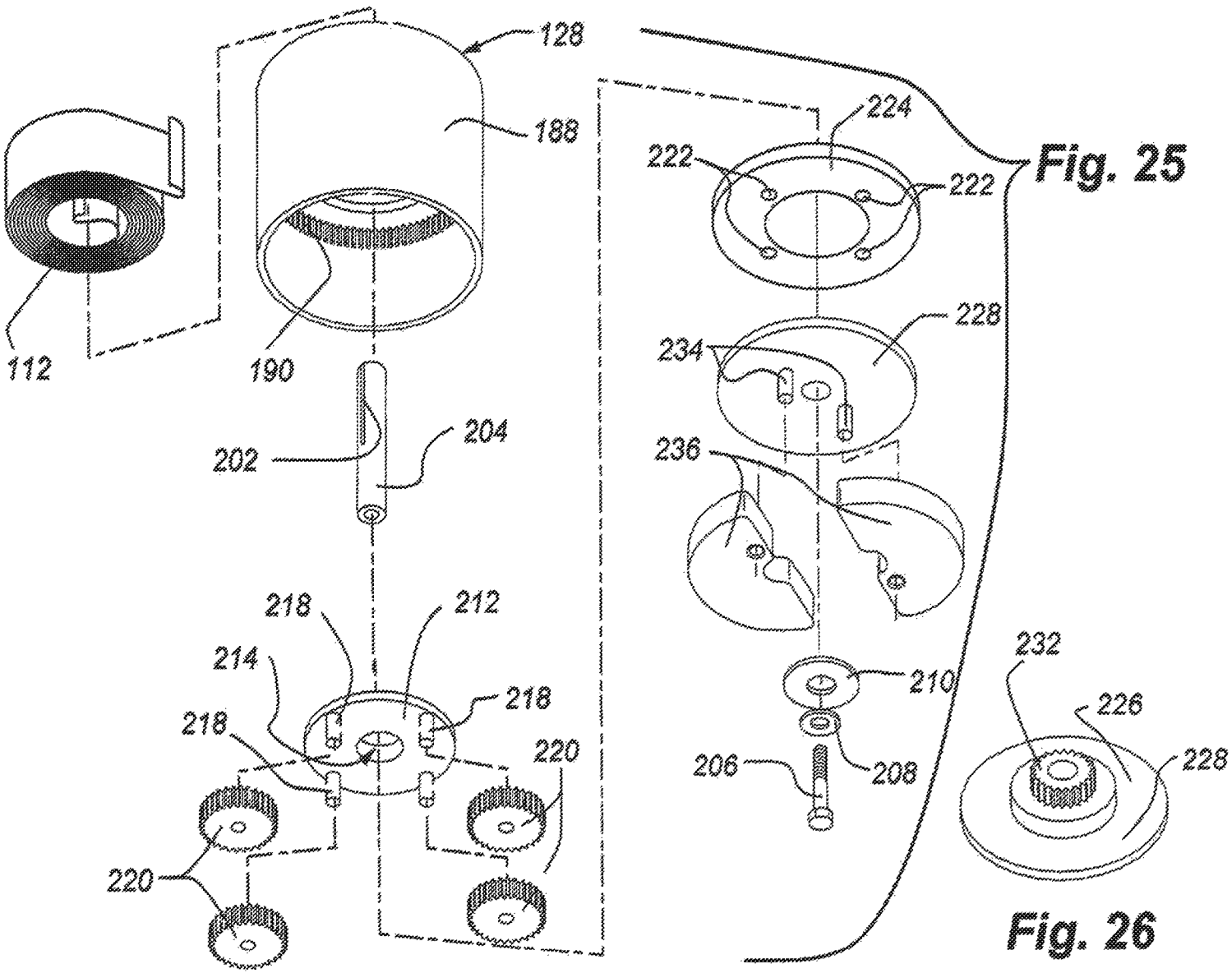
FIG. 25 is an exploded isometric looking upwardly at the components of the covering shown in FIG. 24 with the fabric for the covering having been removed.
FIG. 26 is an isometric looking downwardly on the sun gear component of the system shown in FIG. 25.
Figure 27:
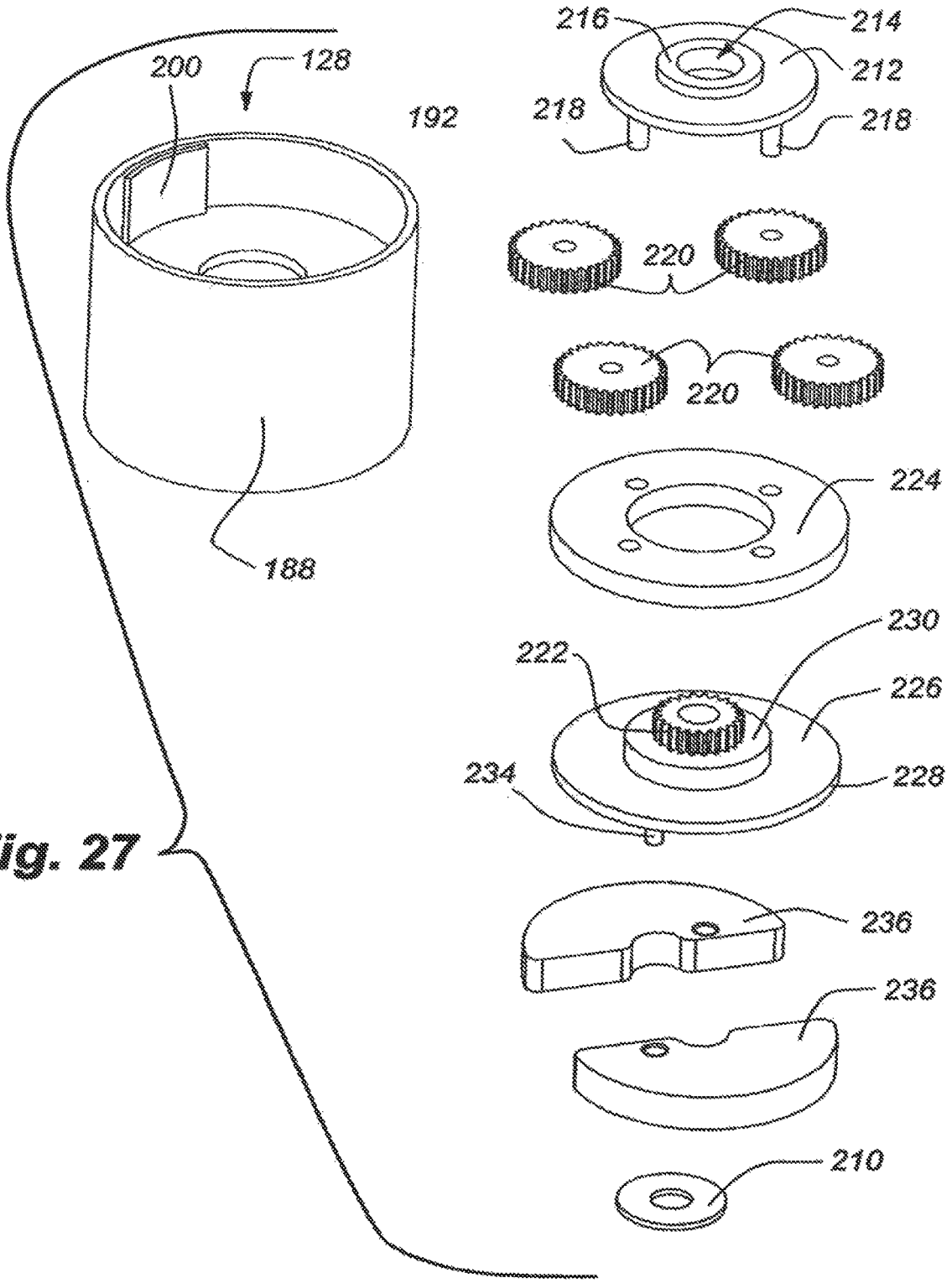
FIG. 27 is an exploded view of the components as shown in FIG. 25 looking downwardly rather than upwardly.

Mounted rotatably on the shaft 204 are several operative components which can be seen probably best in FIGS. 25-27 to include an upper plate 212 having a cylindrical passage 214 therethrough and an upwardly extending cylindrical neck 216 with the upper plate being circular in configuration and including four equally circumferentially spaced downwardly projecting pins 218. Each pin receives a planetary gear 220 adapted to be meshed with the internal ring gear 190 in the roller 128. The lower ends of the four pins 218 are received in four passages 222 through a ring plate 224 positioned beneath the planetary gears and supported upon a lower shelf 226 of a central disc 228 having an upper shelf 230 that supports a portion of each planetary gear and a centered pinion or sun gear 232 that meshes with the four planetary gears. The central disc has two downwardly projecting pins 234 that pivotally receive semicircular governor plates 236, which are in turn supported by the thrust washer 210 so that they can pivot about the downwardly projecting pins 234 and slide across the top of the thrust washer.

With this arrangement, it will be appreciated that as the roller 128 rotates in a direction to unwind the fabric covering material 114 therefrom, through the strap 134 connected to the fabric material being pulled by the control cord 138, which is wrapped around the wrap spool 140 at the opposite end of the headrail, fabric is unwrapped and moved toward the extended position of the covering. During this movement of the fabric covering material, the roller is coiling or tensioning the return spring 112.

The control system 132 at the opposite end of the headrail from the roller 128 includes a braking system (not seen) as mentioned previously that holds the fabric 114 against the bias of the return spring 112 until a brake in the braking system is released, which allows the return spring to rotate the roller in an opposite direction. Of course, rotation of the roller in either direction causes the planetary gears 220 and the sun gear 232 to rotate in unison even though the planetary gears and sun gears are rotated at a much faster speed than the roller itself due to the gear reduction between the internal ring gear 190 and the planetary gears. In order to keep the roller from rotating too fast through the bias of the return spring, the rotation of the planetary gears by the ring gear and consequently the sun gear by the planetary gears causes the governor plates 236 to spin and pivot outwardly into frictional engagement with the inner wall of the roller. This frictional engagement keeps the roller from rotating too fast so the covering does not move too rapidly from an extended to a retracted position once released by the brake which is activated and de-activated in a known manner, and as described previously, by the pull cord.

Figure 28:
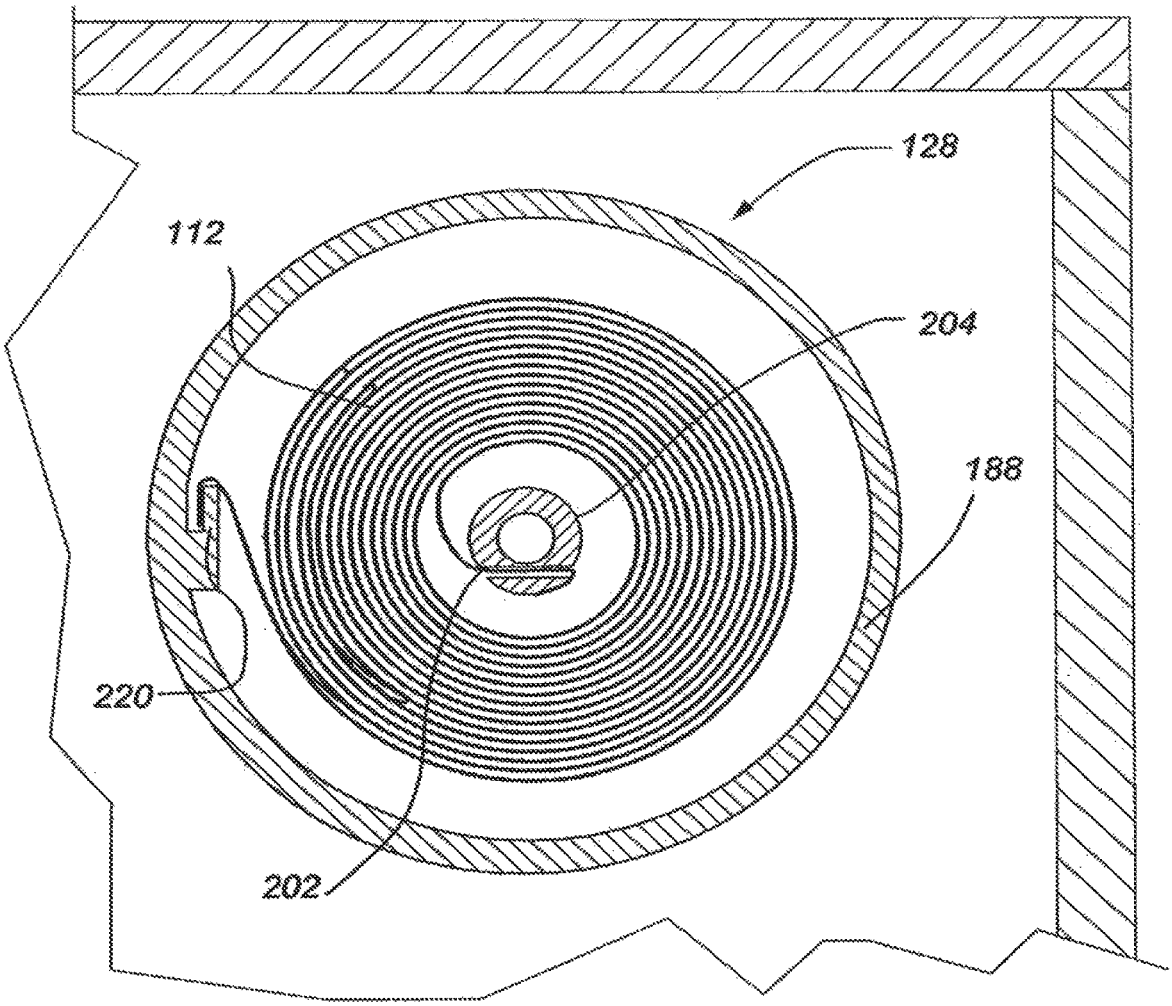
FIG. 28 is a section taken along line 28-28 of FIG. 24.
Figure 29:
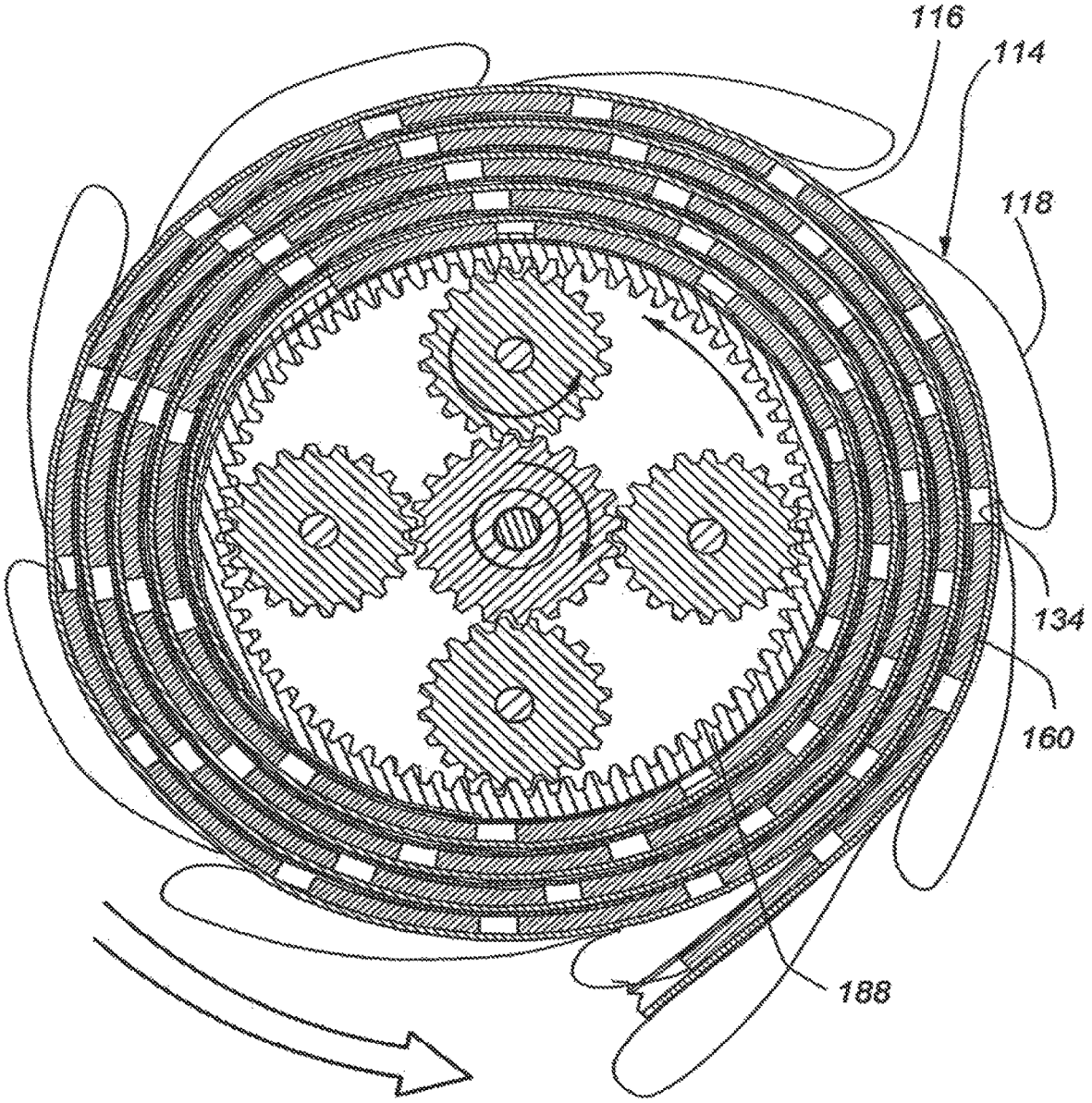
FIG. 29 is a section taken along line 29-29 of FIG. 24.
Figure 30:
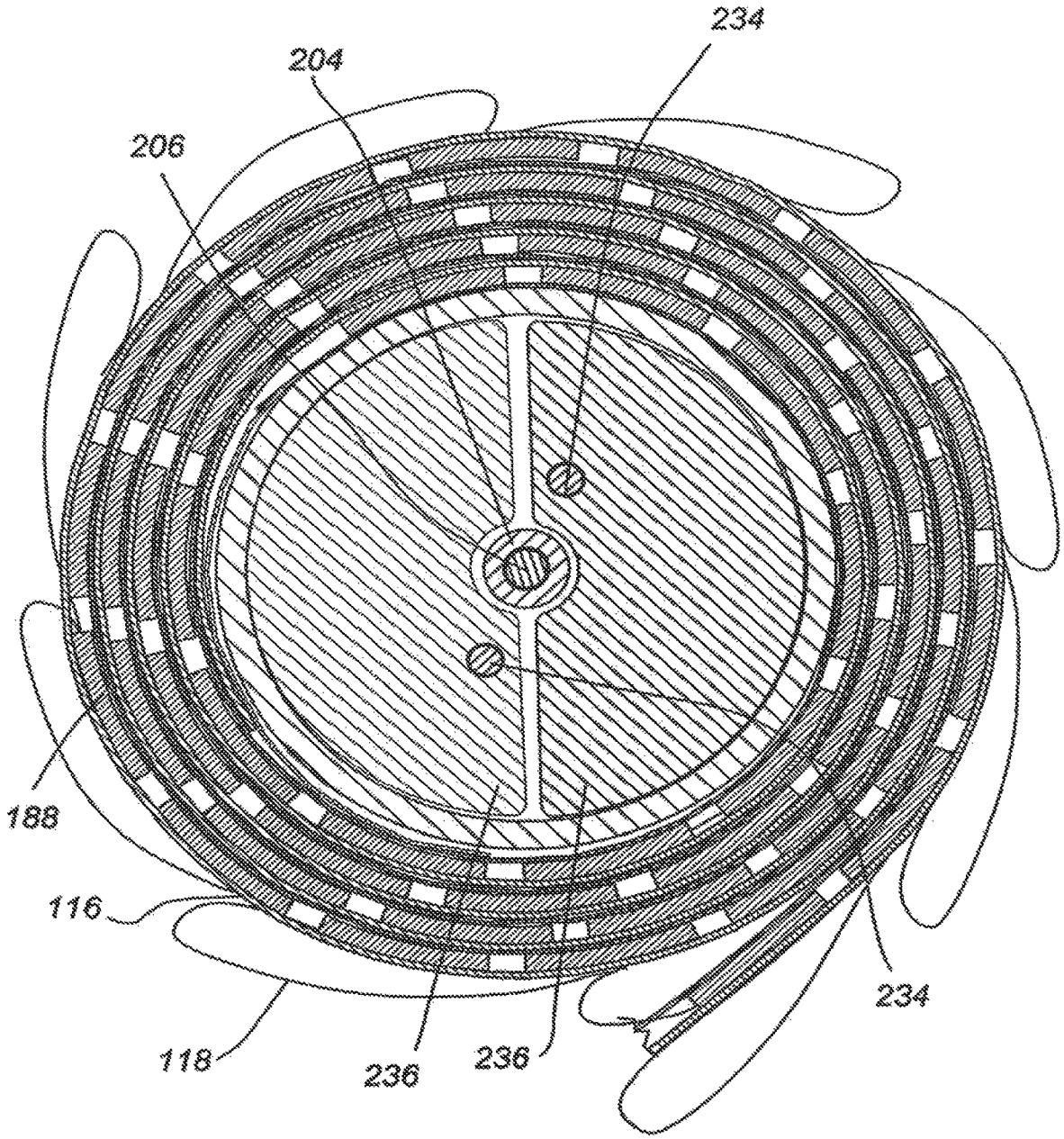
FIG. 30 is a section taken along line 30-30 of FIG. 24.

FIGS. 28, 29 and 30 show sections through the roller 128 at different elevations with FIGS. 29 and 30 showing the fabric covering material 114 wrapped on the roller. FIG. 29 includes directional arrows showing the direction of movement of the roller relative to the planetary gears 220 and the sun gear 232 with it being evident in FIG. 30 that the governor plates 236 will pivot about the pins 234 under centrifugal force as the central disc 228 is rotated at a relatively high rate of speed relative to the roller itself.

A further embodiment 240 of the covering of the present invention is shown in FIGS. 31-58B with this embodiment employing a center-draw system in accordance with the present invention where left 242 and right 244 fabric panels can be extended across corresponding portions of an architectural opening or can be retracted around their own rollers 246 at opposite sides of the opening. As mentioned with the previous embodiments, the rollers can be of any desired length, but it is preferable they be very short, i.e. less than six inches, so are alternately referred to as drums or hubs. It will be appreciated, however, from the description that follows that the control system for operating the embodiment of FIGS. 31-58B could be employed in a side-draw system wherein only a single panel was extendable across the entire architectural opening and could be retracted around a roller at one side edge of the opening as in the prior described embodiments. Modifications to the system described hereafter would be evident to those skilled in the art to convert the center-draw system to a side-draw system.

Figure 31:
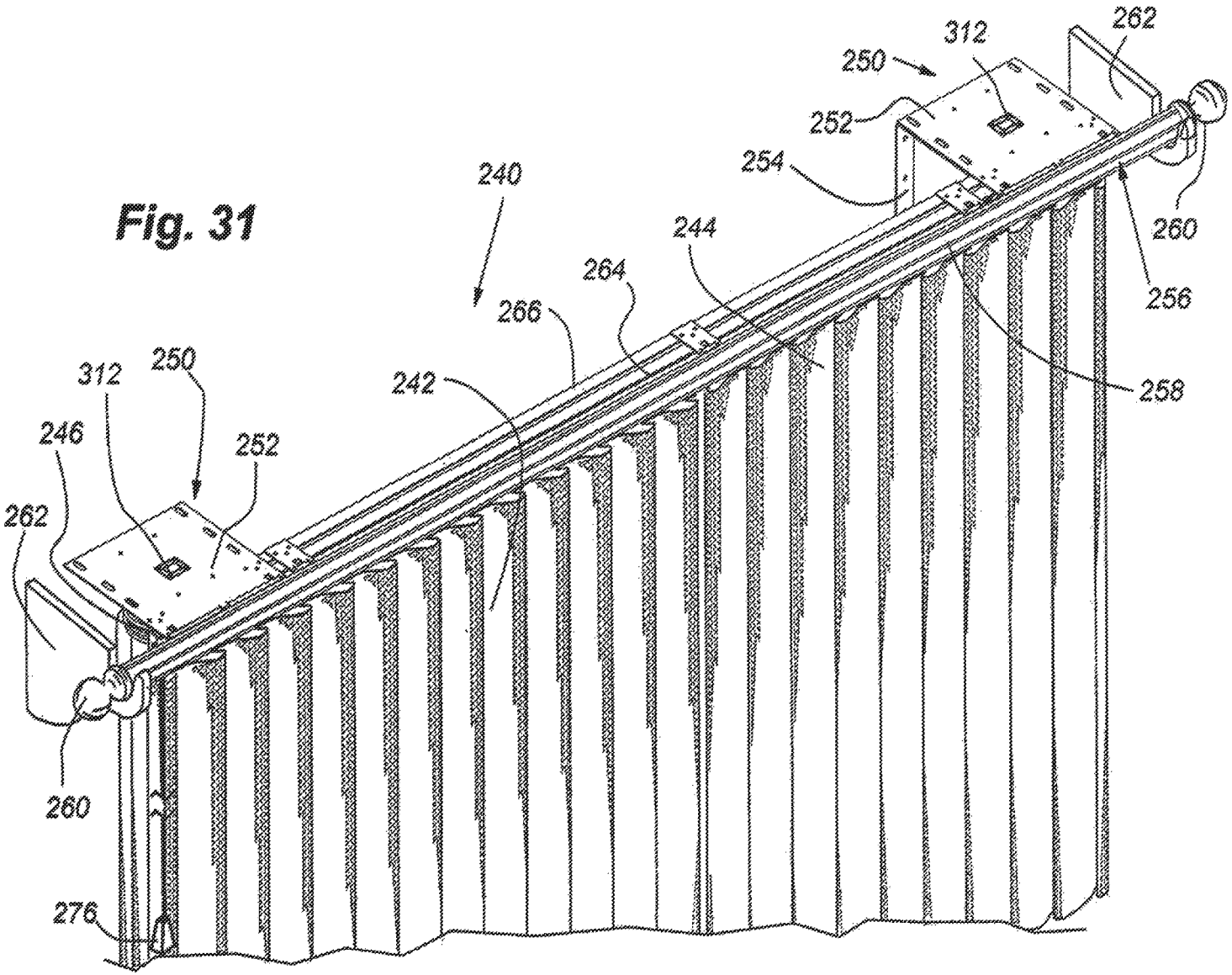
FIG. 31 is a fragmentary isometric of a further embodiment of the present invention, which illustrates a center-draw covering in a fully extended position.
Figure 32:
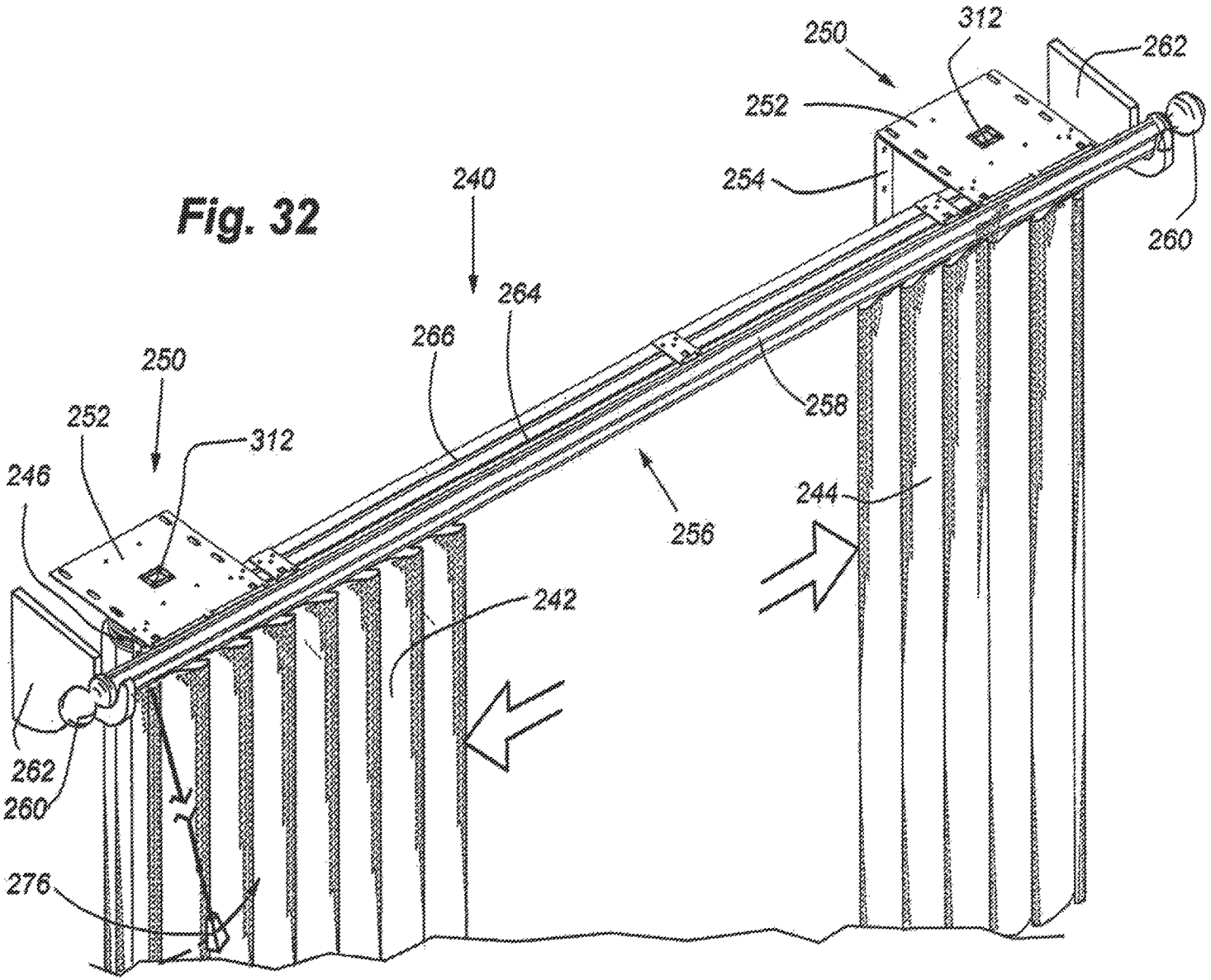
FIG. 32 is a fragmentary isometric similar to FIG. 31 with the covering partially retracted.
Figure 33:
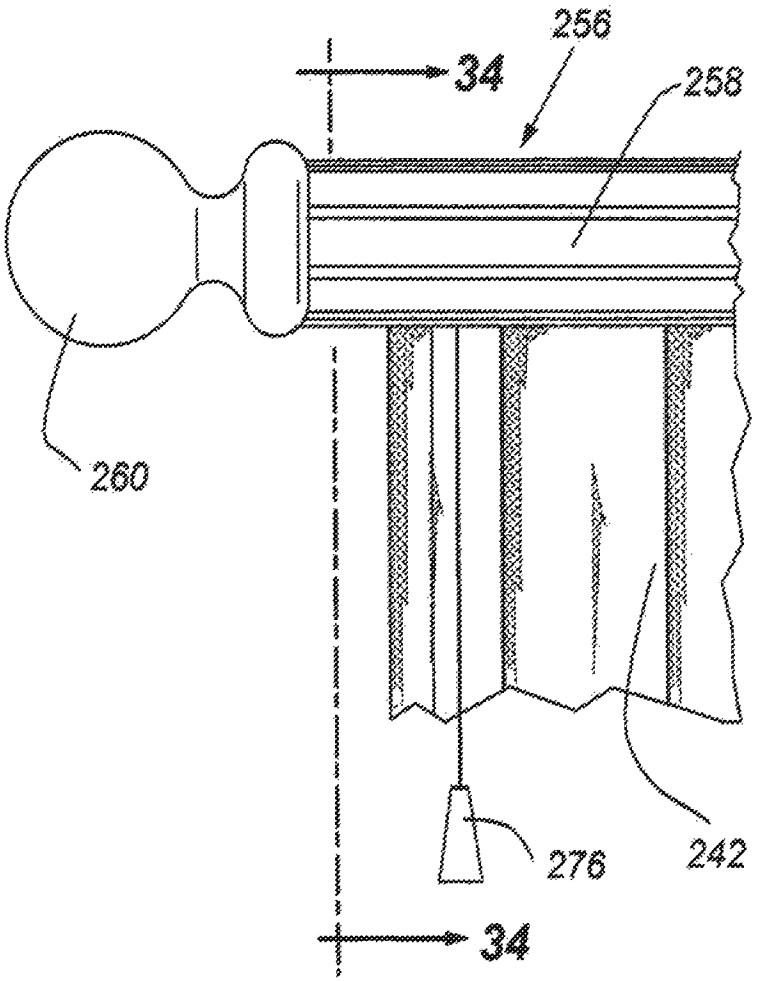
FIG. 33 is an enlarged fragmentary front elevation showing the upper left end of the covering of FIG. 31.
Figure 34:
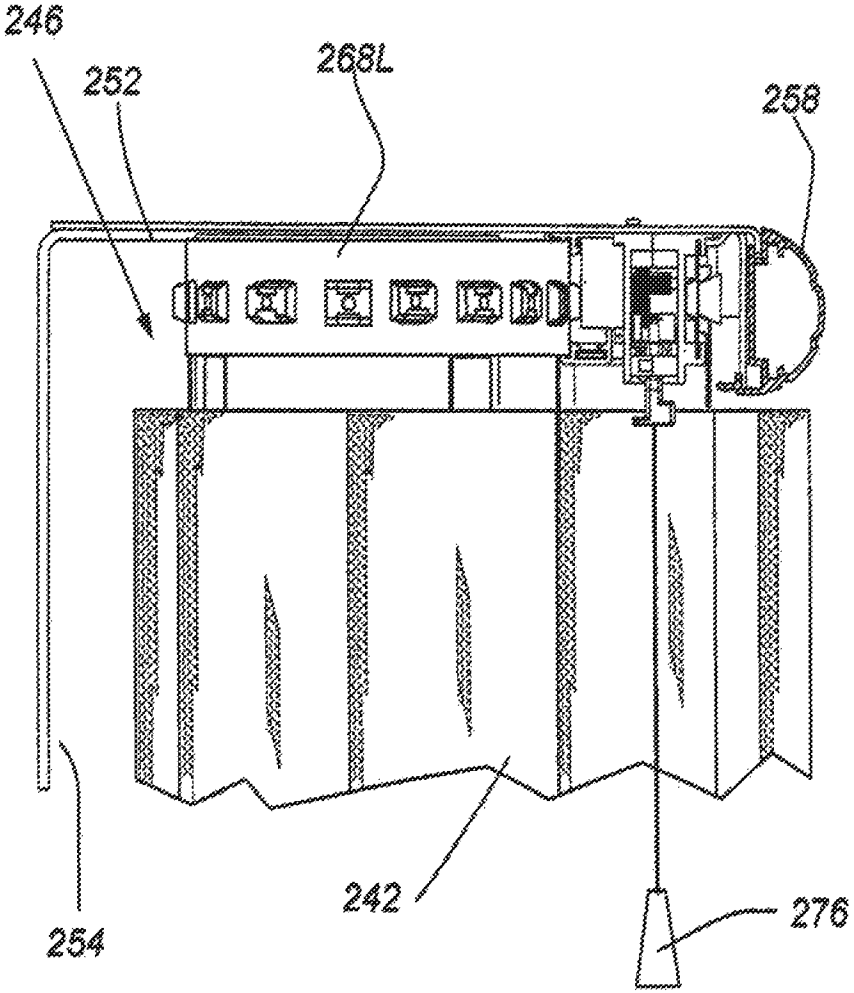
FIG. 34 is a section taken along line 34-34 of FIG. 33.
Figure 36:
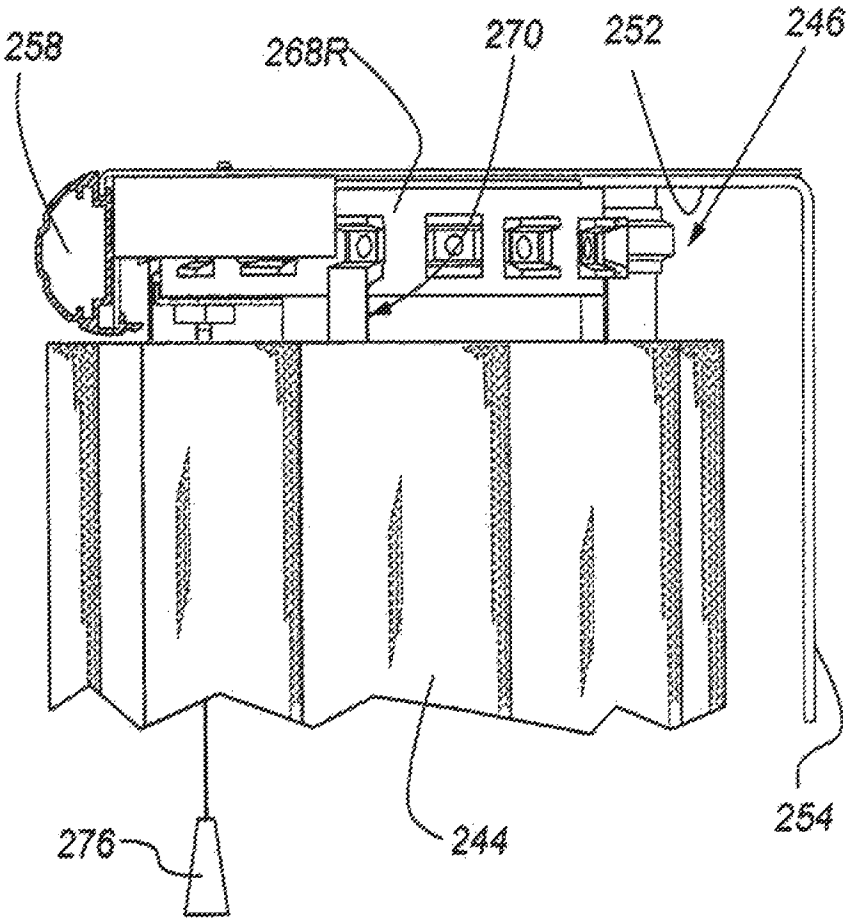
FIG. 36 is a section taken along line 36-36 of FIG. 35.
Figure 35:
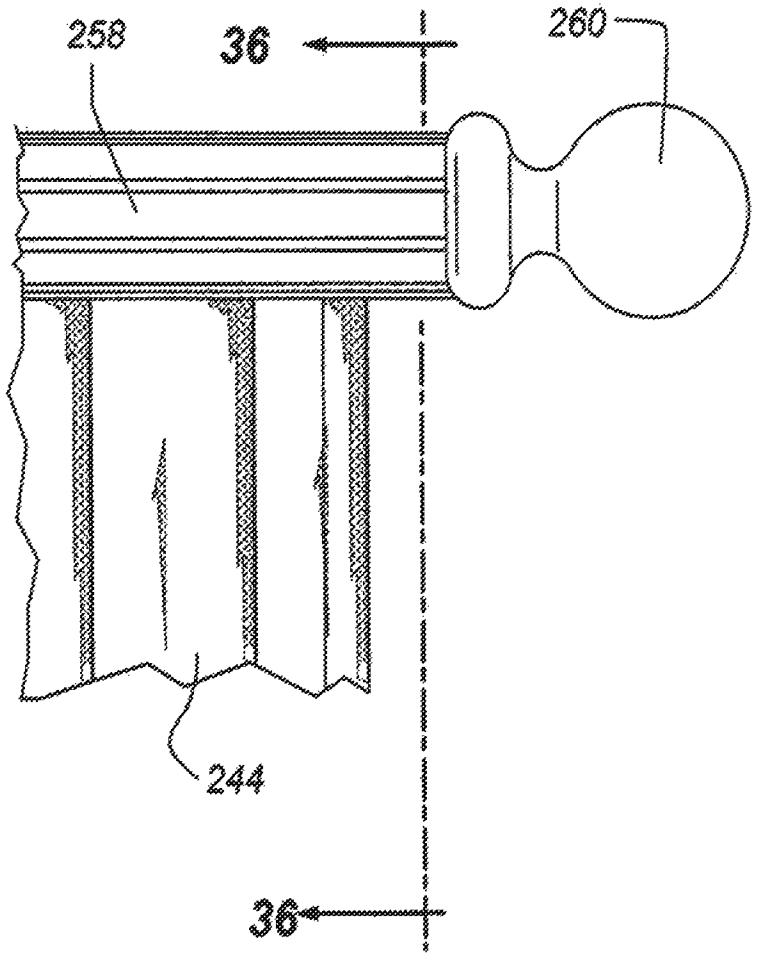
FIG. 35 is a fragmentary elevation similar to FIG. 33 showing the upper right-hand corner of the covering of FIG. 31.
Figure 38:
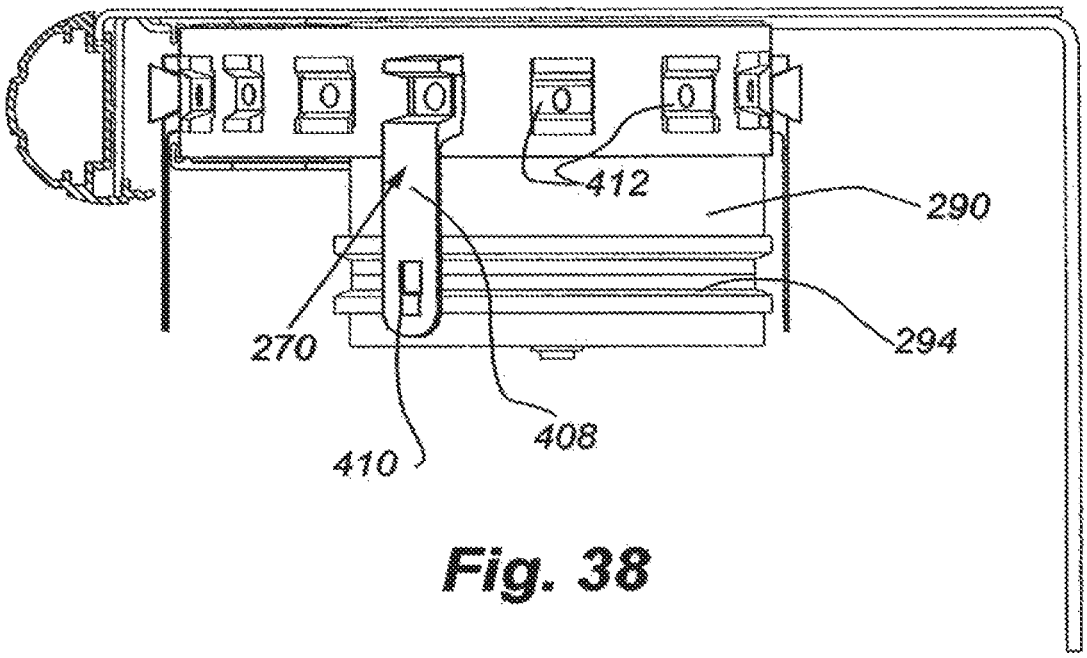
FIG. 38 is a section similar to FIG. 36 with the fabric having been removed.
Figure 37:
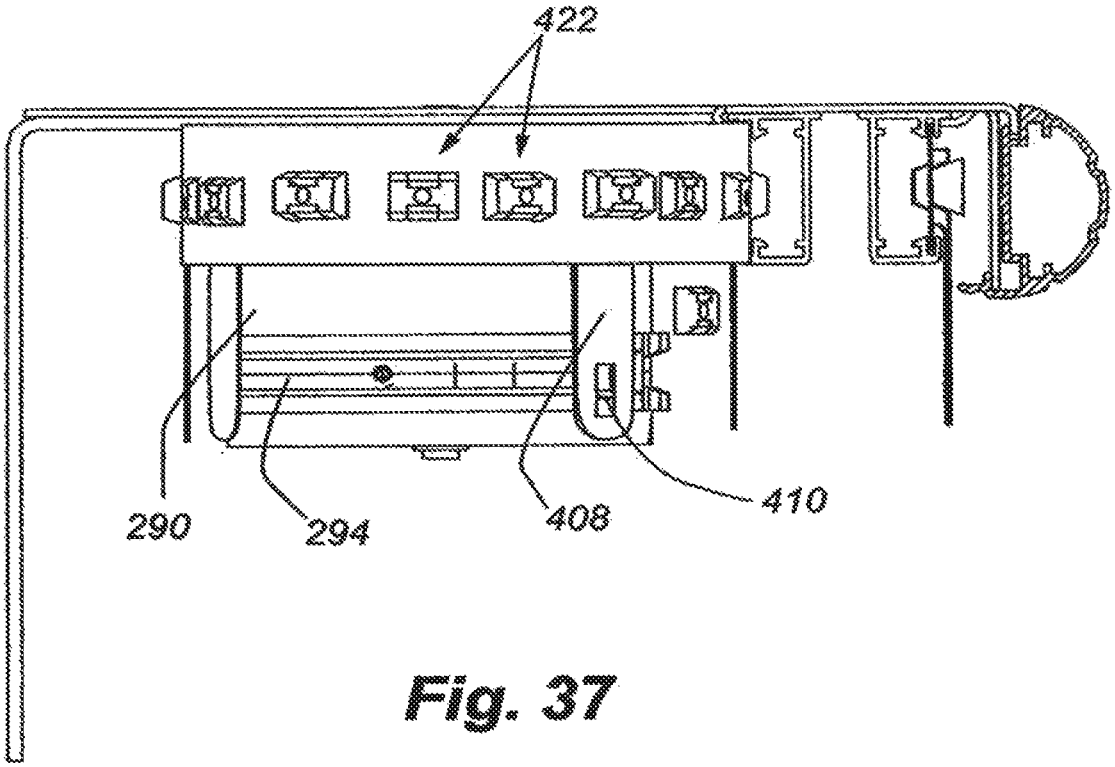
FIG. 37 is a section similar to FIG. 34 with the fabric of the covering having been removed.
Figure 40:
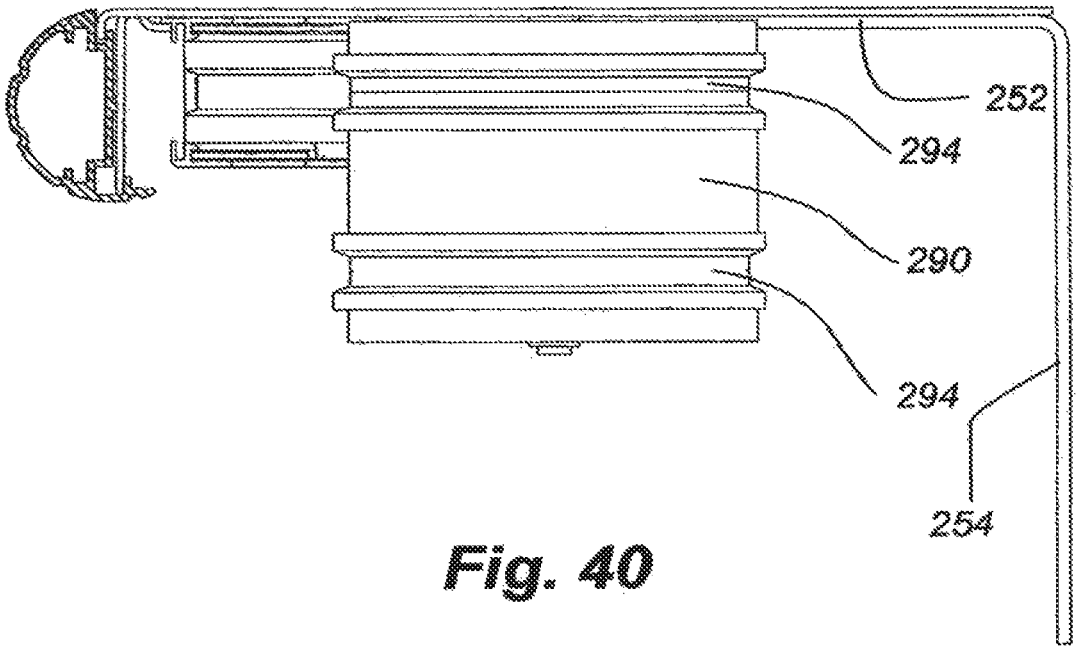
FIG. 40 is a section similar to FIG. 38 with the support tape having been removed.
Figure 39:
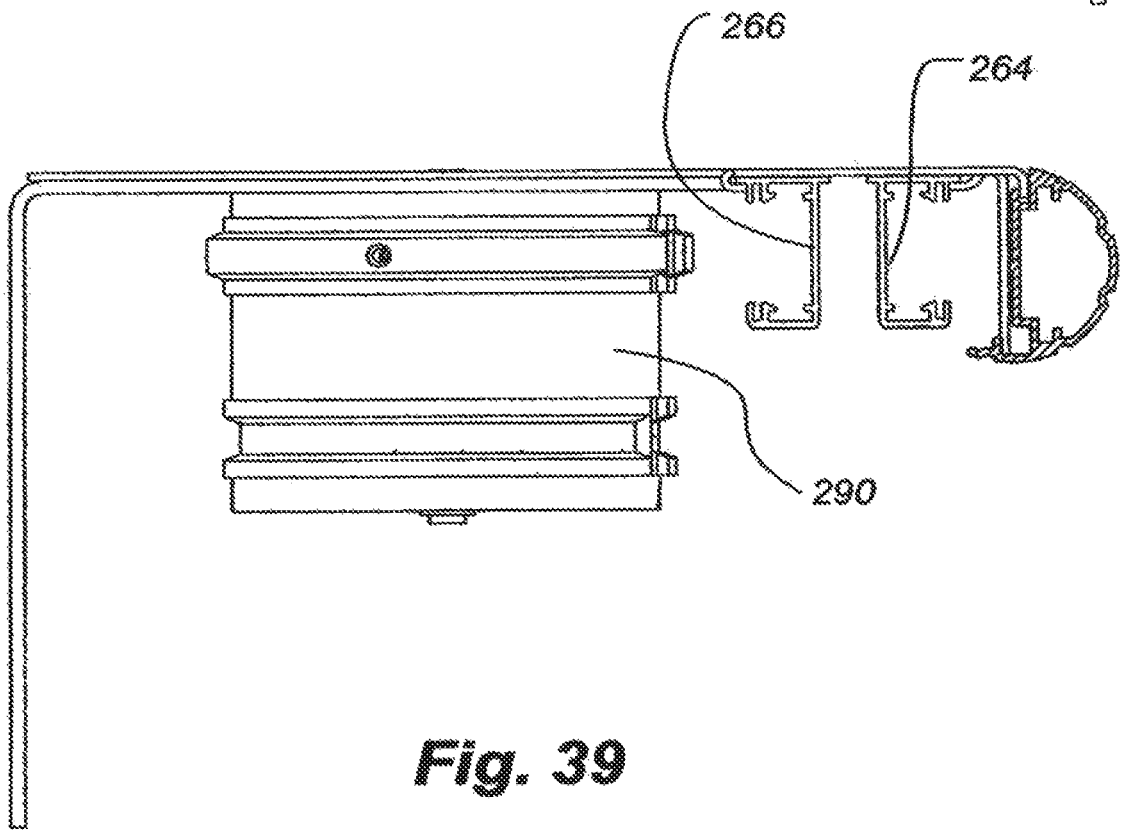
FIG. 39 is a section similar to FIG. 37 with the support tape of the covering having been removed.
Figure 41:
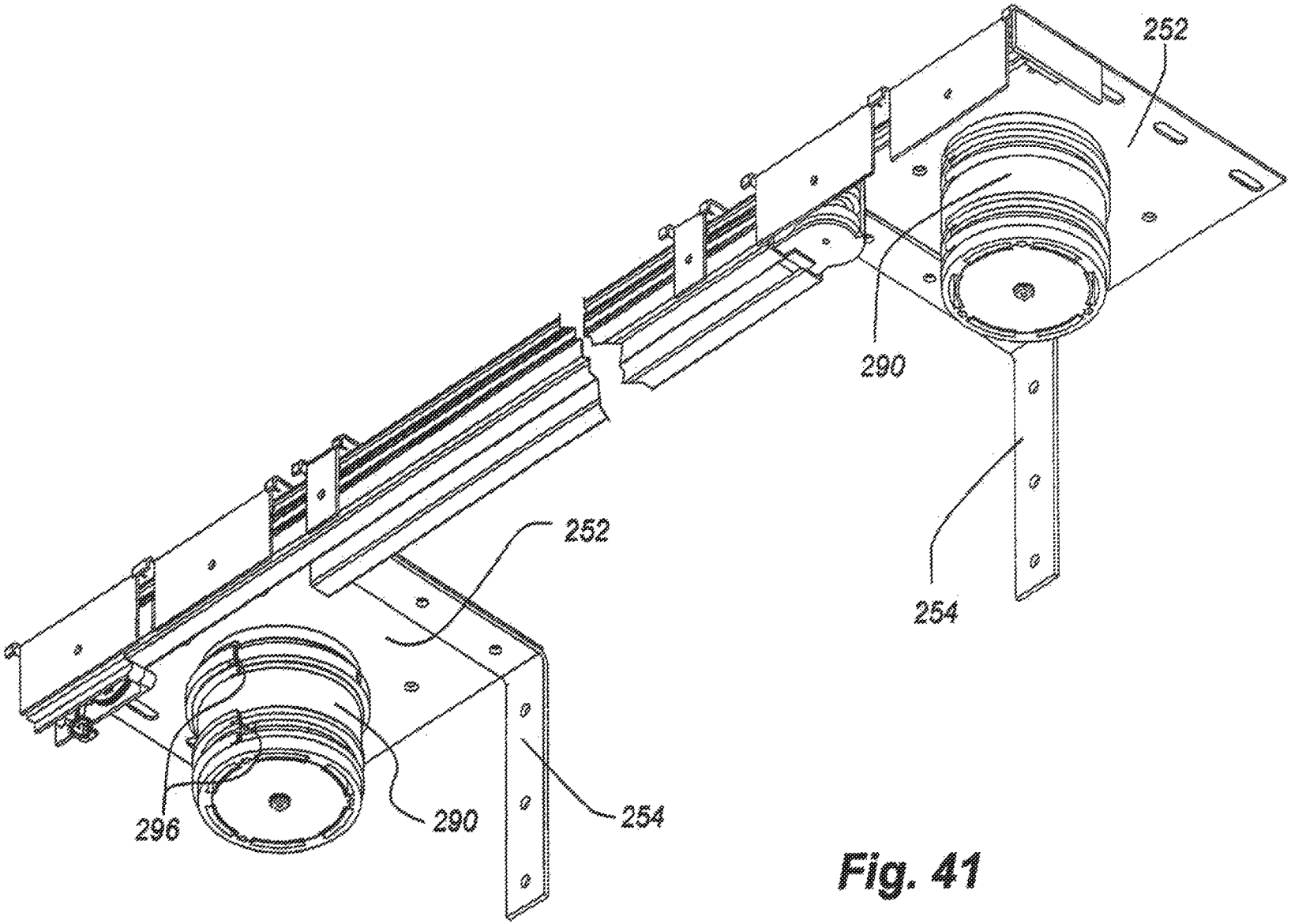
FIG. 41 is a fragmentary isometric looking upwardly at the control system for the covering of FIG. 31 with the fabric and support tapes and pull cord having been removed.

Referring first to FIGS. 31 and 32, the covering of this embodiment of the invention can be seen to incorporate a headrail 246 having mounting brackets 250 with horizontal plates 252 and optional vertical legs 254, which could extend down a vertical wall if the covering were to be mounted on a vertical wall. If it were to be mounted on a horizontal overlying ceiling, the mounting plates would, of course, be secured directly to the ceiling with fasteners through holes provided through the plate. As will be described hereafter, the mounting plates support the control system for the covering as well as a decorative valence 256 which in the disclosed embodiment is simply a substantially semi-cylindrical rod 258 having spheres 260 at opposite ends and shown supported on decorative brackets 262 even though the decorative brackets are simply aesthetic and are not necessary to the operation of the covering as the valence is in fact snapped onto a front flange of the mounting plates 252.

Figure 57:
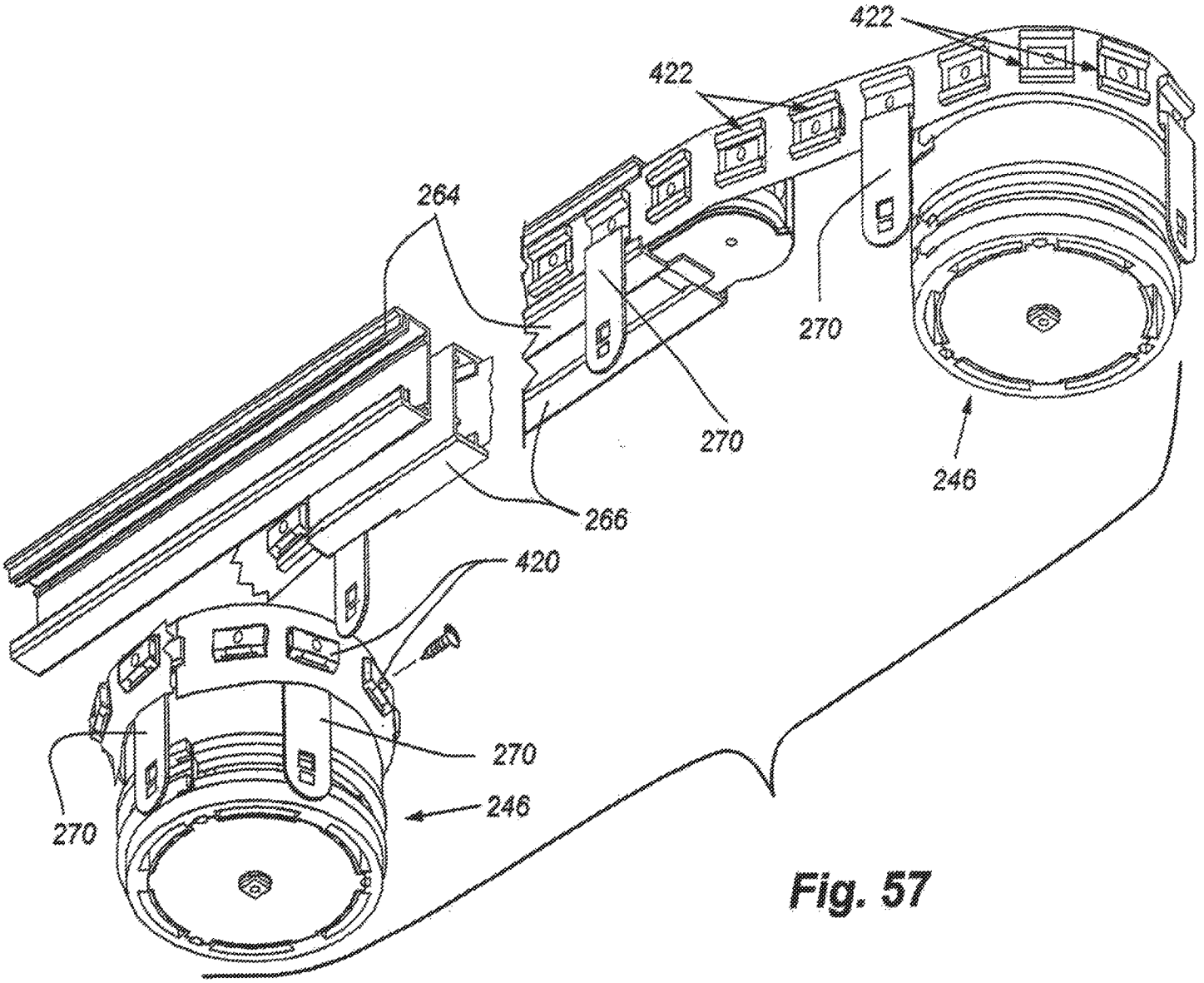
FIG. 57 is a fragmentary isometric looking upwardly at portions of the headrail showing the take-up drum at each end of the covering of FIG. 31.
Figures 58, 58A, 58B:
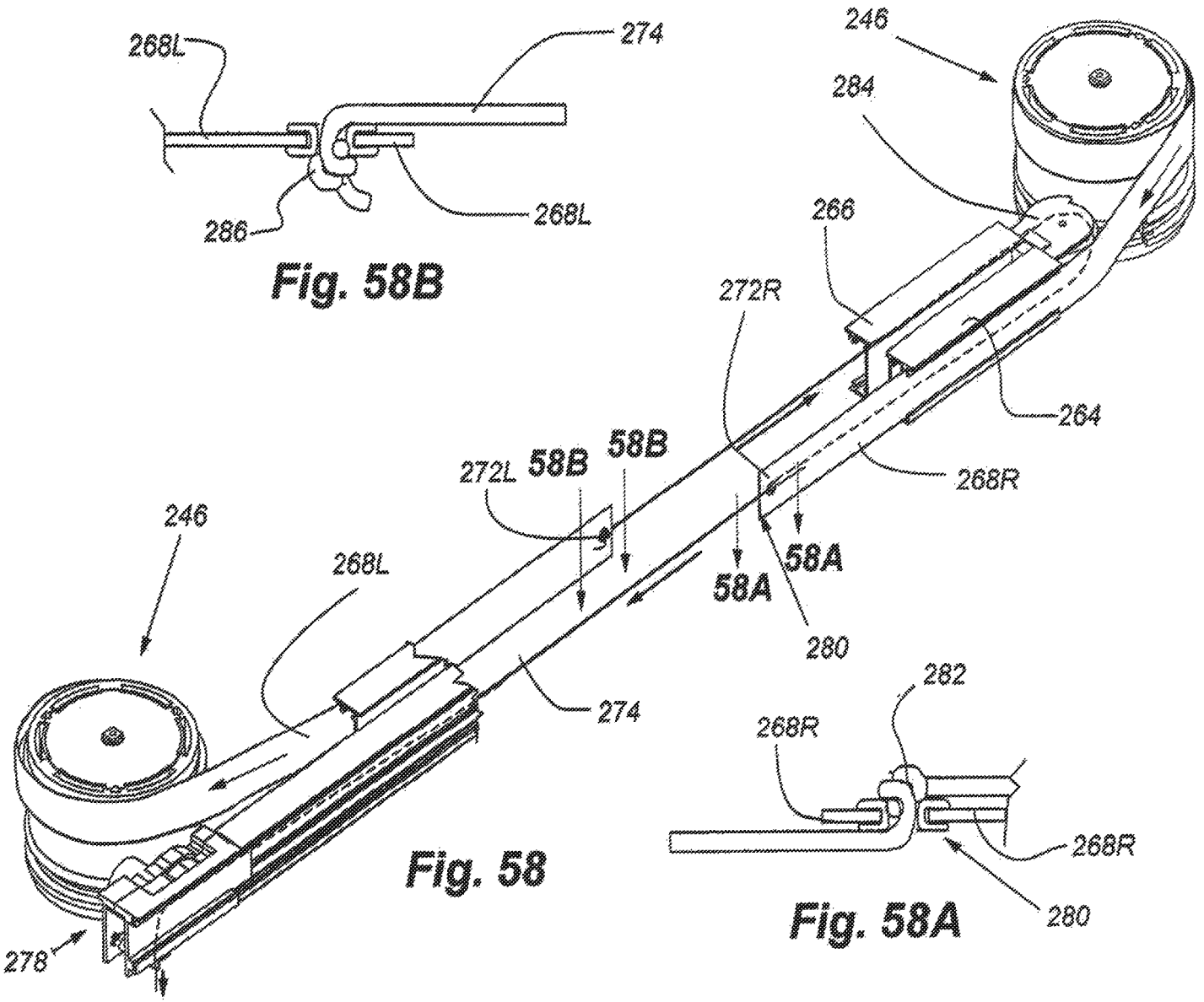
FIG. 58 is a diagrammatic fragmentary isometric looking downwardly at portions of the headrail of the covering of FIG. 31.
FIG. 58A is an enlarged fragmentary section taken along line 58A-58A of FIG. 58.
FIG. 58B is an enlarged fragmentary section taken along line 58B-58B of FIG. 58.
Figure 59:
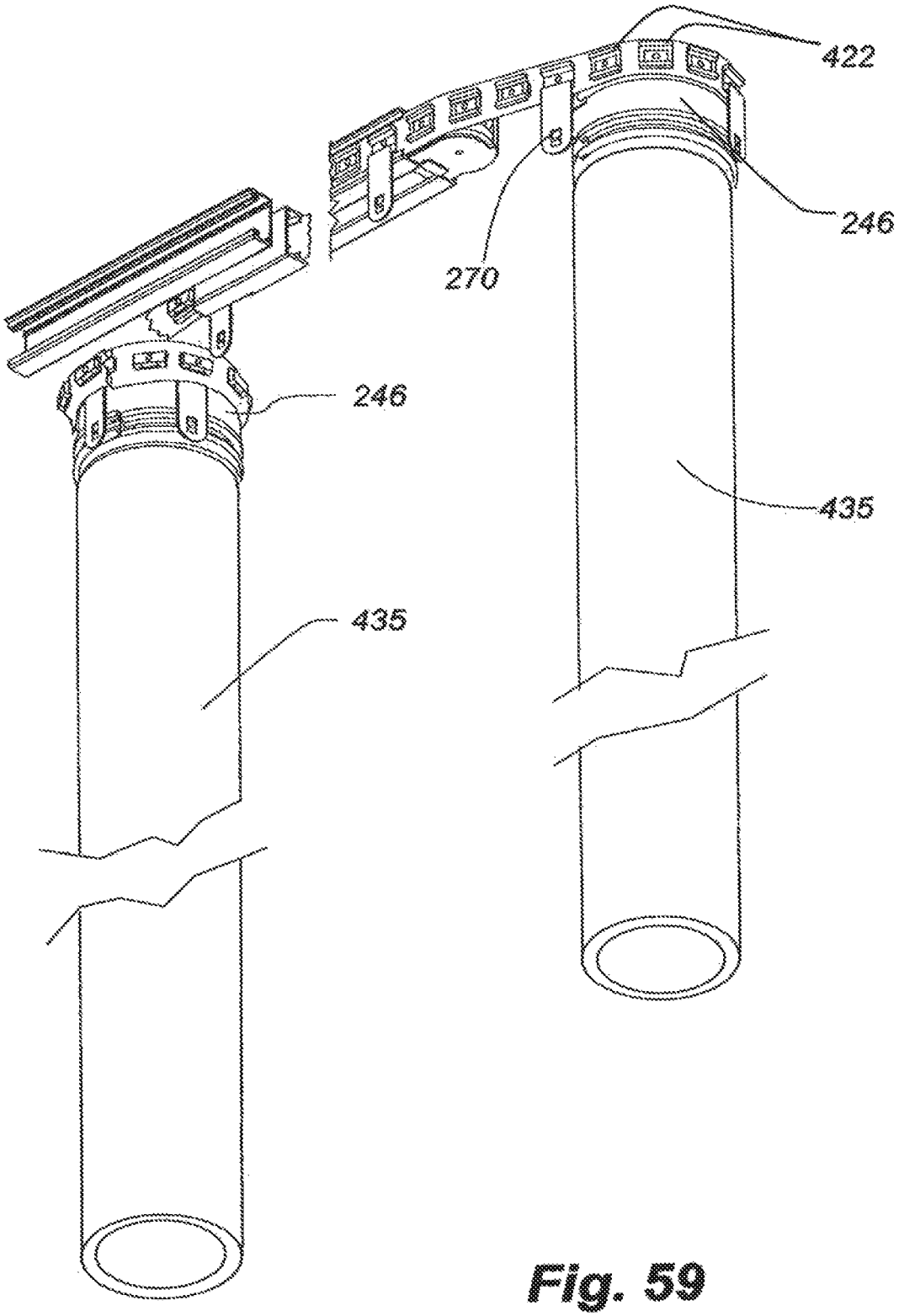
FIG. 59 is an isometric view of an alternative to the embodiment of FIGS. 31 through 58 wherein the roller at each end of the covering is shown as being an elongated tube.

An overview of the operation of the embodiment of FIGS. 31-58A is probably best illustrated in FIG. 58. It can there be seen the headrail 246 has a horizontal front 264 and rear 266 guide track which are each of generally C-shaped cross-section with the front track opening forwardly and the rear track opening rearwardly. These tracks can be similar to those illustrated in the embodiment of FIGS. 17-30 and are therefore designed to slidably support flexible straps 268R and 268L of the type used in the first-described embodiments on which hangers 270 (not shown in FIG. 58) for supporting the fabric panels 242 and 244 are mounted. Rotatable rollers 246 are mounted at each end of the headrail and suspended from the mounting plates 252 for rotation about vertical axes with each roller having an outer end of a support strap secured thereto so that as the panel of fabric associated with each support strap is extended or retracted, the strap with the fabric supported thereon is unwrapped from an associated roller or wrapped thereon, respectively.

The opposite or inner end 272R and 272L of each support strap 268R and 268L, respectively, is secured to a common pull cord 274 having a depending free end 276 at the left end of the headrail, which is manipulatable by an operator which could be a human being, an electric motor, or the like. The pull cord extends upwardly through a drive system 278 at the left end of the headrail and then horizontally toward the opposite end of the headrail where it is fixedly connected at an intermediate location 280 along its length with a knot 282 (FIG. 58A) to the inner end 272R of the support strap associated with the right fabric panel 244 and roller 246 at the right end of the headrail. The pull cord continues to extend toward the right end of the headrail, after its connection to the inner end of the right support strap, where it passes around a pulley 284 mounted for rotation about a vertical axis so that it then extends rearwardly and subsequently in a reverse horizontal direction toward the left end of the headrail. The opposite end of the pull cord 274 is then connected with a knot 286 (FIG. 58B) to the inner end 272L of the left support strap which is associated with the left panel 242 of the covering. It will therefore be appreciated that by pulling downwardly on the pull cord at the left end of the headrail, the inner end of the right support strap is pulled to the left toward the center of the headrail while the inner end of the left support strap is pulled to the right toward the center of the headrail. Of course, movement of the pull cord in an opposite or upward direction at its free end 276 at the left end of the headrail permits the right support strap to wrap around its associated roller and the left support strap to wrap around its associated roller. As will be appreciated from the description that follows, the drive system 278 at the left end of the headrail is operative to permit the pull cord to be pulled downwardly at the left end of the headrail to extend or close the covering across the architectural opening and bias springs 288 (to be described hereafter) are mounted within the rollers 246 to rotatably bias the rollers and thus the covering toward a retracted position. A brake is also provided in the drive system, as will be described later, to retain the covering in any fully or partially extended position.

The rollers 246 are probably best described by reference to FIGS. 49-55. It will also be appreciated with the description that follows that the rollers are modular and are identical at each end of the headrail except the rollers are inverted relative to each other so that the appropriate rotational bias can be placed on the roller, which is in an opposite rotational direction at each end of the headrail. In other words, and as mentioned previously, the roller at the left end of the headrail, as viewed in FIG. 58, is biased in a clockwise direction while the roller at the right end of the headrail is biased in a counterclockwise direction, which in both instances, is toward a retracted position of the covering. Due to the modular design of the roller, the inversion is accomplished simply by inverting the roller without any other modifications.

Since the rollers 246 are identical, only one will be described with that roller being illustrated in the orientation shown in FIGS. 49-55. The roller has a rotatable generally cylindrical main body 290, which is substantially hollow in its interior except that it has an inwardly directed horizontal ring gear 292 integrally formed therein adjacent to the top of the cylindrical body. A pair of axially vertically spaced annular grooves 294 is formed in the outer surface of the cylindrical body with each groove being of substantially trapezoidal transverse cross-section. As best appreciated by reference to FIGS. 49, 54, and 55, each groove is also a spiral so that at one identified location 296 on the outer surface of the cylindrical body, the groove is substantially contiguous with the outer surface of the cylindrical body but progressively increases in diameter as it extends around the cylindrical body in one direction so that at the same location, the opposite end of the groove (even though it is continuous) is raised away from the cylindrical surface of the main body for a purpose to be described hereafter.

Figure 51:
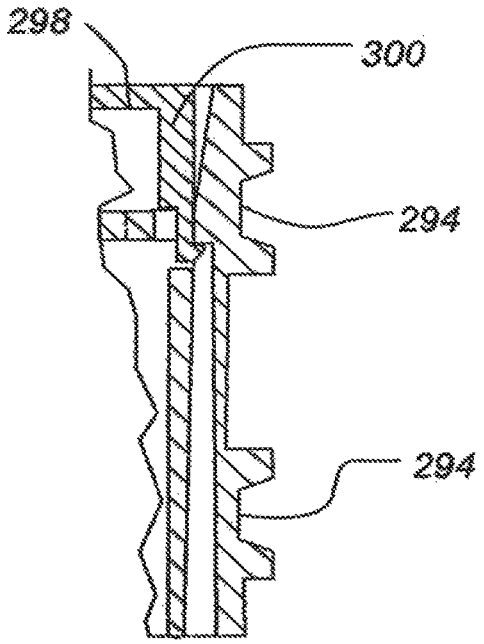
FIG. 51 is an enlarged fragmentary section taken along line 51-51 of FIG. 50.
Figure 52:
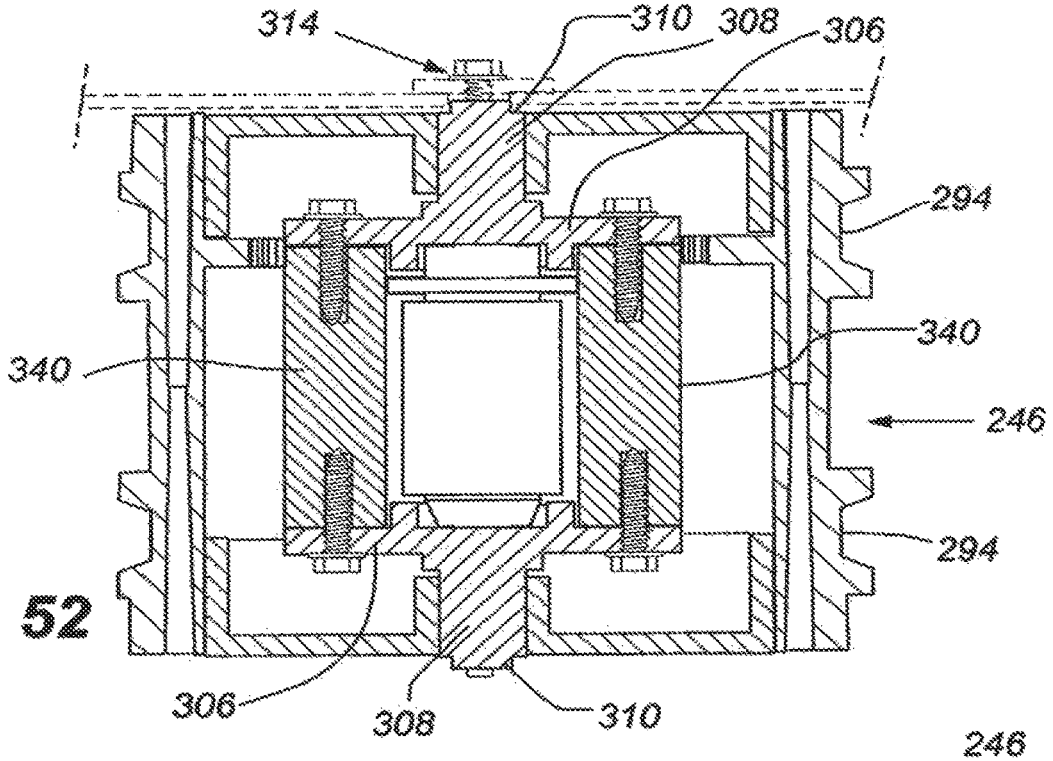
FIG. 52 is a section taken along line 52-52 of FIG. 50.
Figure 53:
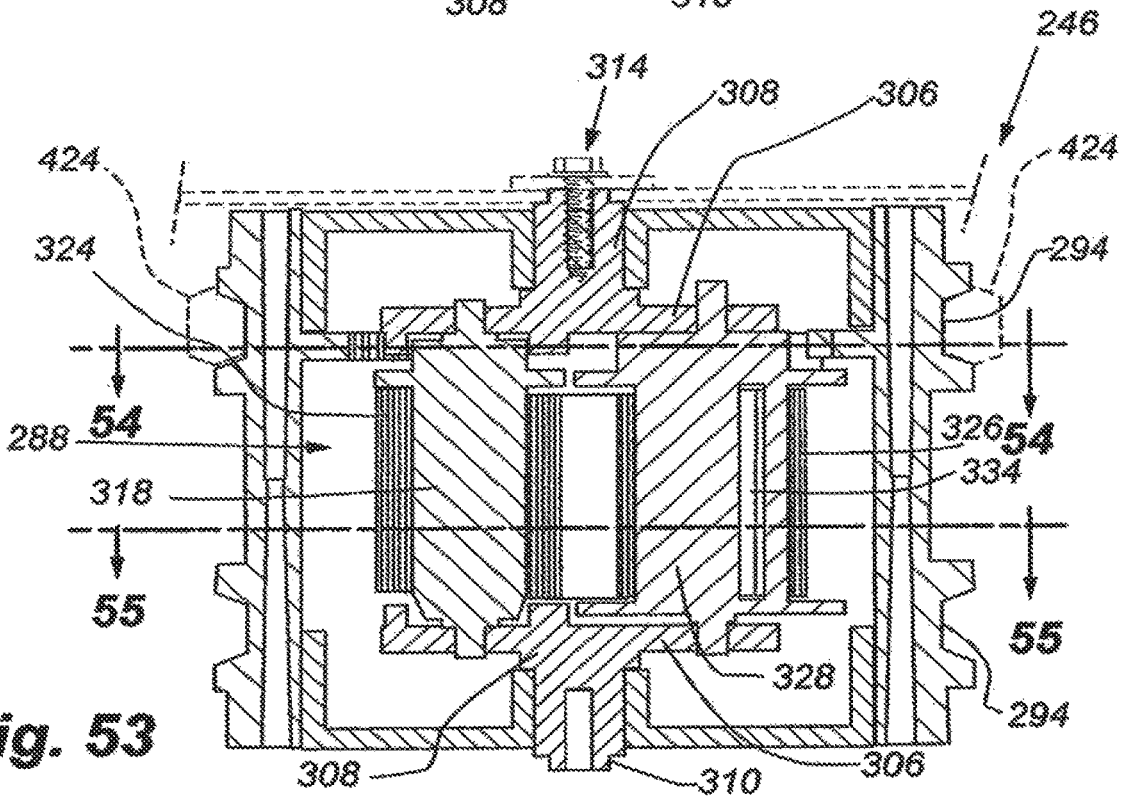
FIG. 53 is a section taken along line 53-53 of FIG. 50.
Figure 54:
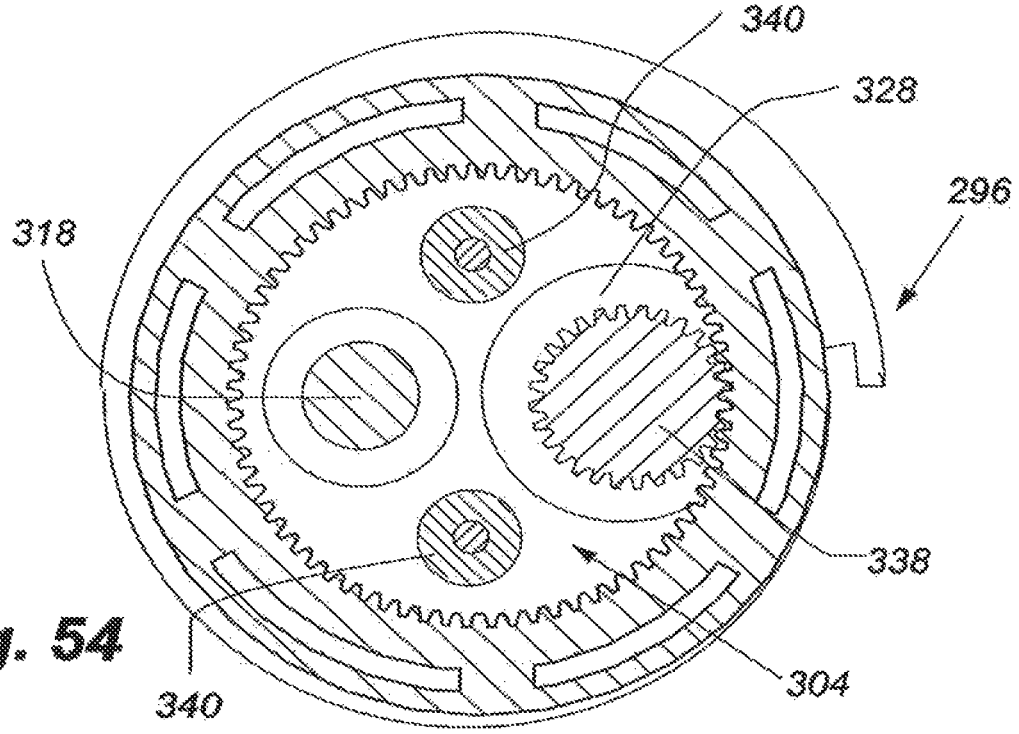
FIG. 54 is a section taken along line 54-54 of FIG. 53.
Figure 55:
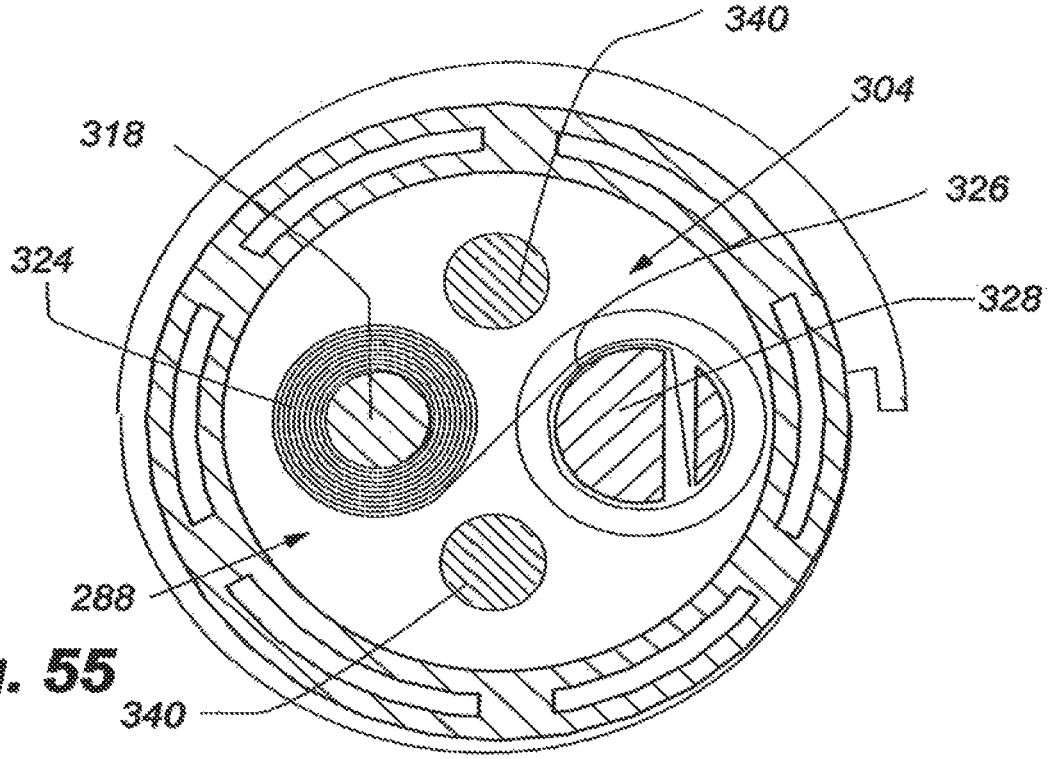
FIG. 55 is a section taken along line 55-55 of FIG. 53.
Figure 55A:
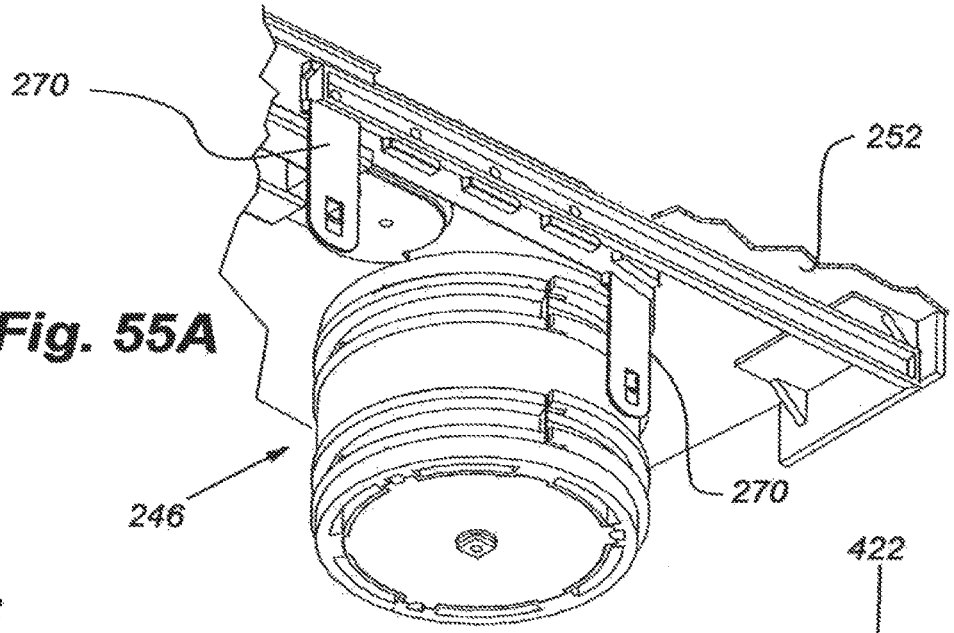
FIG. 55A is a fragmentary isometric looking upwardly at the take-up drum at the right end of the headrail with a support tape positioned adjacent thereto.
Figure 56A:
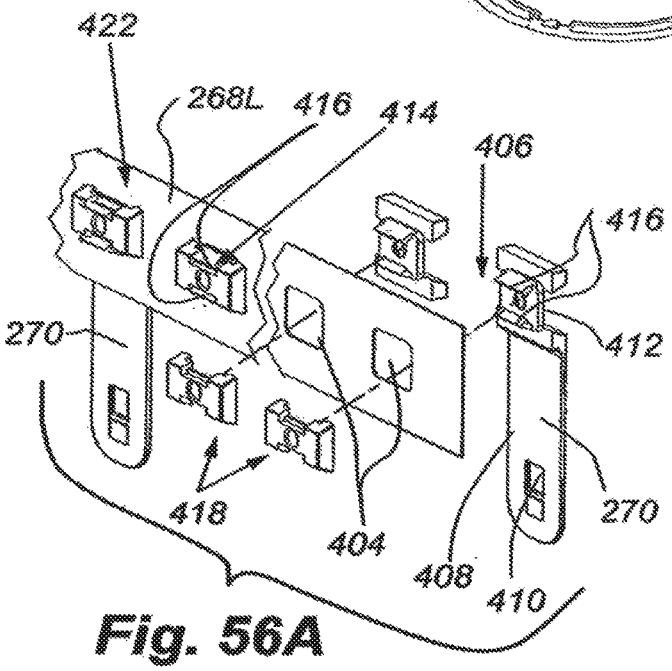
FIG. 56A is an exploded fragmentary isometric of a support tape and fabric hangers shown from the rear side of the tape.
Figure 56B:
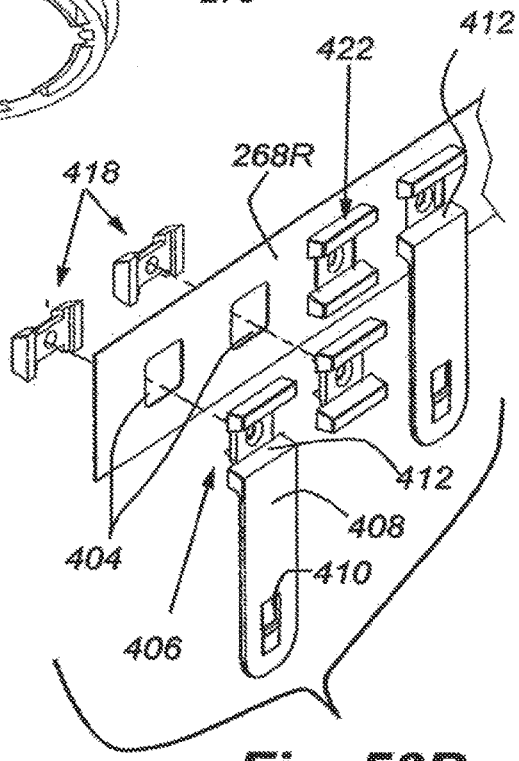
FIG. 56B is an exploded fragmentary isometric similar to FIG. 56A as viewed from the front of the tape.

Upper and lower identical circular end caps 298 are removably mounted on opposite ends of the main cylindrical body with each end cap having somewhat flexible catch legs 300 extending in an axial direction with each catch leg being alignable and associated with a catch groove 302 in the associated end of the main body 290 so that the end caps can be inserted into the open ends of the main body and releasably snapped in place as possibly best appreciated by reference to FIG. 51. The end caps, therefore, rotate in unison with the cylindrical main body and in fact rotate relative to the mounting plate 252 from which the rollers 246 are suspended as the associated support strap 268R and 268L is wrapped about and unwrapped from the roller.

Figure 49:
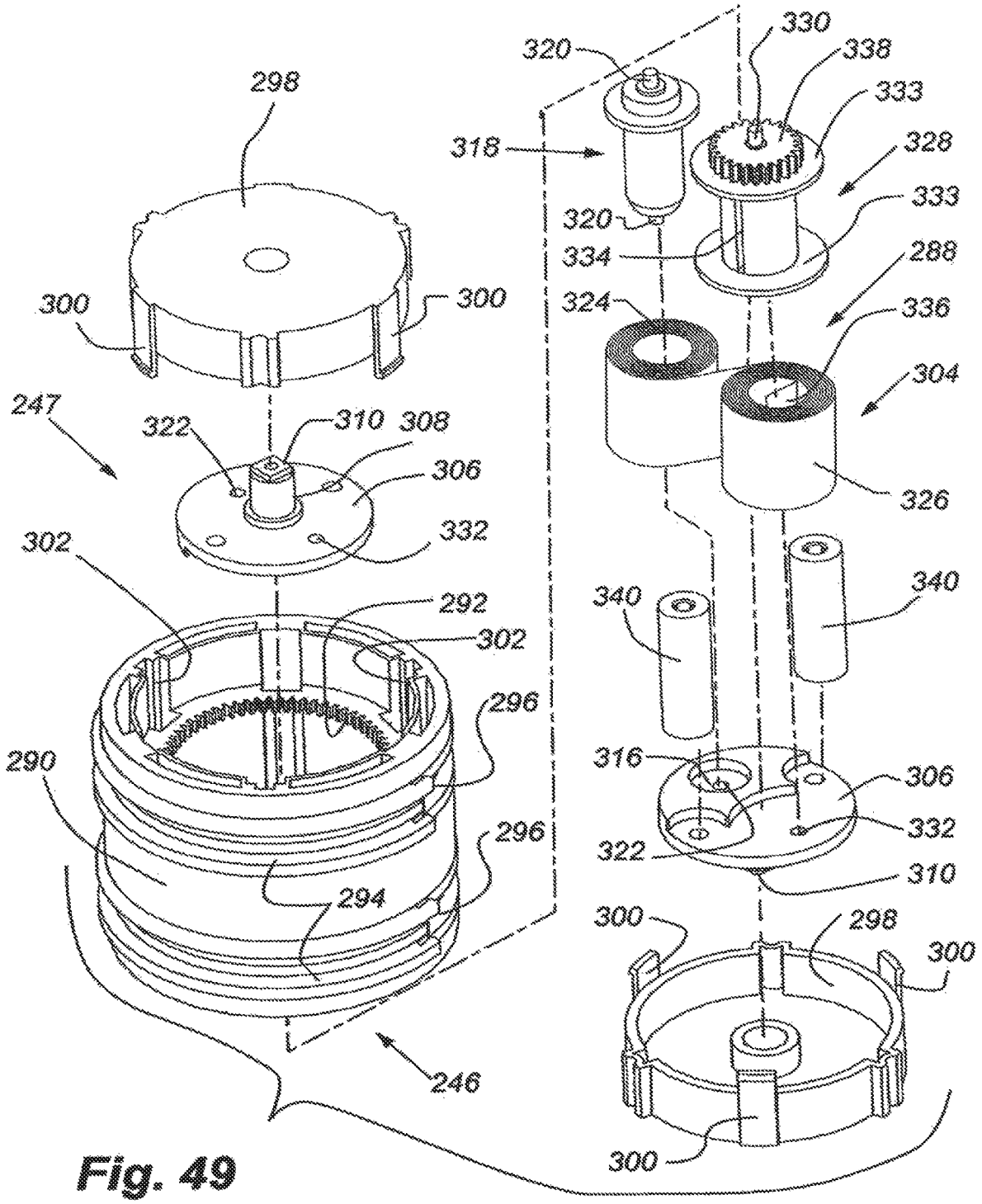
FIG. 49 is an exploded isometric of a take-up drum and speed governor incorporated into the control system of the covering of FIG. 31.
Figure 50:
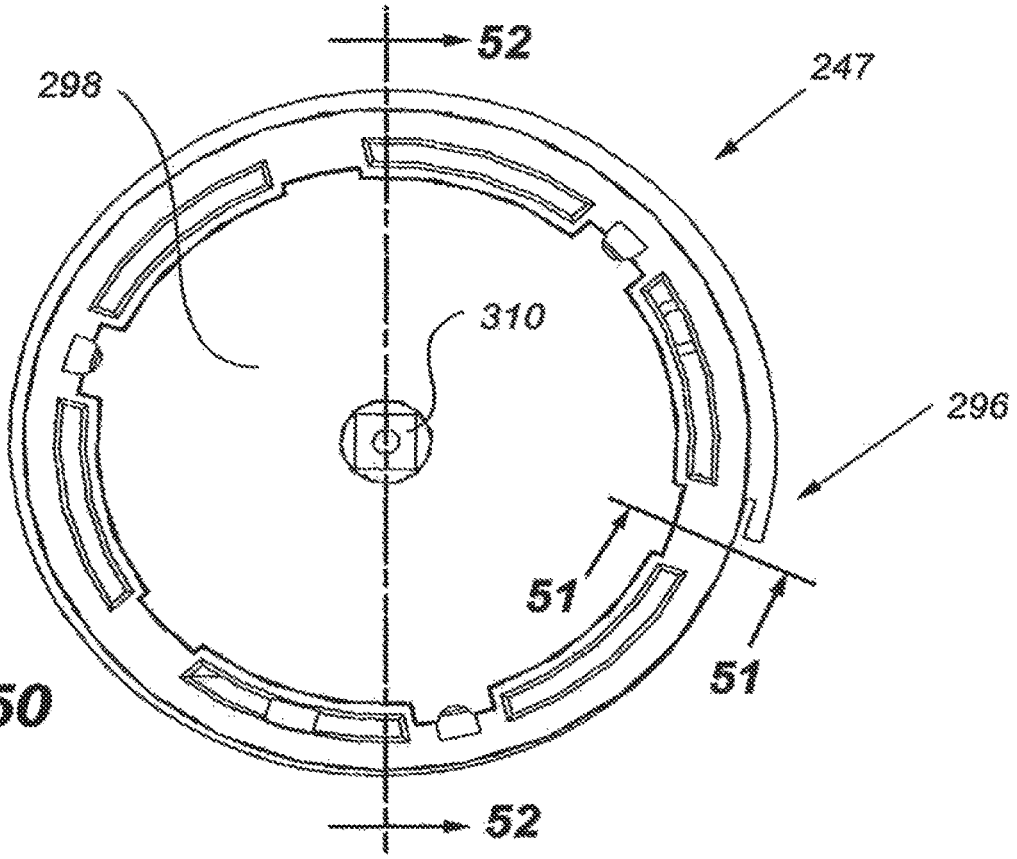
FIG. 50 is a top plan view of the drum shown in FIG. 49 is an assembled condition.

Internally of each cylindrical main body 290, a spring system or unit 304 is rotatably mounted with the spring system being fixed relative to the mounting plate 252 so that the cylindrical body 290 is rotatable thereabout. As best seen in FIG. 49, the spring system includes upper and lower support disks 306 which are identical with the upper support disk having an upwardly projecting cylindrical shaft 308 and the lower support disk having a downwardly projecting support shaft 308. The end 310 of each support shaft is square, which is complementary with a square hole 312 in the associated mounting plate so that the upper disk, when connected to the underside of a mounting plate 252 with a washer and fastener 314 as seen best in FIGS. 52 and 53, remains fixed relative to the mounting plate. Of course, when the roller is inverted for mounting at the opposite end of the headrail, the square end 310 of the support shaft at the bottom of the roller is directed upwardly and positioned in the square hole 312 of the mounting plate at that end of the headrail.

Each support disk has a recess 316 for positioning one end of an idler spring mount 318 with the idler spring mount having axially protruding pins 320 for rotatable receipt in holes 322 within the recesses 316. The idler spring mount or support is therefore rotatable between the upper and lower support disks 306, and one wrap 324 of a dual-wrap spring 288 (FIG. 49) is wrapped around the cylindrical body of the idler mount or support 318. The opposite wrap 326 of the dual-wrap spring is positioned around a cylindrical body of a drive spring support or mount 328, which also has pins 330 projecting from opposite ends thereof that are rotatably received in holes 332 in the associated support disks so it too is rotatable relative to the support disks. The drive support 328 has rings 333 at opposite ends thereof surrounding the cylindrical body with a longitudinal slot 334 in the cylindrical body adapted to receive a tab 336 on one end of the wrap 326 of the double-wrap spring. Above the upper ring is a pinion gear 338 integral with the upper ring 332 so that the pinion gear rotates with the drive support 328. The pinion gear is meshed with the internal ring gear 292 of the cylindrical body 290. When the spring system is mounted within the cylindrical main body of the roller as seen possibly best in FIGS. 52 and 53, it will be appreciated rotation of the cylindrical body of the roller in one direction causes the pinion gear to rotate in a corresponding direction but at a faster speed than the ring gear 292 and consequently the roller. A fixed spacing is maintained between the upper and lower support disks by cylindrical spacer legs 340, which are diametrically opposed from each other and spaced 90 degrees around the support disk from the idler and drive supports.

From the above description, it will be appreciated the spring system 304 is a modular system that is rotatably seated within the main body 290 of the roller 246 and that rotation of the cylindrical body of the roller causes the drive support 328 to rotate and tension the dual-wrap spring 288 when the roller is rotated in a first predetermined direction. As mentioned previously, the rollers are mounted on their associated mounting plates 252 so that the roller at the left end of the headrail tensions its dual-wrap spring when it is rotated in a counterclockwise direction and the roller at the right end of the headrail tensions its dual-wrap spring when rotated in a clockwise direction.

The drive system 278 for the covering is probably best appreciated by reference to FIGS. 42-48. The drive system, of course, is intended to cooperate with the pull cord 274 in effecting extension and retraction of the covering. The drive system also includes a speed governor 342, which controls the rate at which the double-wrap springs 288 in the rollers 246 move the covering from the extended to the retracted position.

Figure 45:
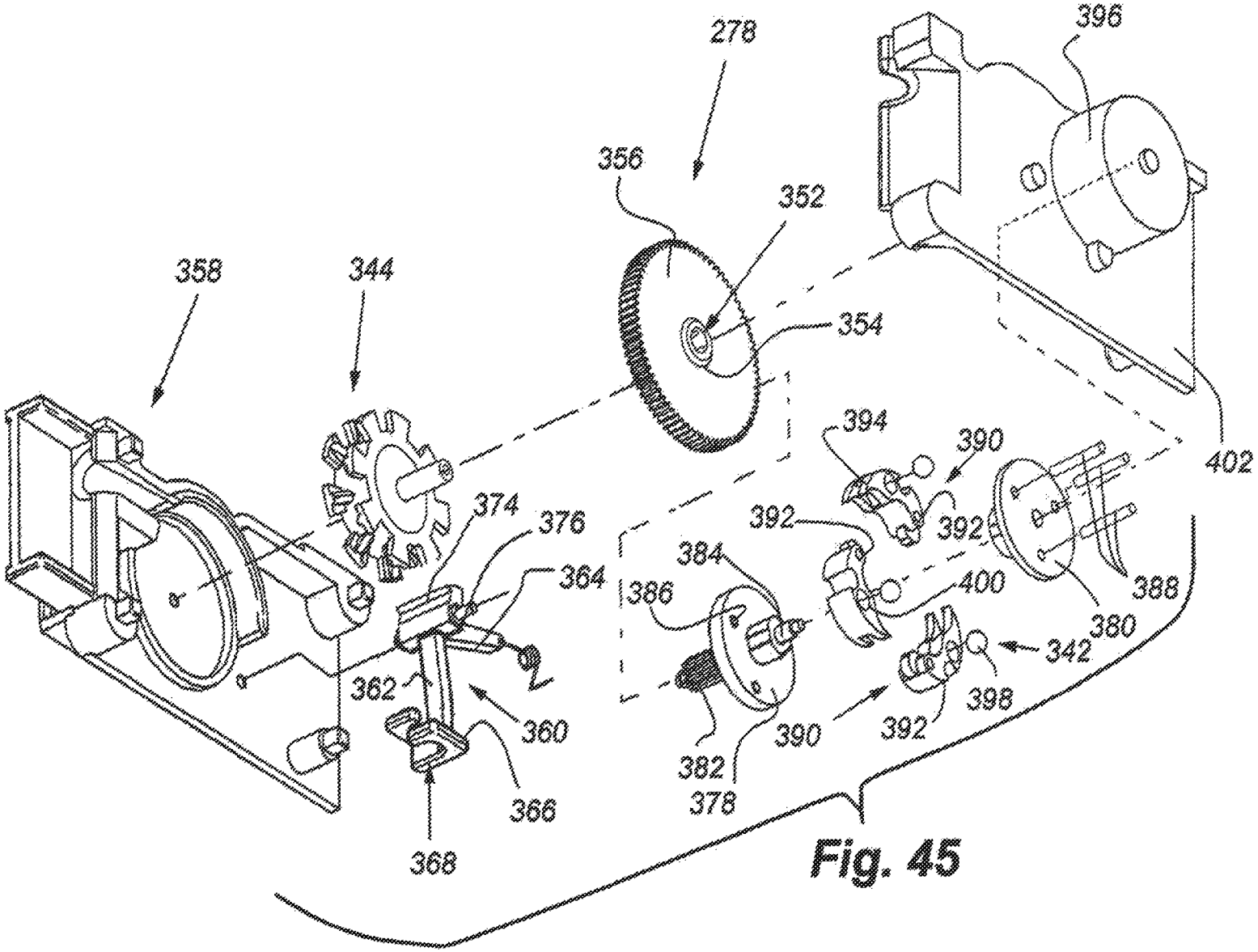
FIG. 45 is an exploded isometric of the drive system shown in FIG. 42.
Figure 46:
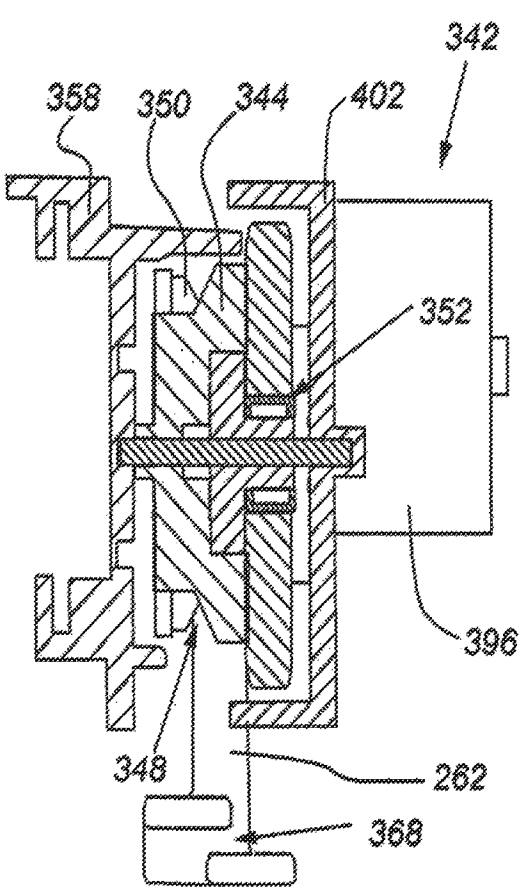
FIG. 46 is an enlarged section taken along line 46-46 of FIG. 43.
Figure 47:
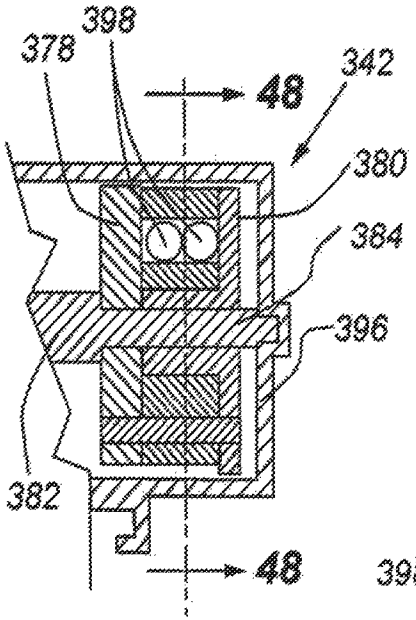
FIG. 47 is an enlarged section taken along line 47-47 of FIG. 43.
Figure 48:
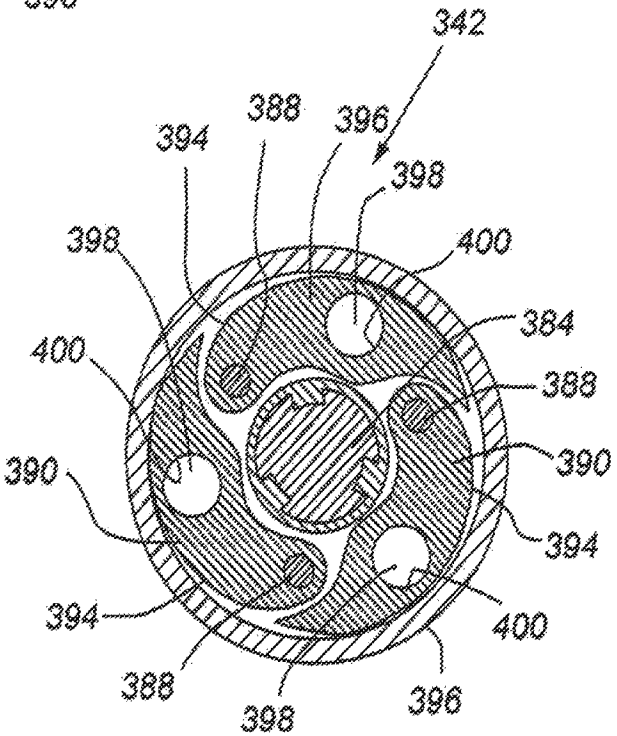
FIG. 48 is a section taken along line 48-48 of FIG. 47.

Referring first to FIG. 45, the drive system 278 can be seen to include a drive or cog wheel 344 having radially extending opposed fingers 346 defining a groove 348 therebetween in which the pull cord is positioned with the fingers also having teeth 350 adapted to grip the cord 274 so that movement of the cord in one direction or another causes the drive wheel to rotate in a corresponding direction. The drive wheel supports on an inner face thereof a one-way bearing 352, which is press fit or otherwise fixedly received in an axial hole 354 through a drive gear 356 so that the drive wheel will rotate in one direction in unison with the drive gear while the drive gear can rotate in an opposite direction independently of the drive wheel. The drive wheel with the associated drive gear are rotatably mounted on a support plate 358 at the left end of the headrail even though the drive system could just as easily be mounted at the opposite end of the headrail as will be apparent to those skilled in the art.

Figure 43:
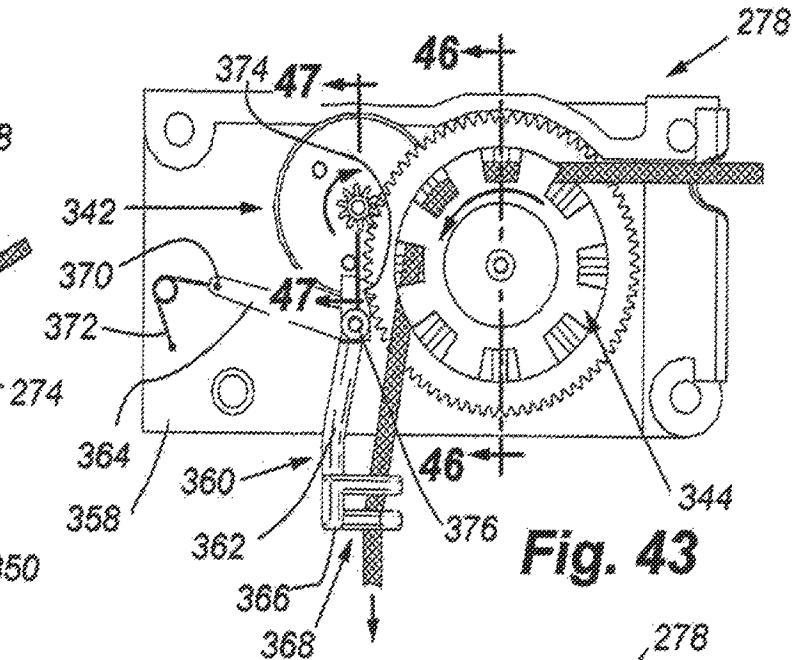
FIG. 43 is a front elevation of the drive system shown in FIG. 42.
Figure 44:
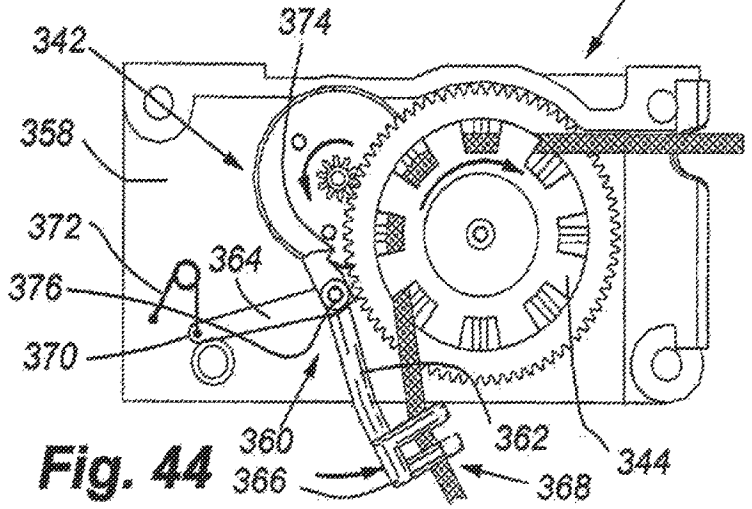
FIG. 44 is a front elevation similar to FIG. 43 with the brake for the drive system having been released.
Figure 42:
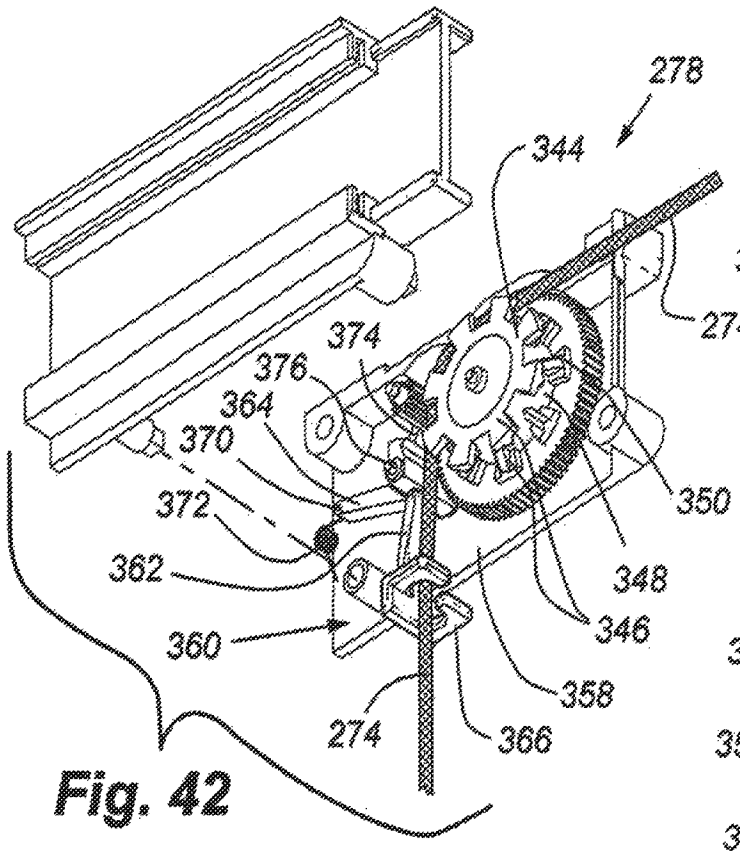
FIG. 42 is an exploded fragmentary isometric showing the left end of the headrail for the covering of FIG. 31 with the drive system for the covering of FIG. 31.

Pivotally mounted on the support plate 358 is a trigger arm 360 having a substantially vertical leg 362 and a substantially horizontal leg 364 with the lower or distal end 366 of the vertical leg having a passage 368 therethrough for slidable receipt of the pull cord 274. The distal end 370 of the horizontal leg is connected to one end of a toggle spring 372 whose opposite end is secured to the support plate so that the toggle spring shifts between the positions shown in FIGS. 43 and 44 so as to alternately bias the horizontal leg in an over-center manner toward an operative position as shown in FIG. 43 and a release position as shown in FIG. 44. In the operative position, the vertical leg of the trigger arm has a pawl 374 at its upper end engageable with the teeth in the drive gear 356 with the pawl being on the opposite side of the pivot 376 from the distal end 366 of the vertical leg. As will be appreciated, as the trigger arm is pivoted in a counterclockwise direction, the pawl is released from its engagement with the drive gear and when the pivot arm is pivoted in a clockwise direction into the position of FIG. 43, the pawl is engaged with the drive gear. As mentioned, the toggle spring alternately biases the trigger arm toward either the operative position of FIG. 43 or the release position of FIG. 44. Of course, in the release position of FIG. 44, the drive wheel 344 is free to rotate by pulling downwardly on the pull cord 274, which causes the covering to extend or by letting the pull cord rise, which allows the covering to retract under the bias of the dual springs 288 in the rollers 246. However, when the trigger arm is in the locked position of FIG. 43, rotation of the drive gear 356 is prevented even though rotation of the drive wheel is permitted in a counterclockwise direction, due to the one-way bearing 352, such as when the pull cord is being pulled downwardly. The drive wheel cannot rotate in a clockwise direction when the pawl is engaged in the drive gear due to the one-way bearing connection between the drive wheel and the drive gear, which does, however, permit rotation of the drive wheel in a counterclockwise direction while the drive gear is fixed in position. This relationship between the drive wheel and the drive gear permits an operator to pull downwardly on the drive cord to extend the covering but when the cord is released, it will not move upwardly to permit the covering to retract under the bias of the double-wrap springs as the drive wheel cannot rotate in a clockwise direction relative to the drive gear and the drive gear is prevented from rotating in a clockwise direction by the pawl in the locked position of FIG. 43. It is therefore evident the covering can be pulled toward the extended position to any desired degree but as soon as the pulling motion on the pull cord is terminated, the covering will remain in that position until the pull cord is pulled again or until the trigger arm is pivoted counterclockwise into the release position of FIG. 44 where the pull cord is allowed to be moved upwardly with the drive wheel rotating in a clockwise direction along with rotation of the drive gear caused by the bias of the dual-wrap springs on the rollers.

Rotation of the drive gear 356 in a clockwise direction, as when the covering is retracting, as mentioned previously, has its speed of rotation governed by a governor 342. The governor is probably best appreciated by reference to FIGS. 45-48 and it will there be seen that it includes a front 378 and rear 380 support disk with the front support disk having a forwardly projecting pinion gear 382 fixed to a drive shaft 384 that extends through and is keyed or otherwise fixed to the front support disk for unitary rotation therewith. The front support disk also has three recesses 386 formed therein for receipt of pivot pins 388 associated with pivotal friction arms 390 mounted between the front and rear support disks for pivotal movement about an associated pivot pin. Each friction arm has a bearing hole 392 formed therein at an off-centered location so that rotation of the pinion gear causes each friction arm, through centrifugal force, to pivot about its pivot shaft so that an outer arcuate surface 394 on the friction arm engages a cylindrical wall within a housing 396 surrounding the friction arms where drag of the friction arms on the internal surface of the housing restricts rotation of the pinion gear 382 and thus the drive gear 356 with which it is enmeshed. The degree of frictional drag is regulated by inserting weighted balls 398 into cylindrical pockets 400 within each friction arm with two of such weighted balls being shown in such a pocket in FIG. 47. Of course, the heavier the arm the more centrifugal force holding it against the inner cylindrical wall of the housing and more drag therefore provided by the governor. The desired amount of drag is typically determined by the weight of the fabric. This type of governor is well known and, of course, resists rotation of the rollers 246, affected by the dual-wrap springs 288. It will, therefore, be appreciated that when the trigger arm is released to allow the covering to retract from an extended position, the dual-wrap spring will attempt to open the covering very rapidly but the governor will resist and provide a desired and more controlled speed of opening, which of course can be terminated at any time by shifting the trigger arm from the release position of FIG. 44 to the lock position of FIG. 43. The housing 346 for the governor is integral with a confronting support plate 402 that is secured to the support plate 358 on which the drive wheel 344 is rotatably mounted. The joined support plates are secured to the guide tracks 264 and 266 as seen, for example, in FIG. 42.

As mentioned previously, the support straps 268R and 268L support the top edge of the left 242 and right 244 fabric panels so that the associated support straps and panels can be wrapped about or unwrapped from their associated rollers 246. Referring to FIGS. 55A-57, each support strap can be seen to include a plurality of longitudinally aligned and spaced openings 404 of square cross-section with selected ones of the openings being adapted to releasably receive and support a connector 406 on a hanger 270. Each hanger has a depending vertical leg 408 with a hole 410 near its lower distal end in which a hanger pin or the like (not seen) positioned along the top edge of an associated fabric panel can be inserted so that the fabric panel is supported along its width from associated hangers on the support straps.

Each hanger 270 includes at a top end thereof a connector having a forwardly opening horizontal channel 412 and a rearwardly projecting male element 414 with upper and lower horizontal catch arms 416 adapted to mate with and be releasably secured to a slide member or female element 418 on the opposite side of the support strap. The connector at the top end of the hanger and the slide member are larger in dimension than the square hole through the support strap so that the hanger is connected and suspended from the support strap at the location of an associated square hole. It should also be appreciated, possibly by reference to FIG. 57, that the slide member 418, in combination with the male element 414, forms a horizontally extending elongated body 420 that is of trapezoidal cross-section and conforms to the transverse cross-section of the circumferential grooves 294 in the main body of the rollers 246. Since it is not necessarily desirable that a hanger be suspended from each hole in the support strap, dummy connectors 422, corresponding to the connector 406 at the top of each hanger, can be positioned in selected holes not occupied by a hanger, as shown for example in FIGS. 56A and 56B. The dummy connectors and hangers form trapezoidal guides along the length of the strap for cooperation with the grooves in the rollers so that the straps are guided around the rollers during operation of the covering and support the strap in its wrap around the roller. As mentioned previously, it is important that each wrap of the strap around a roller be spaced a predetermined amount depending upon the thickness of the fabric suspended from the strap. In order to control this spacing, the thickness of the connector at the top of each hanger 270 or dummy connector 422 is preselected and referred to herein as a spacer system. In other words, by increasing the thickness of the connector or dummy connector, the spacing between wraps of the straps 268R and 268L can be regulated.

Figure 66:
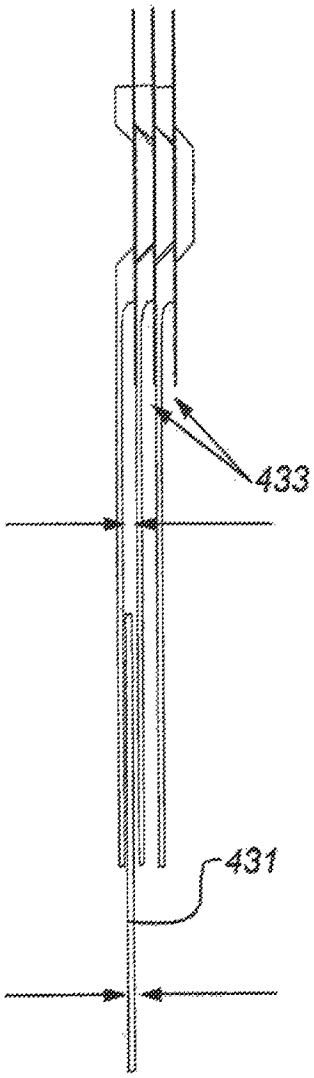
FIG. 66 is a diagrammatic view similar to FIGS. 64 and 65 wherein an even thinner fabric and thinner hangers are used.
Figure 65:
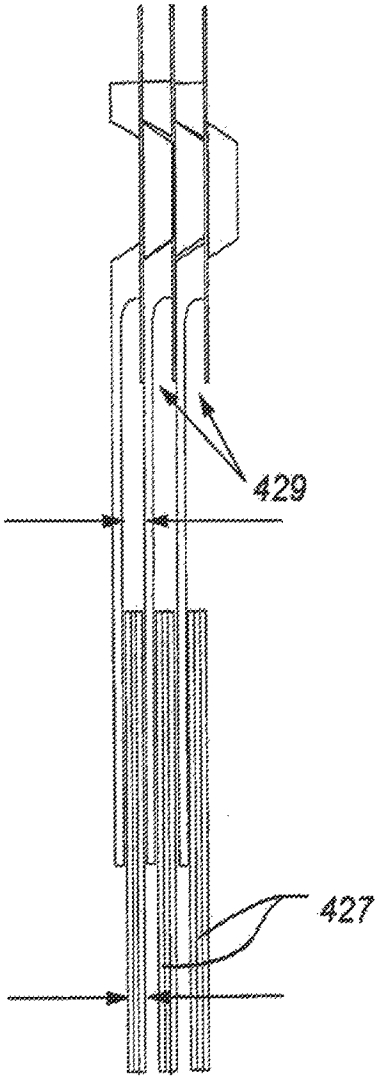
FIG. 65 is a diagrammatic view similar to FIG. 64 with a slightly thinner fabric and the use of thinner hangers for suspending the fabric.
Figure 64:
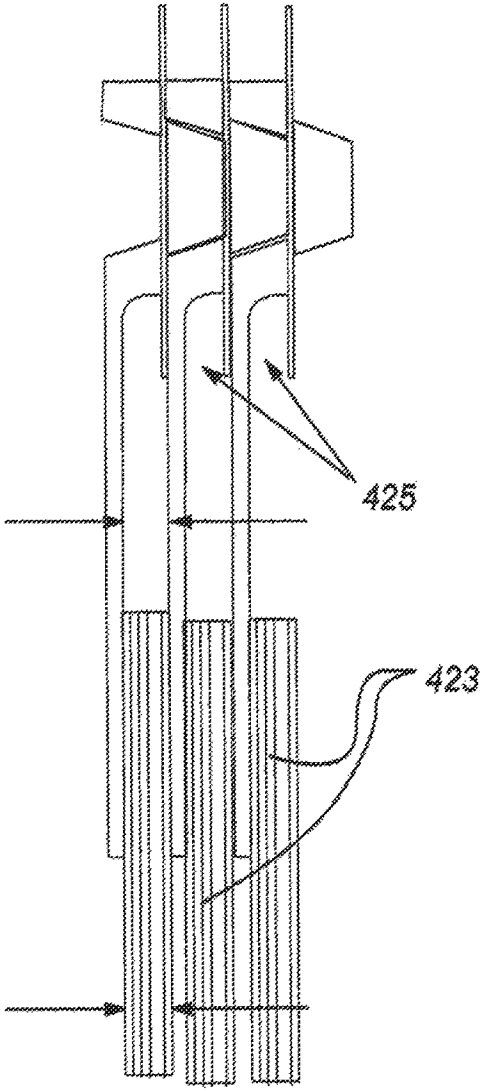
FIG. 64 is a diagrammatic view of the connection of a relatively thick fabric to relatively wide hangers to permit a substantially straight hang of the wrapped fabric material.

As is best illustrated by reference to FIGS. 64 through 66, FIG. 64 illustrates a relatively thick fabric 423 suspended from hangers 425 that are relatively thick and correspond generally to the thickness of the fabric. It will be appreciated in such an arrangement the fabric will hang substantially vertically without any external circumferential confinement inasmuch as the hanger thickness is predetermined to correlate with the fabric thickness so the fabric does not tend to flare outwardly from a tight wrap of the hangers at the top. FIG. 65 is an isometric view similar to FIG. 64 but wherein a somewhat thinner fabric 427 is suspended from somewhat thinner hangers 429 and FIG. 66 shows an even thinner fabric 431 suspended from even thinner hangers 433. The object being to avoid an outward flare of the fabric as it hangs downwardly from the hangers by correlating the thickness of the hangers to the thickness of the fabric. Both the male and female components of the hanger can be made thicker as illustrated in FIGS. 64 and 65 or it is also possible to make only the male component thicker so the female component only receives a portion of the male component but the overall result would be the same.

As mentioned previously, each circumferential groove 294 of a roller is of spiral configuration so that at one location 296 along the circumference of the roller, the groove is contiguous with the outer surface of the main body 290 extending in one direction but elevated from the outer surface extending in the opposite direction.

Also, as mentioned, the outer end of each support strap is secured to its associated roller 246 and that securement location is identified as the location 296 on the roller where a groove 294 is contiguous with the outer surface of the cylindrical main body 290. The strap then wraps around the roller along the spiral surface of the groove so that it progressively extends further and further radially away from the cylindrical surface of the roller and once it passes over the location 296 on the roller where the groove is both contiguous with and spaced from the cylindrical main body, a space is provided to accommodate the dummy 422 and actual 406 connectors so that a relatively smooth radially increasing wrap of a support strap around a roller is achieved.

Referring to FIG. 57, it will be seen the rear of each hanger 270 on the right strap 268R and the associated dummy connectors 422 confront the right roller 246 so that the elongated body 420 is received, as mentioned previously, in the groove 294 of the right roller. The hanger and dummy connectors in the left strap 268L, however, are oriented in an opposite direction so that the forwardly opening horizontal channel 412 confronts the left roller. Accordingly, a ring 424 (shown in FIG. 53 in dashed lines) is fixed in the upper groove of the left roller to protrude outwardly from the groove and be received in the forwardly opening horizontal channels 412. The ring, of course, assumes the same spiral configuration as the circumferential groove in which it is fixed.

It will be appreciated from the above that a center-draw covering has been described with left and right panels that can be wrapped around vertical rollers at each end of the covering with the rollers being rotatable in a first direction by pulling on a pull cord against the bias of a take-up spring system and returned in an opposite direction by the bias of the take-up spring system. In the embodiment as described, the pull cord extends the fabric panels across the architectural opening, while the spring system selectively retracts the covering. A drive system is provided so that when extending the covering, it can be extended to any degree and left to remain at that partially extended location regardless of the bias accumulating within the spring system, but the spring system can be permitted to act upon the covering to retract it with the simple release of a trigger arm through manipulation of the pull cord at one end of the headrail.

As mentioned previously with the earlier embodiments of the invention, the roller 246 as illustrated and described in connection with the third embodiment of the invention could be of any desired length with the roller illustrated being only a few inches in length. A roller extending the full height of the covering could in fact be used which might assist in assuring a vertical hanging orientation of the fabric as an edge of the fabric could be secured to the roller along the full height of the roller. In such an instance, the spacing of each wrap of the support strap at the top of the roller would not be as critical. In other words, the wraps would be maintained substantially uniformly along the full length of the roller. It is also important to note that should a full-length roller be utilized, it would not need to be anchored to the floor or other supporting surface at the bottom of the covering but could rather be only suspended at the top just as the shorter rollers, drums, or hubs described and illustrated previously.

Examples of full length rollers or roller components are illustrated in FIGS. 59 through 63. Referring first to FIG. 69, the rollers 246 at each end of a covering in accordance with the embodiment of FIGS. 31 through 58 are shown diagrammatically to include longitudinal cylindrical extensions 435 suspended from the rollers 246. The longitudinal extensions could be a somewhat rigid body conforming generally in diameter to the hub or roller 246 from which they are suspended and could be connected to the roller or hub in any suitable manner. It should be noted the cylindrical extensions 435 would not need to be anchored to the floor but would rather be capable of slight swinging movement which would give natural aesthetics to a wrap of fabric. Edges of the fabric (not seen) adjacent to the associated cylindrical extensions could be secured along their full height to the extensions so that as the fabrics are wrapped around the drums 246, the fabrics wrap about the cylindrical extensions correspondingly and therefore would not flare outwardly to any substantial degree and would present substantially vertical hangs of the wrapped fabrics when the covering was in a retracted position.

Figure 60:
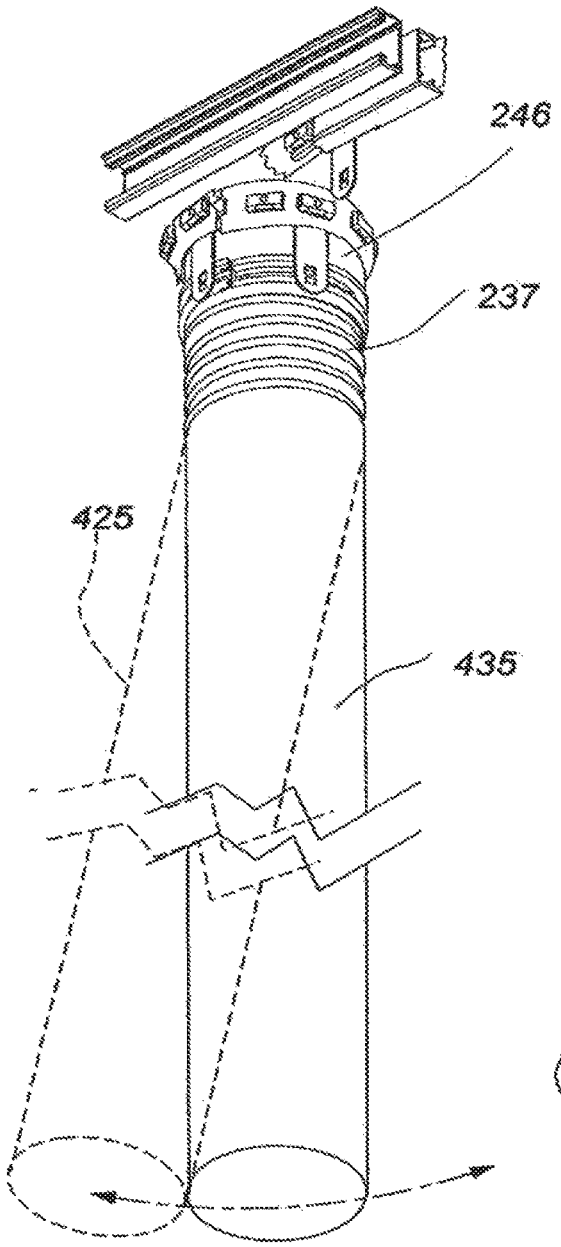
FIG. 60 is an isometric showing the tube illustrated on the left in FIG. 59 in an alternative form wherein the tube is suspended with a coil spring so as to be pivotable adjacent to the headrail.

Looking at FIG. 60, the cylindrical extension 435 is shown diagrammatically to be suspended from a roller 246 with a coil spring 437 that would be frictionally anchored at an upper edge to the roller 246 and would extend as a sleeve tightly around an upper portion of the cylindrical extension 435. In this manner, the cylindrical extension would be free to swing to a greater degree at its bottom than the embodiment shown in FIG. 59.

Figure 61:
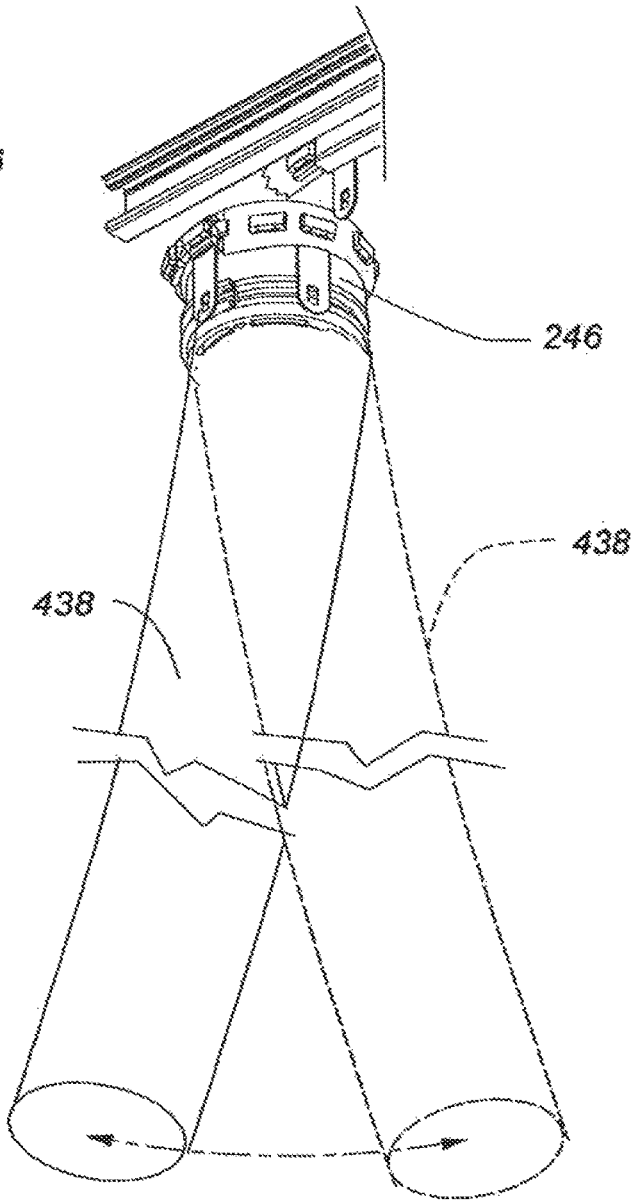
FIG. 61 is an isometric similar to FIG. 60 showing an embodiment of the roller wherein a flexible tube is suspended from the headrail.

Referring to FIG. 61, the cylindrical extension 438 is shown made of a somewhat flexible material that would retain its circular cross sectional configuration and would be anchored at an upper end to a roller 246 in any suitable manner but could flex slightly along its length as would appear natural for suspended fabrics.

Figure 62:
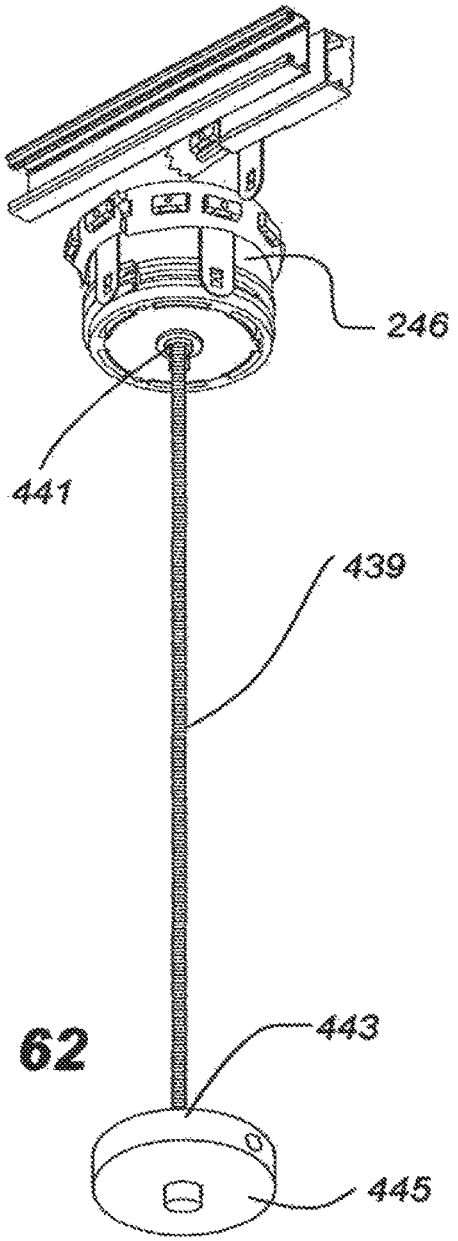
FIG. 62 is an isometric of a further arrangement for utilizing an elongated roller as opposed to a short hub or the like where a speedometer cable permits rotation of the top hub and a bottom disk to which the fabric is attached.
Figure 63:
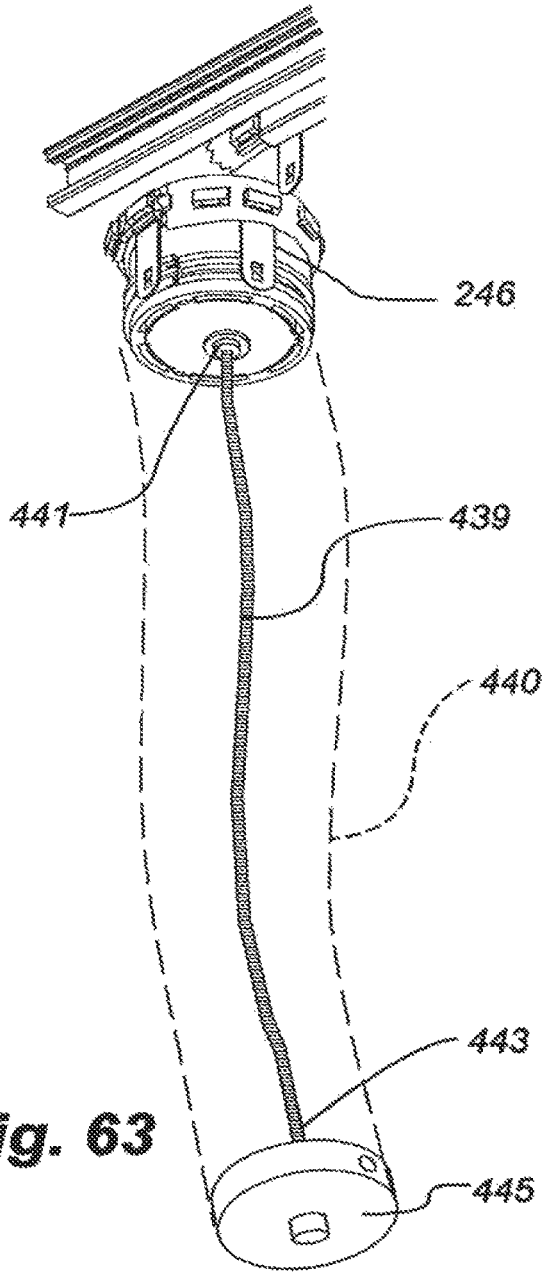
FIG. 63 is an isometric similar to FIG. 62 showing the speedometer cable flexing to permit flexing of the wrapped fabric material.

FIGS. 62 and 63 illustrate a further embodiment of an elongated attachment for a wrapped fabric 440 with this embodiment utilizing a flexible cable 439, such as of the type used as a speedometer cable, where rotation at one end of the cable, i.e., its top end, causes an equivalent rotation at the opposite end, i.e., the bottom end. The cable is flexible, however, along its length. The top end 441 of the cable can be seen in FIGS. 62 and 63 to be anchored to a hub or roller 246 so as to rotate therewith while the bottom end 443 of the cable is secured to a circular disk 445 to which an inner edge (not shown) of the fabric could be secured. Accordingly, when the fabric was wrapped around the drum 246, it would form a substantially uniform wrap around the disk as well as around itself as it extended along the length of the flexible cable.

Figure 67:
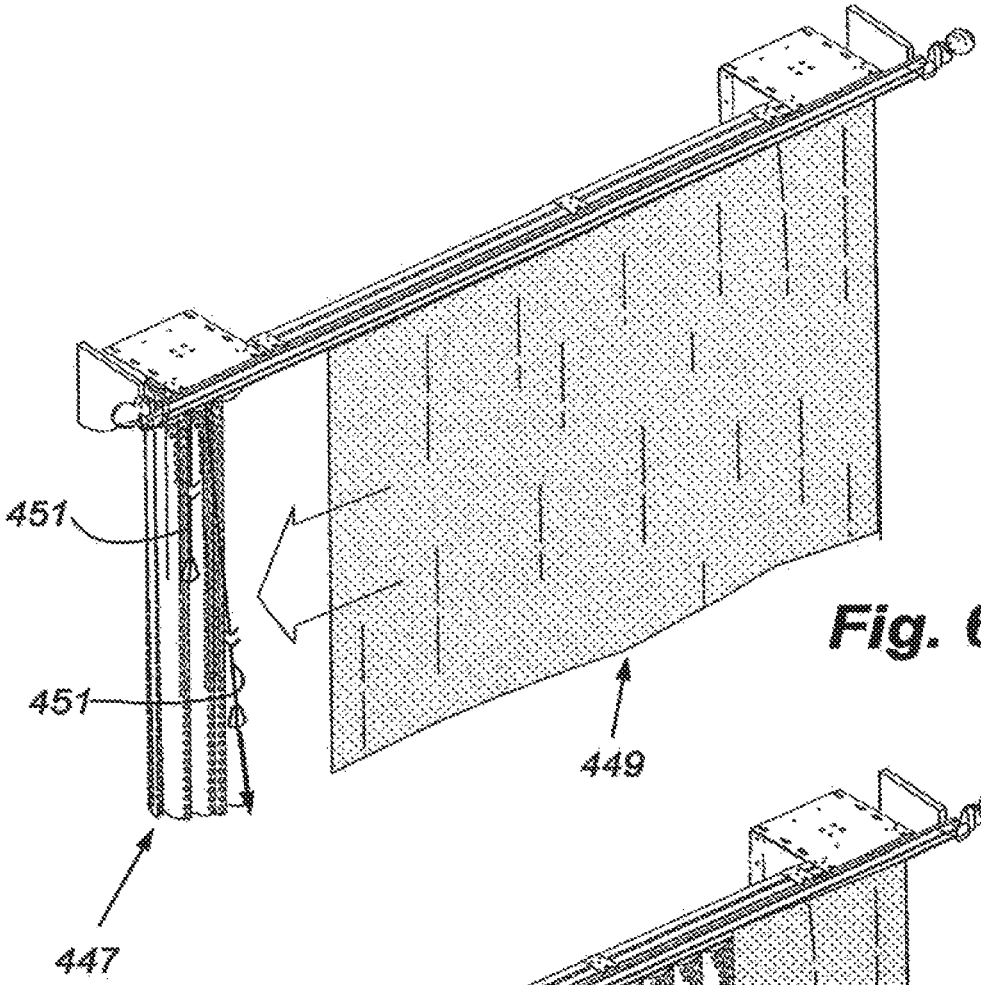
FIG. 67 is an isometric of a further alternative embodiment of the invention wherein a pair of side draw systems are utilized with a different fabric being wrapped at opposite ends of the covering and with one of the fabrics being extended.
Figure 68:
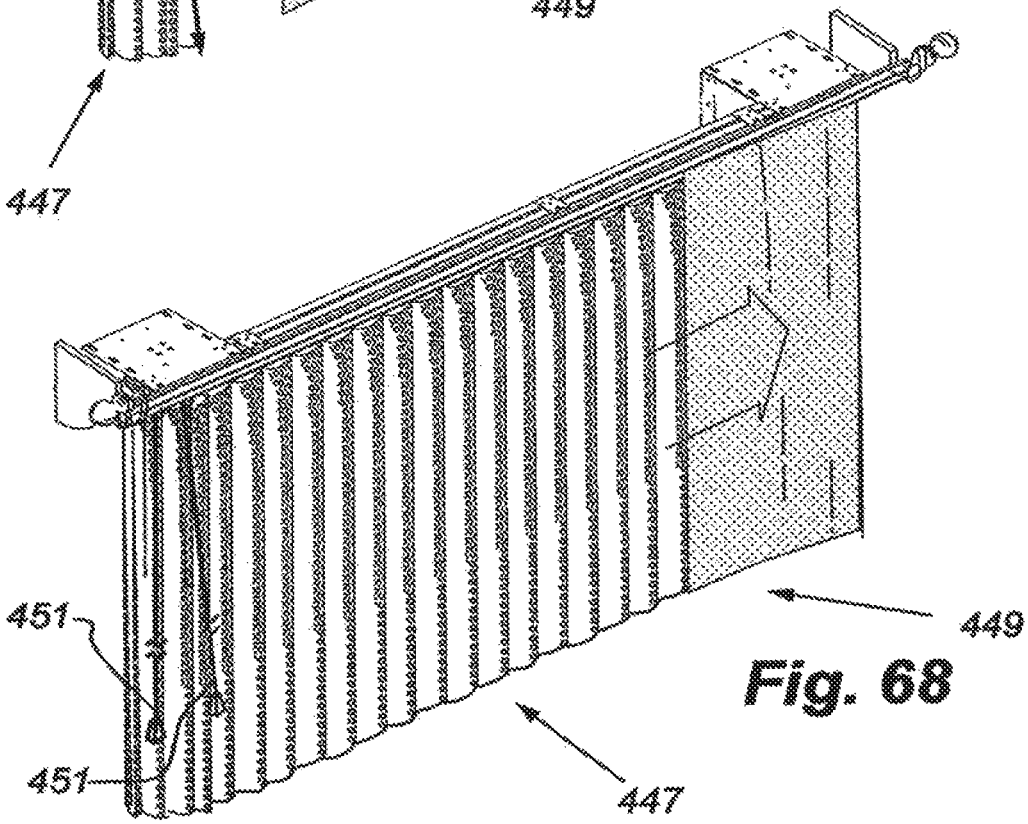
FIG. 68 is an isometric similar to FIG. 67 with the fabric from both ends being at least partially extended.

An alternative embodiment of the present invention is shown in FIGS. 67 and 68 with this embodiment utilizing a pair of the side draw systems shown in FIGS. 1 through 30. In other words, one side draw system of the type shown in FIGS. 1 through 30 is mounted so that a fabric 447 utilized therein is disposed at the left end of the architectural opening and a second usually different fabric 449 is mounted on an identical system that is mounted at the right hand of the architectural opening. In other words, one fabric would have its retracted position at the left end of the covering while the other fabric would have its retracted position at the right end of the covering. Either fabric could then be extended or retracted at will so it might be suitable for having a sheer fabric for example mounted at the right end as shown in FIGS. 67 and 68 and a looped or draped appearing fabric mounted at the left end. As shown in FIG. 67, the sheer fabric 449 is being extended while the looped fabric 447 is retracted and in FIG. 68 the sheer fabric is partially extended as is the looped fabric. FIGS. 67 and 68 also show the pull cords 451 for both systems being mounted at the left end of the covering even the cords associated with each fabric could be mounted at the end associated with the wrap of that fabric if desired. In order to mount both pull cords at the same end, a simple pulley system could be utilized as would be evident to those skilled in the art.

Although the present invention has been described with a certain degree of particularity, it is understood the disclosure has been made by way of example and changes in detail or structure may be made without departing from the spirit of the invention as defined in the appended claims.

The invention claimed is:

1. A retractable covering for an architectural structure, said covering comprising:

a roller rotatable about a first vertical axis;

a shade material wrappable about said roller;

a take-up drum rotatable about a second axis separate from said first vertical axis; and a spacer system coupled to said shade material, said spacer system including a first flexible element coupled to a top end of said shade material, said spacer system including a second flexible element coupled to said first flexible element and having a fixed end coupled to said take-up drum;

wherein beneath said roller said shade material is only wrapped about itself.

2. The covering as in claim 1, wherein, as said shade material is wrapped about said roller, said first flexible element wraps around said roller while said second flexible element unwraps from said take-up drum.

3. The covering as in claim 1, wherein said second axis comprises a second vertical axis and is spaced apart from said first vertical axis in a horizontal direction of said covering.

4. The covering as in claim 1, wherein said second axis comprises a horizontal axis.

5. The covering as in claim 1, wherein:

said roller and said take-up drum are supported relative to a headrail; and said first vertical axis and said second axis are aligned with each other along a lengthwise direction of said headrail.

6. The covering as in claim 1, wherein said shade material is movable between a retracted position in which said shade material is wrapped about said roller, and an extended position in which said shade material is unwrapped from said roller and extends across the architectural structure.

7. The covering as in claim 6, further comprising a spring and a governor operably coupled with said roller, said governor configured to inhibit the rotational speed of said roller during retraction of said shade material under the bias of said spring.

8. The covering as in claim 7, further comprising a planetary gear set that operably couples said governor with said roller to cause said governor to rotate at a faster speed than said roller.

9. The covering as in claim 6, further comprising:

a spring operably coupled with said roller;

a drive system operably coupled with said shade material; and an operating element operably coupled with said drive system to move said shade material from said retracted position to said extended position;

wherein said drive system and said operating element are operable to selectively restrain said shade material in said extended position against the bias of said spring and to selectively free said shade material in said extended position to allow said shade material to move from said extended position to said retracted position under the bias of said spring.

10. The covering as in claim 9, wherein:

said drive system comprises a drive gear and a trigger arm selectively engageable with said drive gear; and said operating element is operably coupled with said trigger arm such that manipulation of said operating element is operable to selectively engage said trigger arm with said drive gear to selectively restrain said shade material in said extended position.

11. The covering as in claim 10, wherein:

said drive system further comprises a drive wheel operably coupled with said operating element such that extension of said operating element from said drive system causes rotation of said drive wheel to extend said shade material across the architectural structure; and said drive wheel is operably coupled with said drive gear via a one-way bearing.

12. The covering as in claim 10, wherein:

when said trigger arm is engaged with said drive gear, said shade material is restrained in said extended position when said operating element is not being extended from said drive system; and when said trigger arm is disengaged from said drive gear, said shade material is free to be retracted under the bias of said spring when said operating element is not being extended from said drive system.

13. A retractable covering for an architectural structure, said covering comprising:

a roller rotatable about a first vertical axis;

a shade material wrappable relative to said roller to move said shade material between a retracted position in which said shade material is wrapped about said roller and an extended position in which said shade material is unwrapped from said roller and extends across the architectural structure;

a take-up drum rotatable about a second axis separate from said first vertical axis; and an element coupled to said shade material and wrappable around said take-up drum as said shade material is moved from said retracted position to said extended position;

wherein:

said take-up drum defines a variable outer diameter across at least a portion of said take-up drum about which said element wraps as said shade material is unwrapped from said roller; and said shade material is only wrapped about itself beneath said roller when said shade material is moved to said retracted position.

14. The covering as in claim 13, wherein said take-up drum defines a frustoconical shape such that said outer diameter varies from a minimum diameter to a maximum diameter across the portion of said take-up drum about which said element wraps as said shade material is unwrapped from said roller.

15. The covering as in claim 14, wherein:

said minimum diameter is substantially equal to an outer diameter of said roller; and said element is wrapped around said take-up drum from said maximum diameter to said minimum diameter as said shade material is unwrapped from said roller.

16. The covering as in claim 13, wherein said outer diameter varies between a minimum diameter and a maximum diameter as a function of an effective diameter of said roller as said shade material is wrapped around and unwrapped from said roller.

17. The covering as in claim 13, wherein said outer diameter is varied such that said shade material is unwound from said roller at the same speed as said element is wrapped about said take-up drum.

18. The covering as in claim 13, wherein said second axis comprises a second vertical axis and is spaced apart from said first vertical axis in a horizontal direction of said covering.

19. A retractable covering for an architectural structure, said covering comprising:

a roller rotatable about a first vertical axis;

a shade material wrappable relative to said roller to move said shade material between a retracted position in which said shade material is wrapped about said roller and an extended position in which said shade material is unwrapped from said roller and extends across the architectural structure;

a take-up drum rotatable about a second axis separate from said first vertical axis; and an element coupled to said shade material and wrappable around said take-up drum;

wherein:

rotation of said take-up drum about said second axis is coordinated with rotation of said roller about said first vertical axis such that said element wraps around said take-up drum as said shade material unwraps from said roller with movement of said shade material from said retracted position to said extended position; and said take-up drum is rotatably coupled to said roller such that rotational motion of one of said take-up drum or said roller is transferred to the other of said take-up drum or said roller.

20. The covering as in claim 19, wherein said take-up drum is rotatably coupled to said roller via an intermediate gear such that said roller rotates about said first vertical axis in a first direction as said take-up drum rotates about said second axis in an opposite second direction.

21. The covering as in claim 19, wherein the rotation of said take-up drum is coordinated with the rotation of said roller such that said shade material is unwound from said roller at the same speed as said element is wrapped about said take-up drum.

22. The covering as in claim 19, wherein said shade material is only wrapped about itself beneath said roller when said shade material is moved to said retracted position.

23. The covering as in claim 19, wherein said take-up drum defines a variable outer diameter across at least a portion of said take-up drum about which said element wraps as said shade material is unwrapped from said roller.

24. The covering as in claim 23, wherein said outer diameter varies as a function of an effective diameter of said roller as said shade material is wrapped around and unwrapped from said roller.

* * * * *